US005830627A

United States Patent [19]

Nakai et al.

[11] Patent Number: 5,830,627

[45] Date of Patent: Nov. 3, 1998

[54] SILVER HALIDE COLOR PHOTOGRAPH MATERIAL AND METHOD FOR FORMING IMAGE USING THE SAME

[75] Inventors: Yasufumi Nakai; Jiro Tsukahara; Toshio Kawagishi, all of Minami-ashigara, Japan

[73] Assignee: Fuji Photo Film Co., Ltd., Kanagawa, Japan

[21] Appl. No.: 832,561

[22] Filed: Apr. 2, 1997

[30] Foreign Application Priority Data

Apr. 2, 1996 [JP] Japan ..... 8-080211

[51] Int. Cl.[6] ..... G03C 1/06

[52] U.S. Cl. ..... 430/505; 430/5; 430/956; 430/957; 430/958; 430/959; 430/960

[58] Field of Search ..... 430/505, 544, 430/956, 954, 958, 959, 960

[56] References Cited

U.S. PATENT DOCUMENTS

| | | | |
|---|---|---|---|
| 4,734,353 | 3/1988 | Ono et al. | 430/959 |
| 4,740,363 | 4/1988 | Hirai et al. | 423/641 |
| 4,740,453 | 4/1988 | Nakamura et al. | 430/959 |
| 4,857,444 | 8/1989 | Hirose et al. | 430/505 |
| 4,865,963 | 9/1989 | Furutachi et al. | 430/505 |
| 4,994,363 | 2/1991 | Koya et al. | 430/959 |
| 5,075,208 | 12/1991 | Watanabe et al. | 430/958 |
| 5,242,785 | 9/1993 | Morigaki et al. | 430/505 |

FOREIGN PATENT DOCUMENTS

| | | |
|---|---|---|
| 61-156126 | 7/1986 | Japan . |
| 2-2553 | 1/1990 | Japan . |
| 8-54705 | 2/1996 | Japan . |
| 8-54724 | 2/1996 | Japan . |

*Primary Examiner*—Hoa Van Le
*Attorney, Agent, or Firm*—Birch, Stewart, Kolasch & Birch, LLP

[57] ABSTRACT

A silver halide color photographic material is described, which comprises a support having provided thereon a blue-sensitive silver halide emulsion layer, a green-sensitive silver halide emulsion layer, and a red-sensitive silver halide emulsion layer, wherein the photographic material contains at least one compound having a photographically useful compound which is inactivated by the chelation with a metal, and the ratios of the gradients of yellow, magenta and cyan in specific development processing II to the gradients thereof in specific development processing I satisfy the following conditions:

$0.8 \leqq \gamma_{II}(Y)/\gamma_{I}(Y) \leqq 1.2$ $0.8 \leqq \gamma_{II}(M)/\gamma_{I}(M) \leqq 1.2$ $0.8 \leqq \gamma_{II}(C)/\gamma_{I}(C) \leqq 1.2$ wherein $\gamma_{I}(Y)$, $\gamma_{I}(M)$ and $\gamma_{I}$ (C) each represents the gradient of yellow, magenta or cyan when the development processing I is carried out and $\gamma_{II}(Y)$, $\gamma_{II}(M)$ and $\gamma_{II}(C)$ each represents the gradient of yellow, magenta or cyan when the development processing II is carried out, with which the upset of the balance of gradation due to shortening of the color development processing time can be improved, and the same gradation in any processing now widely prevailing and rapid processing can be provided. A method for forming an image using the same is also described.

18 Claims, No Drawings

SILVER HALIDE COLOR PHOTOGRAPH MATERIAL AND METHOD FOR FORMING IMAGE USING THE SAME

FIELD OF THE INVENTION

The present invention relates to a silver halide color photographic material which is suitable for rapid processing and a method for forming an image using the same and, in particular, relates to a silver halide color photographic material which is improved in the upset of the balance of gradation due to shortening of the color development processing time, and which is capable of providing the same gradation in any processing now widely prevailing and rapid processing, and relates to a method for forming an image using the same.

BACKGROUND OF THE INVENTION

The development processing time of a color negative light-sensitive material has been extremely reduced by the introduction of C-41 processing by Eastman Kodak in 1972, and the wet processing time exclusive of drying process has been shortened to 17 minutes and 20 seconds. Further, in recent years, the wet processing time has been speeded up to 8 minutes and 15 seconds by the introduction of CN-16FA processing of Fuji Photo Film Co., Ltd. for a minilab market.

Even now when rapid processing has prevailed, finishing of printing of a negative light-sensitive material asked by a user requires 30 minutes or so even by the most quick finishing in a store (a so-called minilab). Therefore, most users have to come to the store two times. Accordingly, in the systems of a color negative film and a color paper at present, further sharp speedup of the development processing time is desired to respond to the demand of users of having done with going to the store by one time.

The reduction of the development processing time has been conventionally conducted mainly by the shortening of the desilvering step after the color development processing step. Taking the above-described C-41 processing and CN-16FA processing as examples, the color developing time of the former is 3 minutes and 15 seconds, that of the latter is 3 minutes and 5 seconds, and they are much the same with respect to the color developing time. In CN-16FA processing, the color developing time occupies about 40% of the entire development processing time. Therefore, the speedup of the color developing time is essential for further sharp reduction of the development processing time.

On the other hand, C-41 processing and the development processing interchangeable therewith (e.g., CN-16FA processing) have prevailed world-widely. For introducing the rapid processing whose color developing time is speeded up into the practical market, this rapid processing is required to have the interchangeability with C-41 processing.

A color negative light-sensitive material in general comprises several spectral-sensitive silver halide emulsion layers and is designed so as to have optimal balance of gradation of emulsion layers when development processed, but when rapid processing the color developing time of which is speeded up is carried out, the balance of gradation is upset and the color reproducibility is conspicuously deteriorated.

A processing method of obtaining the same gradation when development processing is conducted respectively with different color developing times is disclosed for example, in JP-A-2-2553 (the term "JP-A" as used herein means an "unexamined published Japanese patent application"). According to this method, the same gradation can be obtained by changing the processing temperature, the concentration of the color developing agent in a color developing solution and the color developing time. Specifically, it is disclosed in Example 1 of the above patent application that the same gradation as the gradation (a $\gamma$ value) which is obtained by the processing temperature of 38° C., the concentration of the color developing agent of 15 mmol/liter, and the color developing time of 3 minutes and 15 seconds (this processing is thought to be equal to C-41 processing) can be obtained by the processing temperature of 38° C., the concentration of the color developing agent of 150 mmol/liter, and the color developing time of 1 minute and 30 seconds.

However, since the concentration of the color developing agent according to the above method of shortening the color developing time exceeds 100 mmol/liter, the self-coupling reaction of the color developing agent in the color developing solution is conspicuously accelerated, fluctuations of photographic characteristics after storage due to the reduction of the concentration of the color developing agent are large, and the coloring to the photographic material by the product of the self-coupling reaction increases. Further, the amount of the color developing agent remaining in the photographic material after development processing increases and, in particular, the density in the unexposed portion (stain) of the photographic material markedly rises when stored at room temperature.

With a view to avoiding the above problem, the color developing time was shortened to 1 minute and 30 seconds or less with the concentration of the color developing agent being 80 mmol/liter or less and the processing temperature being 40° C. or more, as a result, the diffusion of the color developing agent became rate-determined and the development of the lower layer (the emulsion layer nearer to the support) of the photographic material was delayed than the development of the upper layer (the emulsion layer farther from the support), and the balance of gradation of the upper layer with the lower layer was upset and the color reproducibility was conspicuously deteriorated.

A method of introducing a coupler which releases a developing agent upon coupling reaction into a photographic material as disclosed, for example, in JP-A-61-156126 is known as a method of accelerating development during color development processing. However, the balance of gradation could not be improved by the introduction of such a compound because development was accelerated in ordinary processing and rapid processing.

SUMMARY OF THE INVENTION

Accordingly, an object of the present invention is to provide a silver halide color photographic material which is improved in the upset of the balance of gradation due to shortening of the color developing time, and which is capable of providing images of the same gradation in any development processing now widely prevailing and super-rapid processing in which the color developing time is speeded up, and a further object is to provide a method for forming an image using the same.

The above objects of the present invention can be achieved by the photographic material having the following constitution.

(1) A silver halide color photographic material comprising a support having provided thereon at least one blue-sensitive silver halide emulsion layer, at least one green-sensitive silver halide emulsion layer, and at least one red-sensitive silver halide emulsion layer, wherein said photographic material contains at least one compound having a photographically useful compound which is inactivated by the chelation with a metal, and when the following development processing I and the following development processing II are carried out, the ratios of the gradients in processing II to the gradients in processing I of yellow, magenta and cyan obtained by said two kinds of development processing satisfy the following conditions:

$0.8 \leqq \gamma_{II}(Y)/\gamma_{I}(Y) \leqq 1.2$ $0.8 \leqq \gamma_{II}(M)/\gamma_{I}(M) \leqq 1.2$ $0.8 \leqq \gamma_{II}(C)/\gamma_{I}(C) \leqq 1.2$ wherein $\gamma_I(Y)$, $\gamma_I(M)$ and $\gamma_I(C)$ each represents the gradient of yellow, magenta or cyan when development processing I is carried out and $\gamma_{II}(Y)$, $\gamma_{II}(M)$ and $\gamma_{II}(C)$ each represents the gradient of yellow, magenta or cyan when development processing II is carried out, development processing I:

development processing is characterized in that color development processing is carried out (i) for 3 minutes and 15 seconds of the color developing time, (ii) at the temperature of a color developing solution of 38° C., and (iii) using a color developing solution containing from 15 to 20 mmol/liter of 2-methyl-4-[N-ethyl-N-(β-hydroxyethyl)-amino] aniline;

development processing II:

development processing is characterized in that color development processing is carried out (i) for 60 seconds of the color developing time, (ii) at the temperature of a color developing solution of 45° C., and (iii) using a color developing solution containing from 35 to 40 mmol/liter of 2-methyl-4-[(N-ethyl-N-(β-hydroxyethyl)amino]aniline, and containing a water-soluble nitrogen-containing heterocyclic carboxylic acid chelating agent.

(2) The silver halide color photographic material as described in (1), wherein the above-described metal is boron, magnesium, aluminum, calcium, nickel, copper or zinc.

(3) The silver halide color photographic material as described in (1), wherein the above-described photographically useful compound is a developing agent, an auxiliary developing agent, a fogging agent, a development accelerator, or a development inhibitor.

(4) The silver halide color photographic material as described in (1), wherein the above-described compound having a photographically useful compound which is inactivated by the chelation with a metal is represented by the following formula (I), (II) or (III):

$$(PUG—LINK—LIG)_n \cdot M \cdot L_k \quad (I)$$

$$(BP—LINK—LIG)_n \cdot M \cdot L_k \quad (II)$$

$$(PL)_n \cdot M \cdot L_k \quad (III)$$

wherein PUG represents a photographically useful group; LINK represents a single bond or a divalent linking group; LIG represents a chelate group; BP represents a photographically useful group which is blocked; PL represents a photographically useful group having the chelating ability; M represents any of boron, magnesium, aluminum, calcium, nickel, copper or zinc; L represents a chelate ligand; n represents an integer of from 1 to 3; and k represents 0, 1 or 2.

(5) The silver halide color photographic material as described in (4), wherein M represents zinc.

(6) The silver halide color photographic material as described in (4), wherein the atom bonded to M is nitrogen or oxygen.

(7) The silver halide color photographic material as described in any one of the above (1), (2), (3), (4), (5) or (6), wherein said photographic material contains said compound having a photographically useful compound which is inactivated by the chelation with a metal as solid particles.

(8) The silver halide color photographic material as described in any one of the above (1), (2), (3), (4), (5), (6) or (7), wherein said compound having a photographically useful compound which is inactivated by the chelation with a metal is contained in the light-sensitive silver halide emulsion layer nearest to the support or in the layer adjacent thereto.

(9) A method for forming a color image using the silver halide color photographic material as described in any one of the above (1), (2), (3), (4), (5), (6), (7) or (8), wherein a color image is formed by carrying out the following development processing A, development processing A:

development processing is characterized in that color development processing is carried out (i) for from 150 seconds to 200 seconds of the color developing time, (ii) at the temperature of a color developing solution of from 35 to 40° C., and (iii) using a color developing solution containing from 10 to 20 mmol/liter of a color developing agent.

(10) A method for forming a color image using the silver halide color photographic material as described in any one of the above (1), (2), (3), (4), (5), (6), (7) or (8), wherein a color image is formed by carrying out the following development processing B, development processing B:

development processing is characterized in that color development processing is carried out (i) for from 25 seconds to 90 seconds of the color developing time, (ii) at the temperature of a color developing solution of from 40 to 60° C., and (iii) using a color developing solution containing from 25 to 80 mmol/liter of a color developing agent, and containing a water-soluble nitrogen-containing heterocyclic carboxylic acid chelating agent.

DETAILED DESCRIPTION OF THE INVENTION

A water-soluble chelating agent is contained from the first in color development processing solutions of C-41 processing and the development processing interchangeable therewith (e.g., CN-16FA processing) for the purpose of masking metal ions. On the basis of this fact, by making use of a chelate exchange reaction in the release of a photographically useful compound, a combination of a metal complex having high reaction selectivity with a chelating agent has been investigated to design the series which is inactive in ordinary processing but reveals the function only in rapid processing. As a result of examination of various compounds, it was found that a compound having a photographically useful compound which is inactivated by the chelation with a metal according to the present invention has particularly high reactivity with a water-soluble nitrogen-containing heterocyclic carboxylic acid chelating agent, thus the reaction control between two kinds of processing has become possible.

A compound having a photographically useful compound which is inactivated by the chelation with a metal according to the present invention will be described in detail below.

Any compound which has a photographically useful compound, has high reactivity with a water-soluble chelating agent contained in a color developing solution or the prebath thereof, raises a chelate exchange reaction with the water-soluble chelating agent and releases the photographically useful compound can be used as such a compound.

The compound represented by the above formula (I), (II) or (III) is preferably used as such a compound.

In formula (I), PUG represents a photographically useful group. Functions of a photographically useful group include a development inhibitor, a dye, a fogging agent, a developing agent, an auxiliary developing agent, a coupler, a bleach accelerator, a development accelerator, a fixing accelerator, etc. Preferred examples of photographically useful groups include the photographically useful groups disclosed in U.S. Pat. No. 4,248,962 (the group represented by PUG in said patent), the dyes disclosed in JP-A-62-49353 (the releasing group moiety released from the coupler in said patent), the development inhibitors disclosed in U.S. Pat. No. 4,477,563, and the bleach accelerators disclosed in JP-A-61-201247 and JP-A-2-55 (the releasing group moiety released from the coupler in said patent application).

Photographically useful groups in the present invention are preferably compounds which can reduce silver halide (specifically, a developing agent, an auxiliary developing agent, a fogging agent, etc.).

Examples of compounds which can reduce silver halide include hydroquinones, catechols, p-aminophenols, p-phenylenediamines, 1-phenyl-3-pyrazolidones, reductones, sulfonamidophenols, sulfonamidonaphthols, aminohydroxy-pyrazoles, aminopyrazolines, hydrazines, and hydroxylamines. Particularly preferred of them are hydroquinones, p-amino-phenols, p-phenylenediamines, and 1-phenyl-3-pyrazolidones. 1-Phenyl-3-pyrazolidones are most preferred.

In formulae (I) and (II), LINK represents a single bond or a divalent linking group. Examples of preferred linking groups include an ether bond, an alkylene group (e.g., methylene, ethylene, xylylene), an arylene group (e.g., phenylene), and divalent groups shown below. Divalent groups of two or more of these divalent groups bonded in series are also included. These groups may be substituted with a substituent.

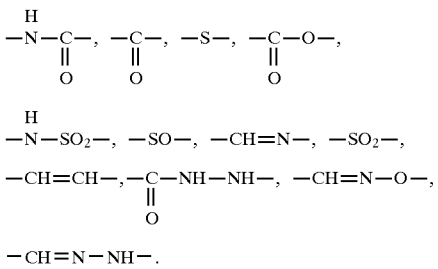

Examples of the substituents include an alkyl group (e.g., methyl, ethyl, isobutyl, n-dodecyl, cyclohexyl), an aryl group (e.g., phenyl, naphthyl), an aralkyl group (e.g., benzyl, phenethyl), a heterocyclic group (e.g., groups derived from pyridine, thiophene, furan, imidazole, oxazole, indole, benzothiazole, hydantoin, oxazolidinedione), a halogen atom (e.g., fluorine, chlorine, bromine), an alkoxyl group (e.g., methoxy, ethoxy, benzyloxy), an aryloxy group (e.g., phenoxy), an alkylthio group (e.g., methylthio, ethylthio), an arylthio group (e.g., phenylthio), a hydroxy group, a nitro group, a cyano group, an amido group (e.g., acetylamino, benzoylamino), a sulfonamido group (e.g., methanesulfonylamino, benzenesulfonylamino), a ureido group (e.g., 3-phenylureido), a urethane group (e.g., isobutoxy-carbonylamino, carbamoyloxy), an ester group (e.g., acetoxy, benzoyloxy, methoxycarbonyl, phenoxycarbonyl), a carbamoyl group (e.g., N-methylcarbamoyl, N,N-diphenylcarbamoyl), a sulfamoyl group (e.g., N-phenylsulfamoyl), an acyl group (e.g., acetyl, benzoyl), an amino group (e.g., amino, methylamino, anilino, diphenylamino), a sulfonyl group (e.g., methylsulfonyl), a carboxyl group, and a sulfo group. These substituents may further have the above substituents on the carbon atoms.

In formulae (I) and (II), LIG represents a chelate group having from 2 to 6 coordination groups. A coordination group is a group having at least one atom having lone pair (preferably a nitrogen atom or an oxygen atom). Specific examples of coordination groups include a nitrogen-containing heterocyclic residue (e.g., a residue obtained by eliminating a hydrogen atom from a nitrogen-containing heterocyclic ring such as pyridine, pyrazine, pyrimidine, piperidine, piperazine, oxazine, thiazine, quinoline, morpholine, pyrrole, imidazole, pyrazole, oxazole, thiazole, benz-imidazole, and indole), a carbonyl group, a carboxyl group, a hydroxyl group, an amino group, a hydroxylamino group, a hydrazino group, an imino group, oxime, hydrazone, an amido group, an imido group, hydrazide and hydroxamic acid.

A ring formed by a chelate group represented by LIG with a metal atom is a 5- to 8-membered ring, preferably a 5- or 6-membered ring. Further, when a chelate group is coordinated with a metal, a hydrogen ion may be released.

LIG is preferably a group obtained by eliminating an optional hydrogen atom from the following compounds. Such a group may have a substituent as the above LINK.

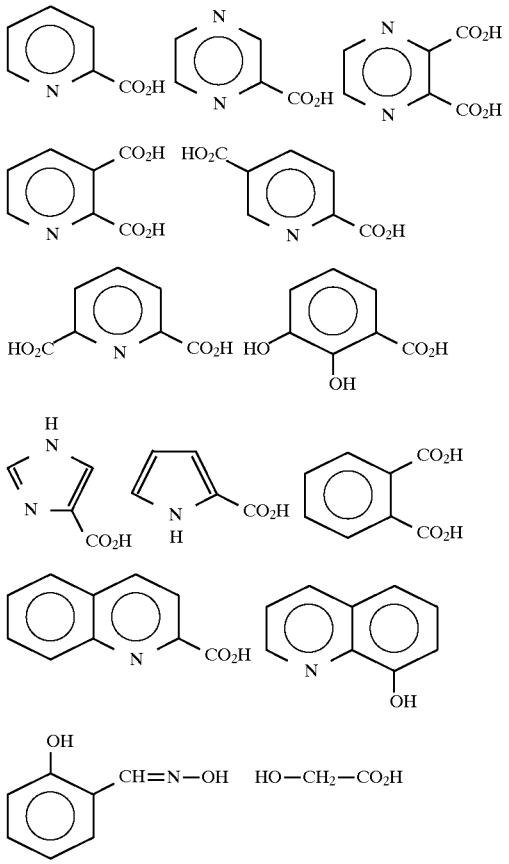

-continued

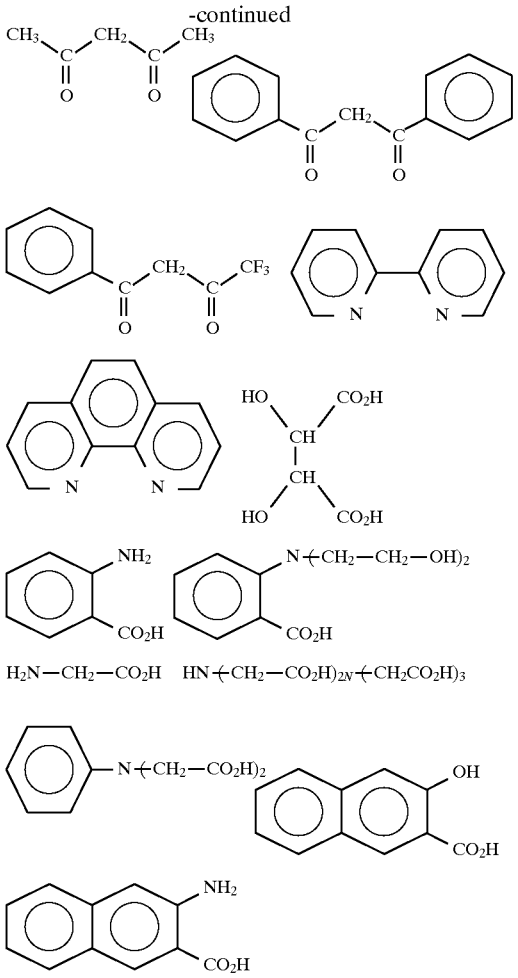

In formula (II), BP represents a photographically useful group which is blocked.

A photographically useful group which is blocked is a residue of the compound whose active proton necessary to reveal the activity of the photographically useful group is substituted with a known blocking group, and a —LINK—LIG group may be bonded to the blocking group moiety or may be bonded to the photographically useful group moiety.

The photographically useful group in BP is the same as PUG described above.

As the blocking group in the photographically useful group which is blocked represented by BP in formula (II), the following already known groups can be applied. That is, there can be cited blocking groups such as an acyl group and a sulfonyl group as disclosed in JP-B-48-9968 (the term "JP-B" as used herein means an "examined Japanese patent publication"), JP-A-52-8828, JP-A-57-82834, U.S. Pat. No. 3,311,476 and JP-B-47-44805 (corresponding to U.S. Pat. No. 3,615,617), blocking groups making use of a reverse Michael reaction as disclosed in JP-B-55-17369 (corresponding to U.S. Pat. No. 3,888,677), JP-B-55-9696 (corresponding to U.S. Pat. No. 3,791,830), JP-B-55-34927 (corresponding to U.S. Pat. No. 4,009,029), JP-A-56-77842 (corresponding to U.S. Pat. No. 4,307,175), JP-A-59-105640, JP-A-59-105641 and JP-A-59-105642, blocking groups making use of the production of quinonemethide or the compounds analogous to quinonemethide by intramolecular electron transfer as disclosed in JP-B-54-39727, U.S. Pat. Nos. 3,674,478, 3,932,480, 3,993,661, JP-A-57-135944, JP-A-57-135945 (corresponding to U.S. Pat. No. 4,420,554), JP-A-57-136640, JP-A-61-196239, JP-A-61-196240 (corresponding to U.S. Pat. No. 4,702,999), JP-A-61-185743, JP-A-61-124941 (corresponding to U.S. Pat. No. 4,639,408), and JP-A-2-280140, blocking groups making use of an intramolecular nucleophilic substitution reaction as disclosed in U.S. Pat. Nos. 4,358,525, 4,330,617, JP-A-55-53330 (corresponding to U.S. Pat. No. 4,310,612), JP-A-59-121328, JP-A-59-218439 and JP-A-63-318555 (corresponding to EP-A-295729), blocking groups making use of a ring cleavage reaction of a 5- or 6-membered ring as disclosed in JP-A-57-76541 (corresponding to U.S. Pat. No. 4,335,200), JP-A-57-135949 (corresponding to U.S. Pat. No. 4,350,752), JP-A-57-179842, JP-A-59-137945, JP-A-59-140445, JP-A-59-219741, JP-A-59-202459, JP-A-60-41034 (corresponding to U.S. Pat. No. 4,618,563), JP-A-62-59945 (corresponding to U.S. Pat. No. 4,888,268), JP-A-62-65039 (corresponding to U.S. Pat. No. 4,772,537), JP-A-62-80647, JP-A-3-236047 and JP-A-3-238445, blocking groups making use of an addition reaction of a nucleophilic agent to conjugated unsaturated bond as disclosed in JP-A-59-201057 (corresponding to U.S. Pat. No. 4,518,685), JP-A-61-43739 (corresponding to U.S. Pat. No. 4,659,651), JP-A-61-95346 (corresponding to U.S. Pat. No. 4,690,885), JP-A-61-95347 (corresponding to U.S. Pat. No. 4,892,811), JP-A-64-7035, JP-A-4-42650 (corresponding to U.S. Pat. No. 5,066,573), JP-A-1-245255, JP-A-2-207249, JP-A-2-235055 (corresponding to U.S. Pat. No. 5,118,596), and JP-A-4-186344, blocking groups making use of a $\mu$-elimination reaction disclosed in JP-A-59-93442, JP-A-61-32839, JP-A-62-163051 and JP-B-5-37299, blocking groups making use of a nucleophilic substitution reaction of diarylmethanes as disclosed in JP-A-61-188540, blocking groups making use of a Lossen rearrangement reaction as disclosed in JP-A-62-187850, blocking groups making use of a reaction of N-acyl compound of thiazolidine-2-thione with amines as disclosed in JP-A-62-80646, JP-A-62-144163 and JP-A-62-147457, blocking groups having two electrophilic groups and react with a dinucleophilic agent as disclosed in JP-A-2-296240 (corresponding to U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-17998, JP-A-4-184337, JP-A-4-184338, WO 92/21064, JP-A-4-330438, WO 93/03419 and JP-A-5-45816, or blocking groups making use of an aromatic nucleophilic substitution reaction as disclosed in EP-A-572084, EP-A-573099 and EP-A-684512.

Further, so-called coupler residues which release photographically useful groups upon reaction with the oxidation products of color developing agents are also useful as blocking groups.

Coupler residues specifically represent a yellow color image-forming coupler residue, a magenta color image-forming coupler residue, a cyan color image-forming coupler residue, a colorless dye-forming coupler residue, or a coupler residue capable of forming a wash-out dye, and they are disclosed in detail in *Research Disclosure*, 37038 (February, 1995), pages from 80 to 85 and from 87 to 89.

Examples of yellow color image-forming coupler residues include, for example, pivaloylacetanilide type, benzoylacetanilide type, malondiester type, malondiamide type, dibenzoylmethane type, benzothiazolylacetamide type, malonestermonoamide type, benzoxazolylacetamide type, benzimidazolylacetamide type, benzothiazolylacetamide type, cycloalkanoylacetamide type, indolin-2-ylacetamide type, quinazolin-4-one-2-ylacetamide type (disclosed in U.S. Pat. No. 5,021,332), and benz-1,2,4-thiadiazine-1,1-dioxide-3-yl-acetamide type (disclosed in U.S. Pat. No. 5,021,330) coupler residues, further, the coupler residues disclosed in EP-A-421221, U.S. Pat. Nos. 5,455,149 and EP-A-622673.

Examples of magenta color image-forming coupler residues include, for example, 5-pyrazolone type, H-pyrazolo-[1,5-a]benzimidazole type, 1H-pyrazolo[5,1-c][1,2,4] triazole type, 1H-pyrazolo[1,5-b][1,2,4]triazole type, 1H-imidazo-[1,2-b]pyrazole type, cyanoacetophenone type, active propene type (disclosed in WO 93/01523), enamine type (disclosed in WO 93/07534), and 1H-imidazo[1,2-b] [1,2,4]triazole type coupler residues, further, the coupler residues disclosed in U.S. Pat. No. 4,871,652.

Examples of cyan color image-forming coupler residues include, for example, phenol type, naphthol type, 2,5-diphenylimidazole type (disclosed in EP-A-249453), 1H-pyrrolo[1,2-b][1,2,4]triazole type, 1H-pyrrolo[2,1-c][1,2,4]-triazole type, pyrrole type (disclosed in JP-A-4-188137 and JP-A-4-190347), 3-hydroxypyridine type (disclosed in JP-A-1-315736), pyrrolopyrazole type (disclosed in U.S. Pat. No. 5,164,289), pyrroloimidazole type (disclosed in JP-A-4-174429), pyrazolopyrimidine type (disclosed in U.S. Pat. No. 4,950,585), and pyrrolotriazine type (disclosed in JP-A-4-204730) coupler residues, further, the coupler residues disclosed in U.S. Pat. Nos. 4,746,602, 5,104,783, 5,162,196 and EP-A-556700.

As examples of colorless dye-forming coupler residues and a coupler residue capable of forming a wash-out dye, for example, indanone type and acetophenone type coupler residues and the coupler residues disclosed in EP-A-443530, EP-A-444501, JP-A-6-138612, JP-A-6-82995, JP-A-6-82996 and JP-A-6-82998 can be cited.

Of these blocking groups, those particularly preferred are represented by the following formula (A-1), (A-2), (A-3), (A-4), (A-5), (A-6), (A-7), (A-8), (A-9), (A-10) or (A-11). # indicates the position to be bonded to a photographically useful group, and a blocking group is bonded to a photographically useful group such that the photographically useful group reveals the function for the first time when the blocking group is cleaved.

(A-1)

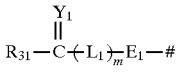

(A-2)

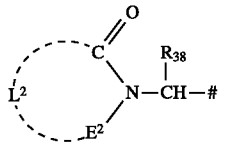

(A-3)

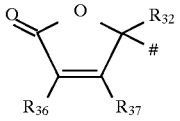

(A-4)

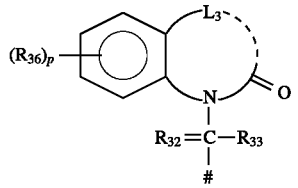

-continued (A-5)

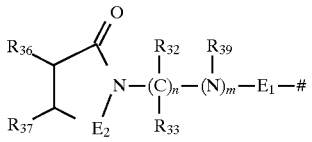

(A-6)

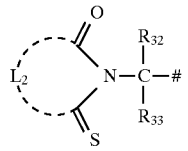

(A-7)

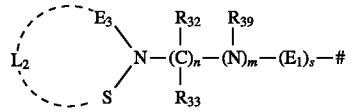

(A-8)

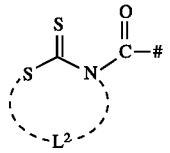

(A-9)

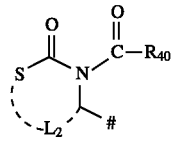

(A-10)

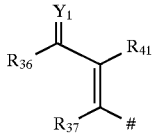

(A-11)

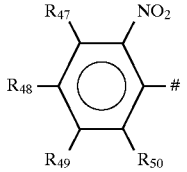

In the following description, $R_{21}$ represents a hydrogen atom, an alkyl group (preferably a straight chain or branched alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 8 carbon atoms, e.g., cyclopropyl, cyclo-pentyl, cyclohexyl, 1-norbornyl, 1-adamantyl), an alkenyl group (preferably an alkenyl group having from 2 to 32 carbon atoms, e.g., vinyl, allyl, 3-buten-1-yl), an aryl group (preferably an aryl group having from 6 to 32 carbon atoms, e.g., phenyl, 1-naphthyl, 2-naphthyl), a heterocyclic group (preferably a 5- to 8-membered heterocyclic group having from 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl, benzotriazol-2-yl), an alkoxyl group (preferably an alkoxyl group having from 1 to 32 carbon atoms, e.g., methoxy, ethoxy, 1-butoxy, 2-butoxy, isopropoxy, t-butoxy, dodecyloxy), a cycloalkyloxy group (preferably a cycloalkyloxy group having from 3 to 8 carbon atoms, e.g., cyclopentyloxy, cyclohexyloxy), an aryloxy group (preferably an aryloxy group having from 6 to 32 carbon atoms, e.g., phenoxy, 2-naphthoxy), a heterocyclic oxy group (preferably a heterocyclic oxy group having from 1 to 32 carbon atoms, e.g., 1-phenyltetrazol-5-oxy, 2-tetrahydropyranyloxy, 2-furyloxy), a silyloxy group (preferably a silyloxy group having from 1 to 32 carbon atoms, e.g., trimethylsilyloxy, t-butyldimethylsilyloxy, diphenylmethylsilyloxy), an acyloxy group (preferably an acyloxy group having from 2 to 32 carbon atoms, e.g., acetoxy, pivaloyloxy, benzoyloxy, dodecanoyloxy), an amino group (preferably an amino group having 32 or less carbon atoms, e.g., amino, methylamino, N,N-dioctylamino, tetradecylamino, octadecylamino), an anilino group (preferably an anilino group having from 6 to 32 carbon atoms, e.g., anilino, N-methylanilino), a heterocyclic amino group (preferably a heterocyclic amino group having from 1 to 32 carbon atoms, e.g., 4-pyridylamino), an alkylthio group (preferably an alkylthio group having from 1 to 32 carbon atoms, e.g., ethylthio, octylthio), an arylthio group (preferably an arylthio group having from 6 to 32 carbon atoms, e.g., phenylthio), or a heterocyclic thio group (preferably a heterocyclic thio group having from 1 to 32 carbon atoms, e.g., 2-benzothiazolylthio, 2-pyridylthio, 1-phenyltetrazolylthio).

$R_{22}$ represents a hydrogen atom, an alkyl group, an aryl group or a heterocyclic group, and preferred carbon atom numbers and specific examples of these groups are the same as those in the alkyl, aryl and heterocyclic groups represented by $R_{21}$.

$R_{23}$ represents a hydrogen atom, a halogen atom, the groups having the same meaning as the groups represented by $R_{21}$, a cyano group, a silyl group (preferably a silyl group having from 3 to 32 carbon atoms, e.g., trimethylsilyl, triethylsilyl, tributylsilyl, t-butyldimethylsilyl, t-hexyldimethylsilyl), a hydroxyl group, a nitro group, an alkoxycarbonyloxy group (preferably an alkoxycarbonyloxy group having from 2 to 32 carbon atoms, e.g., ethoxycarbonyloxy, t-butoxycarbonyloxy), a cycloalkyloxycarbonyloxy group (preferably a cycloalkyloxycarbonyloxy group having from 4 to 9 carbon atoms, e.g., cyclohexyloxycarbonyloxy), an aryloxycarbonyloxy group (preferably an aryloxycarbonyloxy group having from 7 to 32 carbon atoms, e.g., phenoxycarbonyloxy), a carbamoyloxy group (preferably a carbamoyloxy group having from 1 to 32 carbon atoms, e.g., N,N-dimethylcarbamoyloxy, N-butylcarbamoyloxy), a sulfamoyloxy group (preferably a sulfamoyloxy group having from 1 to 32 carbon atoms, e.g., N,N-diethylsulfamoyloxy, N-propylsulfamoyloxy), an alkane-sulfonyloxy group (preferably an alkanesulfonyloxy group having from 1 to 32 carbon atoms, e.g., methanesulfonyloxy, hexadecanesulfonyloxy), an arenesulfonyloxy group (preferably an arenesulfonyloxy group having from 6 to 32 carbon atoms, e.g., benzenesulfonyloxy), an acyl group (preferably an acyl group having from 1 to 32 carbon atoms, e.g., formyl, acetyl, pivaloyl, benzoyl, tetradecanoyl), an alkoxycarbonyl group (preferably an alkoxycarbonyl group having from 2 to 32 carbon atoms, e.g., methoxycarbonyl, ethoxycarbonyl, octadecyloxycarbonyl), a cycloalkyloxycarbonyl group (preferably a cycloalkyloxycarbonyl group having from 2 to 32 carbon atoms, e.g., cyclohexyloxycarbonyl), an aryloxycarbonyl group (preferably an aryloxycarbonyl group having from 7 to 32 carbon atoms, e.g., phenoxycarbonyl), a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl), a carbonamido group (preferably a carbonamido group having from 2 to 32 carbon atoms, e.g., acetamido, benzamido, tetradecanamido), a ureido group (preferably a ureido group having from 1 to 32 carbon atoms, e.g., ureido, N,N-dimethylureido, N-phenylureido), an imido group (preferably an imido group having 10 or less carbon atoms, e.g., N-succinimido, N-phthalimido), an alkoxycarbonylamino group (preferably an alkoxycarbonylamino group having from 2 to 32 carbon atoms, e.g., methoxycarbonylamino, ethoxycarbonylamino, t-butoxycarbonylamino, octadecyloxycarbonylamino), an aryloxycarbonylamino group (preferably an aryloxycarbonylamino group having from 7 to 32 carbon atoms, e.g., phenoxycarbonylamino), a sulfonamido group (preferably a sulfonamido group having from 1 to 32 carbon atoms, e.g., methanesulfonamido, butanesulfonamido, benzenesulfonamido, hexadecanesulfonamido), a sulfamoylamino group (preferably a sulfamoylamino group having from 1 to 32 carbon atoms, e.g., N,N-dipropylsulfamoylamino, N-ethyl-N-dodecylsulfamoylamino), an alkylsulfinyl group (preferably an alkylsulfinyl group having from 1 to 32 carbon atoms, e.g., dodecanesulfinyl), an arenesulfinyl group (preferably an arenesulfinyl group having from 6 to 32 carbon atoms, e.g., benzenesulfinyl), an alkanesulfonyl group (preferably an alkanesulfonyl group having from 1 to 32 carbon atoms, e.g., methanesulfonyl, octanesulfonyl), an arenesulfonyl group (preferably an arenesulfonyl group having from 6 to 32 carbon atoms, e.g., benzenesulfonyl, 1-naphthalenesulfonyl), a sulfamoyl group (preferably a sulfamoyl group having 32 or less carbon atoms, e.g., sulfamoyl, N,N-dipropylsulfamoyl, N-ethyl-N-dodecylsulfamoyl), a sulfo group, or a phosphonyl group (preferably a phosphonyl group having from 1 to 32 carbon atoms, e.g., phenoxyphosphonyl, octyloxyphosphonyl, phenylphosphonyl).

$R_{24}$ represents a hydrogen atom, an alkyl group, an aryl group, an acyl group, an alkanesulfonyl group or an arenesulfonyl group, and $R_{25}$ represents an alkyl group, an aryl group, or a heterocyclic group, and carbon atom numbers and specific examples of these groups are the same as those described in the groups represented by $R_{21}$ and $R_{23}$.

When $R_{21}$, $R_{22}$, $R_{23}$, $R_{24}$ and $R_{25}$ represent groups which can have further substituents, examples of preferred substituents include a halogen atom, an alkyl group, a cycloalkyl group, an alkenyl group, an aryl group, a heterocyclic group, a cyano group, a silyl group, a hydroxyl group, a carboxyl group, a nitro group, an alkoxyl group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arenesulfonyl group, a sulfamoyl group, and a phosphonyl group, and carbon a tom numbers and specific examples of these groups are the same as those described in the groups represented by $R_{21}$, and $R_{23}$.

In formula (A-1), $R_{31}a$ represents the groups having the same meaning as $R_{21}$; $Y_1$ represents an oxygen atom, a sulfur atom, $=N—R_{24}$, or $=C(E_4)—E_5$; $L_1$ represents a divalent linking group containing one or two atoms selected from a carbon atom or a nitrogen atom in the main chain; m represents 0 or 1; $E_1$ represents —CO— or —$SO_2$—; and $E_4$ and $E_5$ each represents an electron attractive group selected from the group consisting of cyano, nitro, —CO—$R_{22}$, —$CO_2R_{25}$, —CON ($R_{24}$)—$R_{22}$, —$SO_2$—$R_{25}$, and —$SO_2N$ ($R_{24}$)—$R_{22}$. Preferably, $R_{31}$ represents an alkyl group, an aryl group, or a heterocyclic group; $Y_1$ represents an oxygen atom; $L_1$ represents —C($R_{32}$)($R_{33}$)—, —C($R_{32}$)($R_{33}$)—C ($R_{34}$)($R_{35}$)—, —C($R_{36}$)=C($R_{37}$)— (wherein $R_{36}$ and $R_{37}$ may be bonded to form a 5- to 7-membered ring), —C($R_{32}$) ($R_{33}$)—N($R_{24}$)—, or —N($R_{24}$)—; m represents 0 or 1; $E_1$ represents —CO— or —$SO_2$—; $R_{32}$, $R_{33}$, $R_{34}$ and $R_{35}$ represent the groups having the same meaning as $R_{22}$; and $R_{36}$ and $R_{37}$ represent the groups having the same meaning as $R_{23}$. More preferably, $R_{31}$ represents an alkyl group or an aryl group; $Y_1$ represents an oxygen atom; $L_1$ represents —C($R_{32}$)(R33)—, —C($R_{36}$)═C($R_{37}$)— (wherein $R_{36}$ and $R_{37}$ may be bonded to form a 5- to 7-membered unsaturated ring or aromatic ring), or —N($R_{24}$)—; m represents 0 or 1; and $E_1$ represents —CO—.

In formula (A-2), $E_2$ represents —CO—, —C═N ($R_{24}$)—, —C═C($E_4$)—$E_5$, or —$SO_2$—; $E_4$ and $E_5$ each represents an electron attractive group; $R_{38}$ represents the groups having the same meaning as $R_{22}$; and $L_2$ represents a nonmetal atomic group necessary to form a 5- to 7-membered ring together with —CO—N—$E_2$—. Preferably, $E_2$ represents —CO—, —C═N($R_{24}$)—, —C═C($E_4$)—$E_5$, or —$SO_2$—; $E_4$ and $E_5$ each represents an electron attractive group selected from the group consisting of cyano, nitro, —CO—$R_{22}$, —$CO_2R_{25}$, —CON($R_{24}$)—$R_{22}$, —$SO_2$—$R_{25}$, and —$SO_2N$($R_{24}$)—$R_{22}$; $R_{38}$ represents the groups having the same meaning as $R_{22}$; $L_2$ represents —C($R_{32}$)($R_{36}$)—C($R_{33}$)($R_{37}$)— or —C($R_{36}$)═C($R_{37}$)—; and $R_{32}$, $R_{33}$, $R_{36}$ and $R_{37}$ represent the groups having the same meaning as $R_{32}$, $R_{33}$, $R_{36}$ and $R_{37}$ in formula (A-1), and $R_{36}$ and $R_{37}$ may be bonded to form a 5- to 7-membered saturated ring, unsaturated ring or aromatic ring. More preferably, $E_2$ represents —CO— or —$SO_2$—; $R_{38}$ represents a hydrogen atom; and $L_2$ represents a substituted or unsubstituted ethylene group or a substituted or unsubstituted 1,2-phenylene group.

In formula (A-3), $R_{32}$, $R_{36}$ and $R_{37}$ represent the groups having the same meaning as $R_{32}$, $R_{36}$ and $R_{37}$ in formula (A-1); and $R_{36}$ and $R_{37}$ may be bonded to form a 5- to 7-membered saturated ring, unsaturated ring or aromatic ring.

In formula (A-4), $R_{32}$, $R_{33}$ and $R_{36}$ represent the groups having the same meaning as $R_{32}$, $R_{33}$ and $R_{36}$ in formula (A-1); $L_3$ represents a nonmetal atomic group necessary to form a 5- to 7-membered ring; and p represents 0 or an integer of from 1 to 4. Preferably, $L_3$ represents —CO— or —C═N($R_{24}$)—; and $R_{32}$ and $R_{33}$ each represents a hydrogen atom. More preferably, $L_3$ represents —CO—.

In formula (A-5), $R_{32}$, $R_{33}$, $R_{36}$ and $R_{37}$ represent the groups having the same meaning as $R_{32}$, $R_{33}$, $R_{36}$ and $R_{37}$ in formula (A-1), and $R_{36}$ and $R_{37}$ may be bonded to form a 5- to 7-membered saturated ring, unsaturated ring or aromatic ring; $R_{39}$ represents the groups having the same meaning as $R_{24}$; $E_1$ represents —CO— or —$SO_2$—; $E_2$ represents —CO—, —CS—, —C═N($R_{24}$)—, —SO— or —$SO_2$—; n represents 0, 1 or 2; and m represents 0 or 1, and n+m is 1, 2 or 3 Preferably, $E_1$ represents —CO—; $E_2$ represents —CO— or —$SO_2$—; n represents 0, 1 or 2; and m represents 0 or 1, and n+m is 1, 2 or 3. More preferably, $E_1$ and $E_2$ represent —CO—; n represents 1, m represents 0; and $R_{32}$ and $R_{33}$ represent hydrogen atoms.

In formula (A-6), $R_{32}$ and $R_{33}$ represent the groups having the same meaning as $R_{32}$ and $R_{33}$ in formula (A-1); $L_2$ represents a nonmetal atomic group necessary to form a 5- to 7-membered ring together with —CO—N—CS—. Preferably, $L_2$ represents a substituted or unsubstituted 1,2-phenylene group, a substituted or unsubstituted ethylene group, —C($R_{34}$)($R_{35}$)—S— or —C($R_{34}$)($R_{35}$)—O—; and $R_{34}$ and $R_{35}$ represent the groups having the same meaning as $R_{34}$ and $R_{35}$ in formula (A-1).

In formula (A-7), $R_{32}$ and $R_{33}$ represent the groups having the same meaning as $R_{32}$ and $R_{33}$ in formula (A-1); $R_{39}$ represents the groups having the same meaning as $R_{24}$; $L_2$ represents a nonmetal atomic group necessary to form a 5- to 7-membered ring together with —$E_3$—N—S—; $E_1$ represents —CO— or —$SO_2$—; $E_3$ represents —CO—, —CS—, —C═N($R_{24}$)—, —SO— or —$SO_2$—; n represents 0, 1, 2 or 3; and m and s represent 0 or 1, provided that when m represents 1, s represents 1, and when n represents 0, m and s each represents 1. Preferably, $L_2$ represents a substituted or unsubstituted 1,2-phenylene group, a substituted or unsubstituted ethylene group, —C($R_{34}$)($R_{35}$)—S— or —C($R_{34}$)($R_{35}$)—O—; $R_{34}$ and $R_{35}$ represent the groups having the same meaning as $R_{34}$ and $R_{35}$ in formula (A-1); $E_1$ represents —CO— or —$SO_2$—; $E_3$ represents —CO— or —$SO_2$—; n represents 0 or 1; and m and s each represents 0 or 1, provided that when m represents 1, s represents 1, and when n represents 0, m and s each represents 1. More preferably, $L_2$ represents a substituted or unsubstituted 1,2-phenylene group, or a substituted or unsubstituted ethylene group; $E_1$ represents —CO—; $E_3$ represents —CO— or —$SO_2$—; n represents 1; and m and s each represents 0.

In formula (A-8), $L_2$ represents a nonmetal atomic group necessary to form a 5- to 7-membered ring together with —S—CS—N—, and preferably a substituted or unsubstituted 1,2-phenylene group, or a substituted or unsubstituted ethylene group.

In formula (A-9), $R_{40}$ represents the groups having the same meaning as $R_{25}$; $L_2$ represents a nonmetal atomic group necessary to form a 5- to 7-membered ring together with —S—CS—N—, and preferably a substituted or unsubstituted 1,2-phenylene group, or a substituted or unsubstituted ethylene group.

In formula (A-10), $Y_1$ represents the groups having the same meaning as Y, in formula (A-1); $R_{41}$ represents the groups having the same meaning as $R_{23}$; and $R_{36}$ and $R_{37}$ represent the groups having the same meaning as $R_{36}$ and $R_{37}$ in formula (A-1), and $R_{36}$ and $R_{37}$ may be bonded to form a 5- to 7-membered saturated ring, unsaturated ring or aromatic ring.

In formula (A-11), $R_{47}$ represents a group selected from the group consisting of cyano, —CO—$R_{22}$, —$CO_2R_{25}$, —CON($R_{24}$)—$R_{22}$, —$SO_2$—$R_{25}$, and —$SO_2N$($R_{24}$)—$R_{22}$, or a hydrogen atom; $R_{48}$ represents a group selected from the group consisting of nitro, cyano, —CO—$R_{22}$, —$CO_2R_{25}$, —CON($R_{24}$)—$R_{22}$, —$SO_2$—$R_{25}$, and —$SO_2N$($R_{24}$)—$R_{22}$, or a hydrogen atom; $R_{49}$ represents the groups having the same meaning as $R_{47}$; and $R_{50}$ represents the groups having the same meaning as $R_{48}$.

Specific examples of blocking groups are shown below.

(A-1)

$$CH_3\overset{O}{\overset{\|}{C}}CH_2CH_2\overset{O}{\overset{\|}{C}}-,\quad H\overset{O}{\overset{\|}{C}}CH_2CH_2\overset{O}{\overset{\|}{C}}-,\quad C_{18}H_{37}\overset{O}{\overset{\|}{C}}CH_2CH_2\overset{O}{\overset{\|}{C}}-,$$

-continued
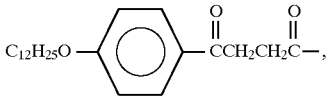
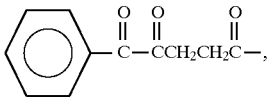
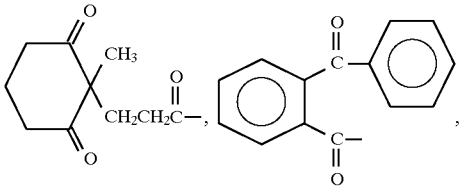
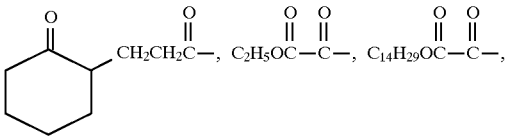
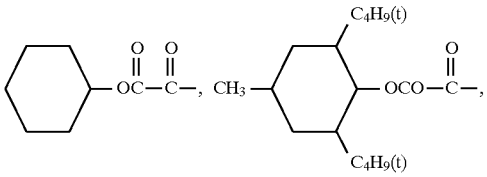
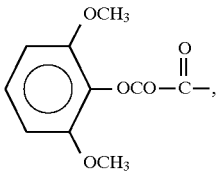
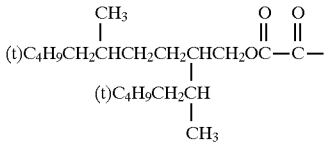
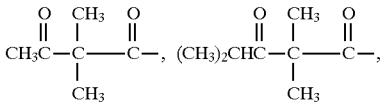
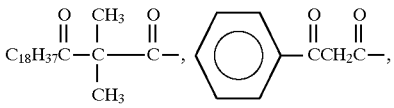
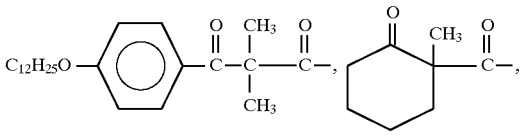
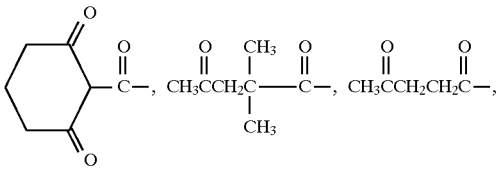
-continued
(A-2)
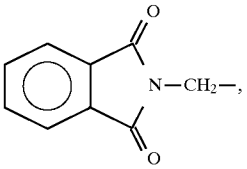
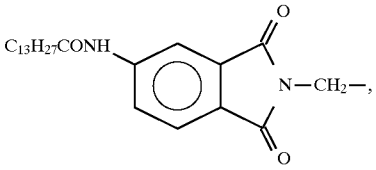
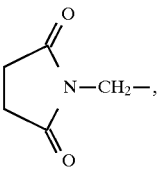
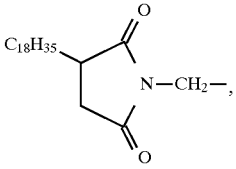
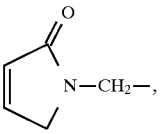
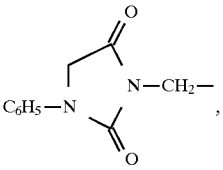
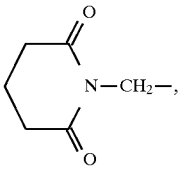
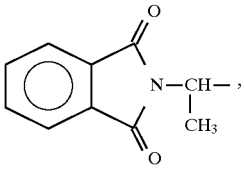
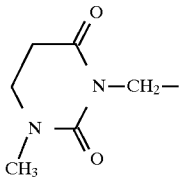
(A-3)
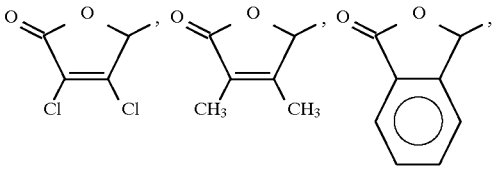
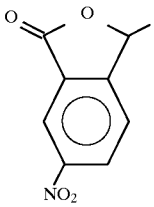

-continued
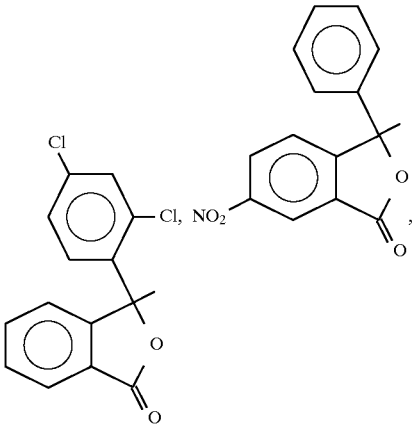
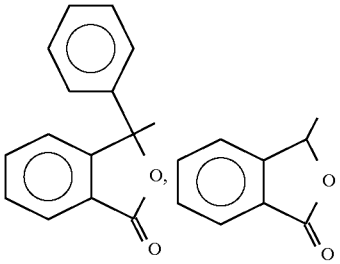
(A-4)
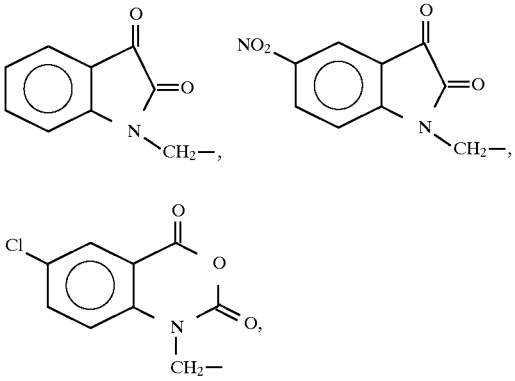
(A-5)
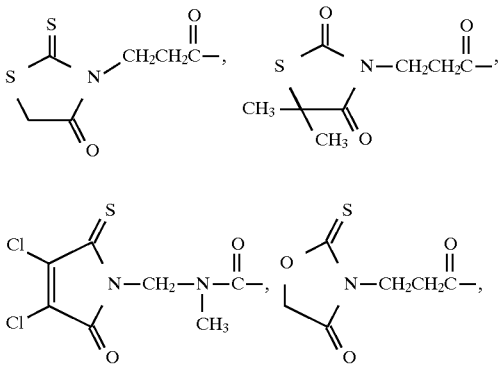
-continued
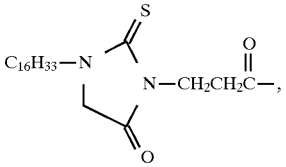
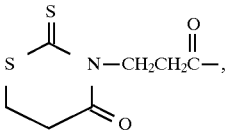
(A-6)
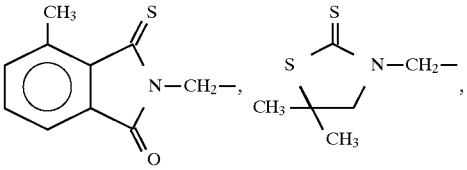
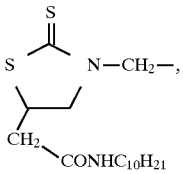
(A-7)
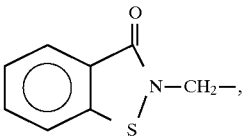
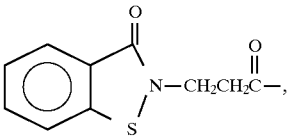
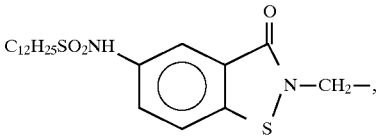
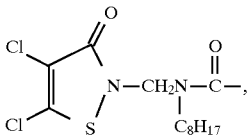
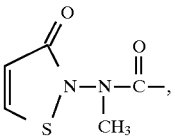
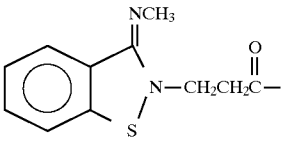

-continued
(A-8)
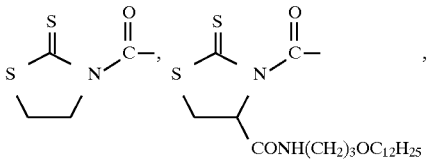
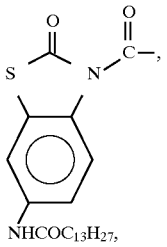
(A-9)
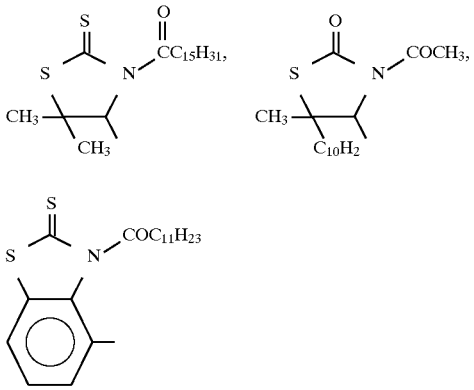
(A-10)
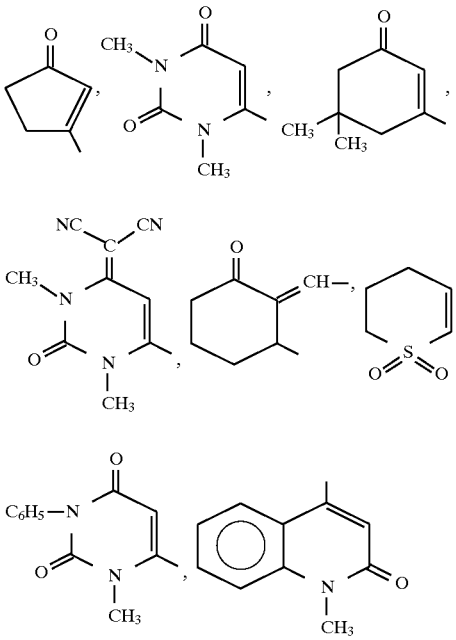
-continued
(A-11)
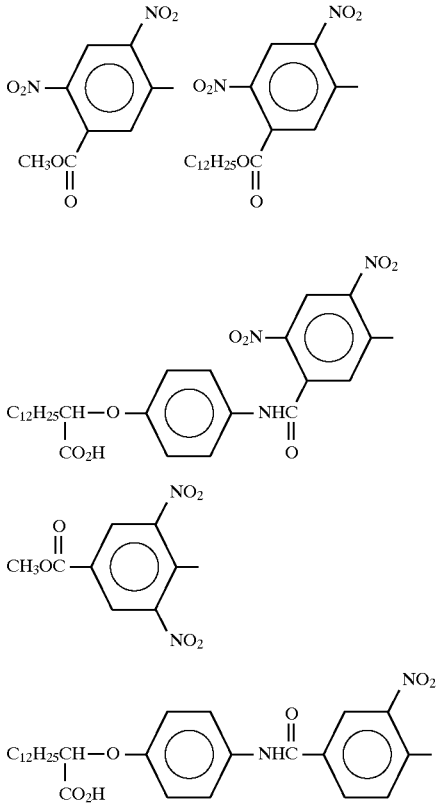
In formula (III), PL represents a photographically useful group having the chelating ability. This corresponds to the case in which the above photographically useful group constitutes a part or the entire of a chelate group. Preferred examples of PL are shown below.
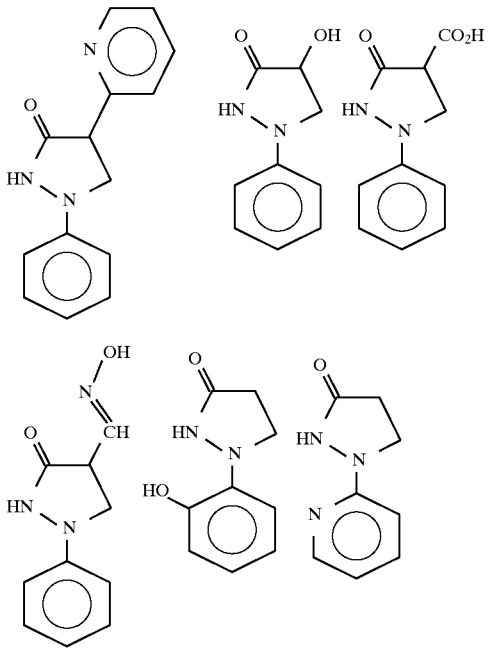

-continued

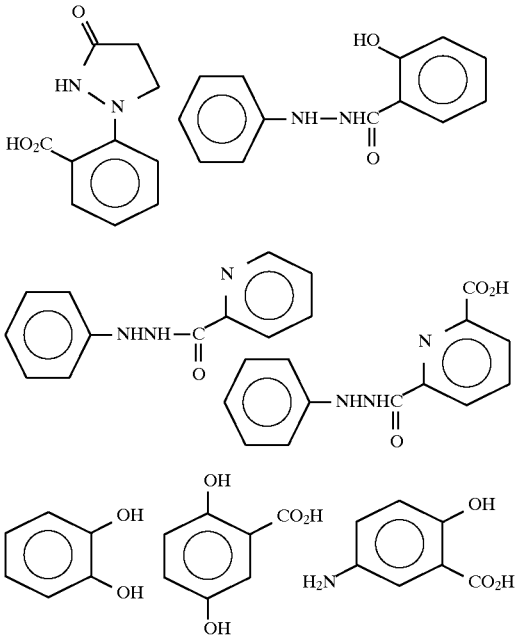

In formulae (I) to (III), M represents boron, magnesium, aluminum, calcium, nickel, copper or zinc, preferably zinc.

In formulae (I) to (III), L represents a mere chelate ligand which does not have a photographically useful group. L represents almost the same meaning as LIG, to be accurate a compound obtained by adding hydrogen to the radical defined in LIG.

In formulae (I) to (III), n represents an integer of from 1 to 3, and k represents 0, 1 or 2. The sum of n and k does not exceed 3. n is preferably 1 or 2 and k is preferably 0 or 1.

In the present invention, the case in which the photographically useful group is a reducing agent to silver halide, M is zinc, n is 2 and k is 0 is preferred as a combination. Further, the compound according to the present invention may be hydrate.

In the present invention, a compound can be designed so that BP in formula (II) can be bonded to LINK-LIG group at the blocking group part, and the bond of the blocking group and the photographically useful group can be cleaved upon cleavage of LIG-M bond. Such a compound is represented by the following formula (IV).

$$(\text{PUG—B—LINK—LIG})_n \cdot \text{M} \cdot \text{L}_k \qquad \text{(IV)}$$

wherein B represents a blocking group, and other symbols are the same as those described above.

In formula (IV), B can be any group so far as it is a group capable of being released from PUG upon cleavage of LIG-M bond, but it is preferred that PUG-B bond is cleaved by the electron transfer reaction or the nucleophilic substitution reaction of the anion grown in LIG group after LIG-M bond is cleaved. Specifically, it is a divalent group represented by the following formula (B):

$$\#\text{—G}\text{—}(\text{Time})_m\text{—}\#\# \qquad \text{(B)}$$

wherein # indicates the position to be bonded to the group represented by LIG in formula (IV), ## indicates the position to be bonded to the group represented by PUG, m represents 0 or 1, and G represents, as well as a single bond, divalent groups shown below.

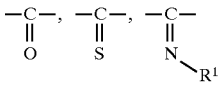

wherein $R^1$ represents a hydrogen atom, an alkyl group (preferably a straight chain or branched alkyl group having from 1 to 32 carbon atoms, e.g., methyl, ethyl, propyl, cyclohexyl), an aryl group (preferably an aryl group having from 6 to 32 carbon atoms, e.g., phenyl, naphthyl), a hydroxyl group, or an alkoxyl group (preferably an alkoxyl group having from 1 to 32 carbon atoms, e.g., methoxy, ethoxy, benzyloxy).

Time represents a timing group, which may be any group so far as it is a group capable of cleaving Time-PUG bond after LIG-G bond is cleaved. The following can be cited as such examples, for example, the groups making use of a cleavage reaction of hemiacetal as disclosed in U.S. Pat. Nos. 4,146,396, 4,652,516 and 4,698,297; the timing groups causing a cleavage reaction utilizing an intramolecular nucleophilic substitution reaction as disclosed in U.S. Pat. Nos. 4,248,962, 4,847,185 and 4,857,440; the timing groups causing a cleavage reaction making use of an electron transfer reaction as disclosed in U.S. Pat. Nos. 4,409,323 and 4,421,845; the timing groups causing a cleavage reaction utilizing a hydrolysis reaction of iminoketal as disclosed in U.S. Pat. No. 4,546,073; the timing groups causing a cleavage reaction utilizing a hydrolysis reaction of ester as disclosed in West German Patent Application (OLS) No. 2,626,317, and the timing groups causing a cleavage reaction utilizing a reaction with a sulfite ion as disclosed in EP-A-572084. Specific examples of preferred Time are shown below. # indicates the position to be bonded to the group represented by G, and ## indicates the position to be bonded to the group represented by PUG.

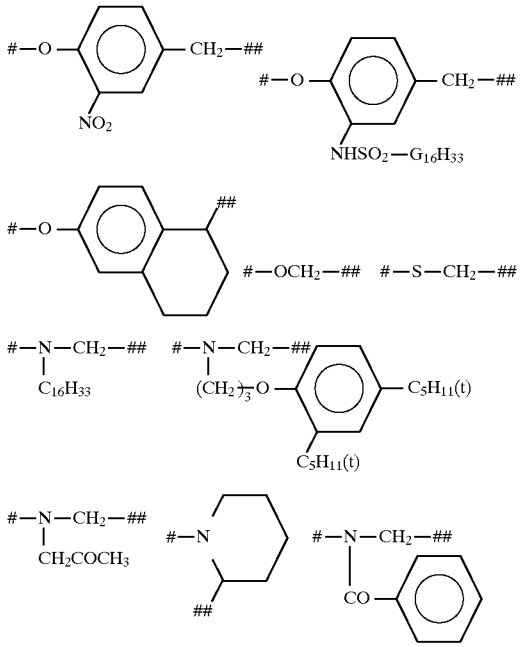

-continued

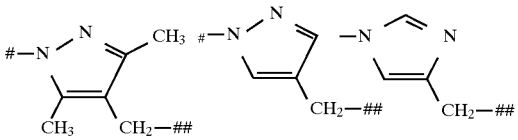

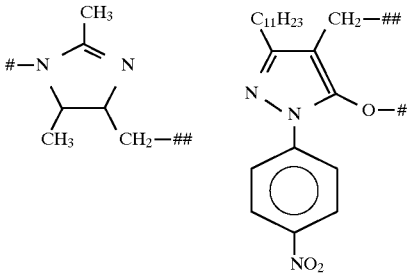

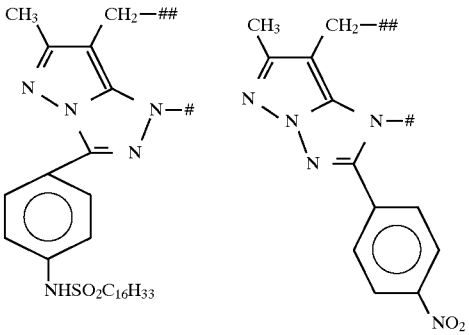

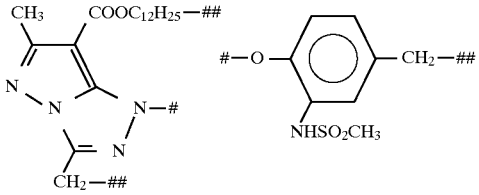

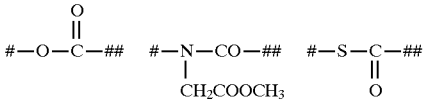

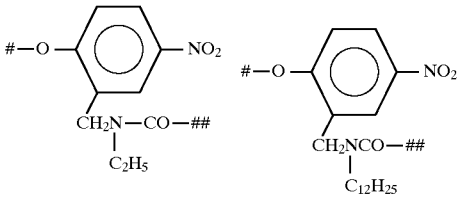

-continued

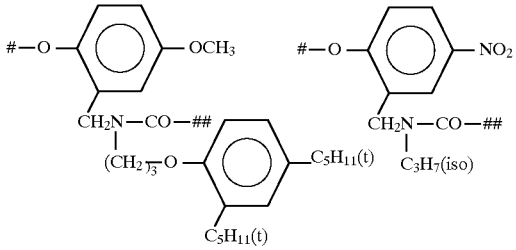

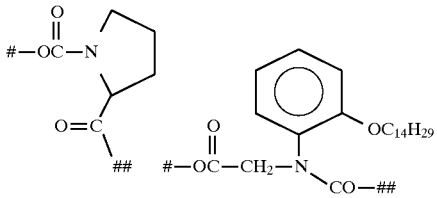

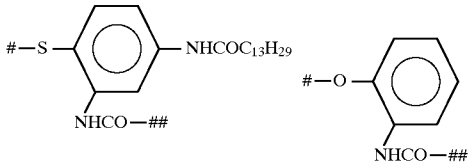

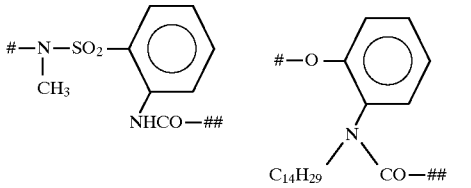

Of the compounds having a photographically useful compound which is inactivated by the chelation with a metal represented by formula (I), (II) or (III), the compounds represented by formula (I) or (II) are more preferred, and the compounds represented by formula (II) are particularly preferred.

Specific examples of preferred compounds according to the present invention are shown below, but the present invention is not limited thereto.

1.
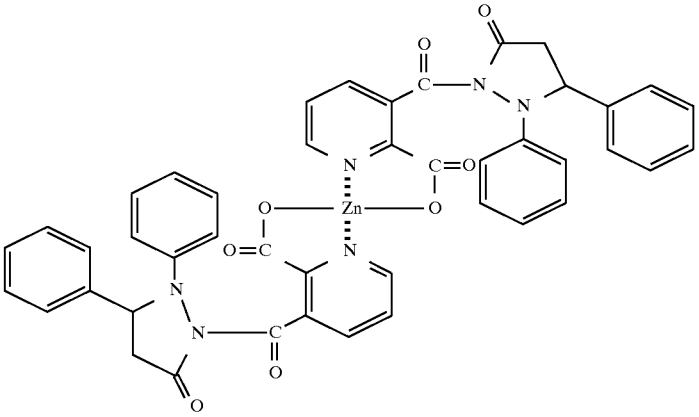
2.
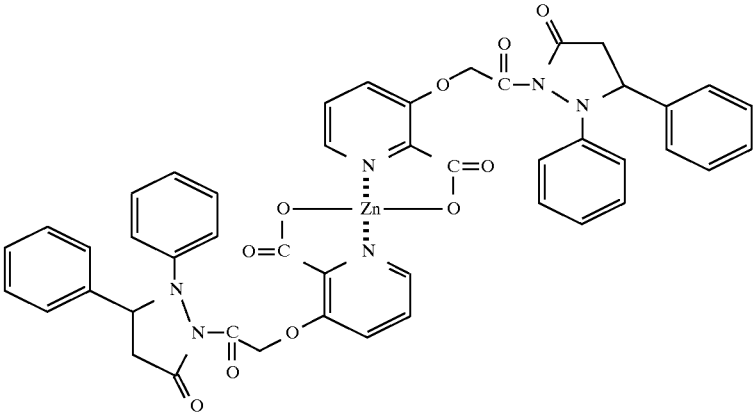
3.
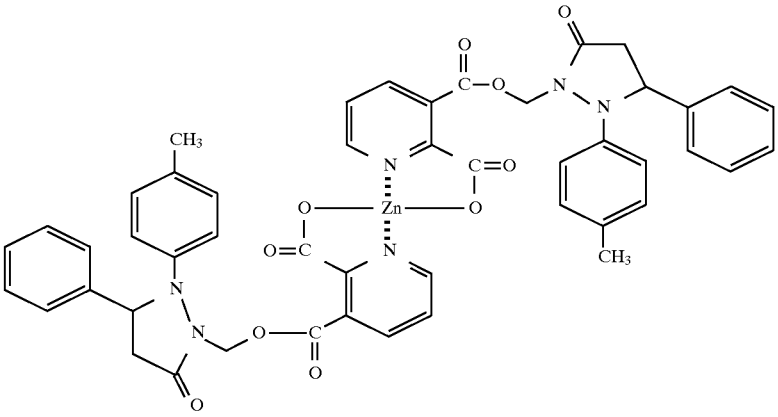

-continued
4.
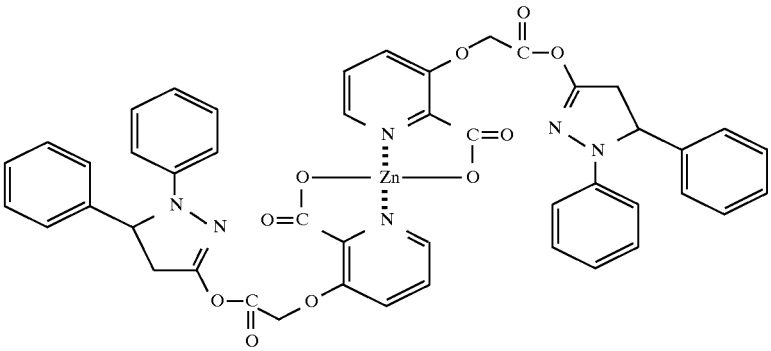
5.
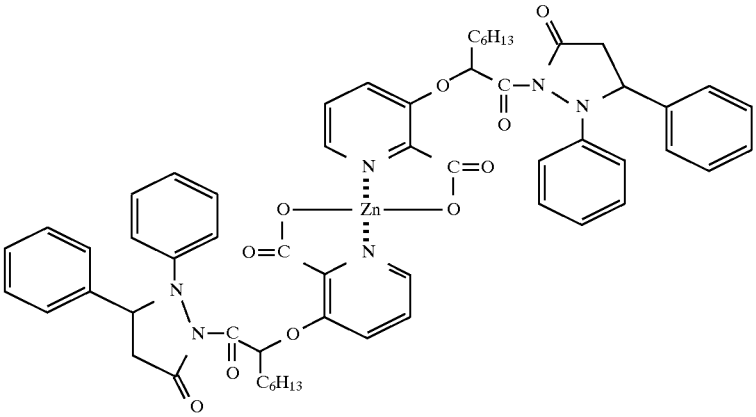
6.
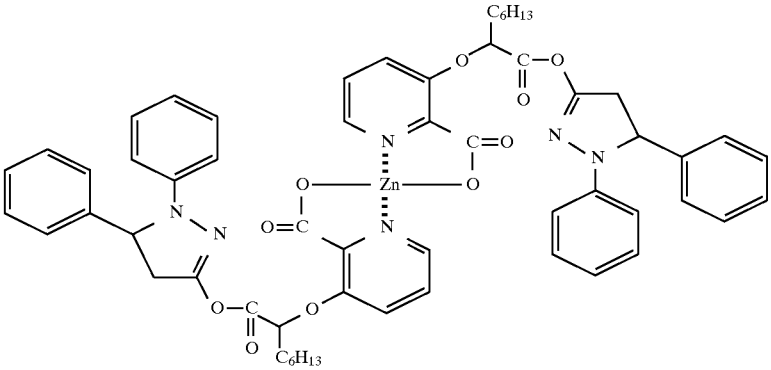
7.
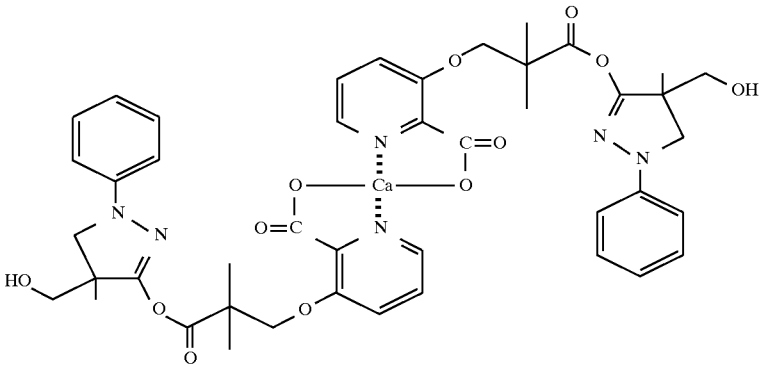

-continued
8.
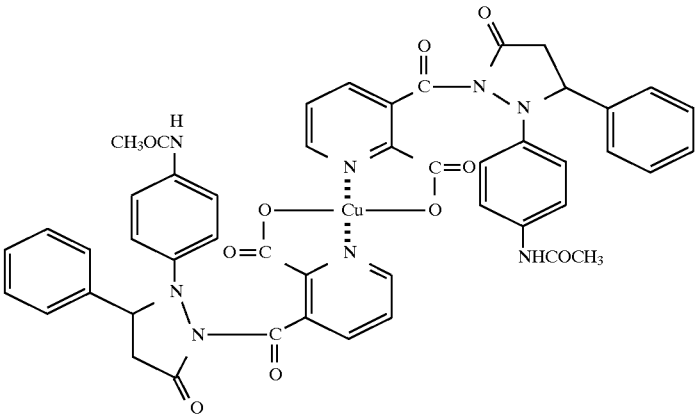
9.
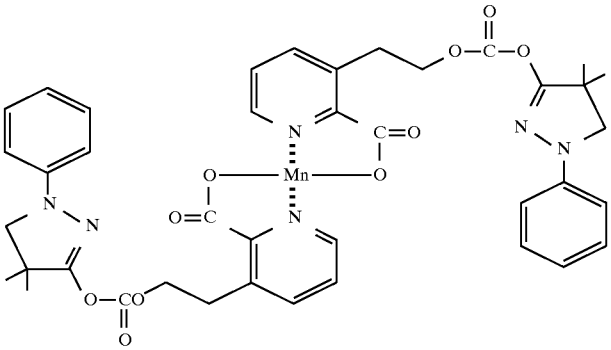
10.
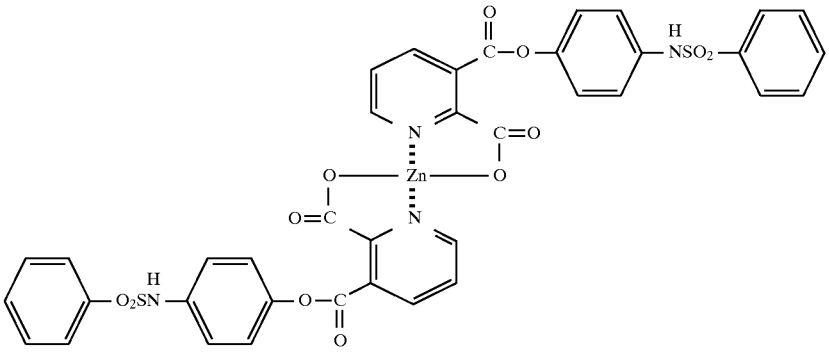

-continued
11.
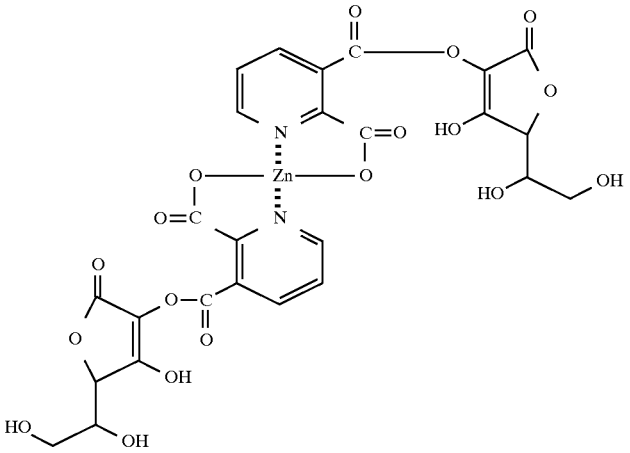
12.
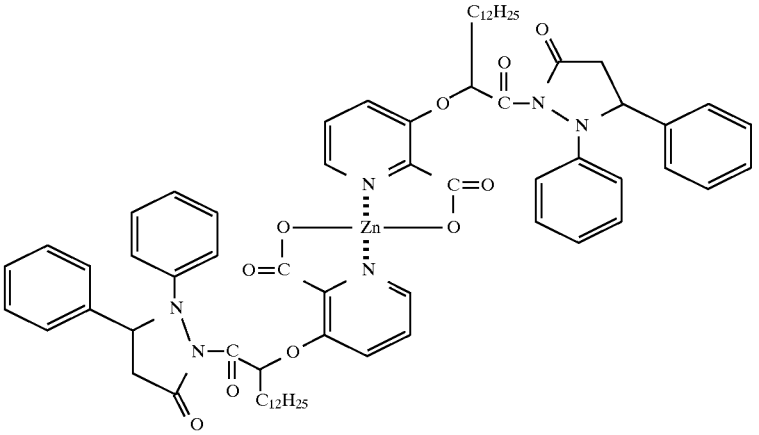
13.
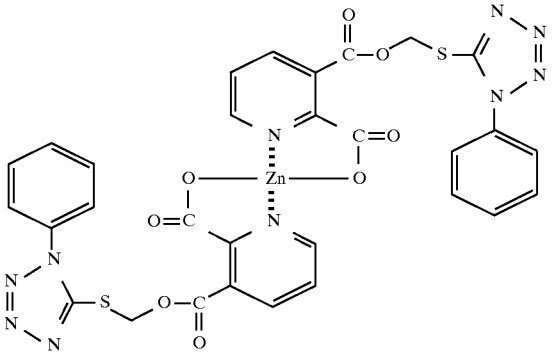

-continued
14.
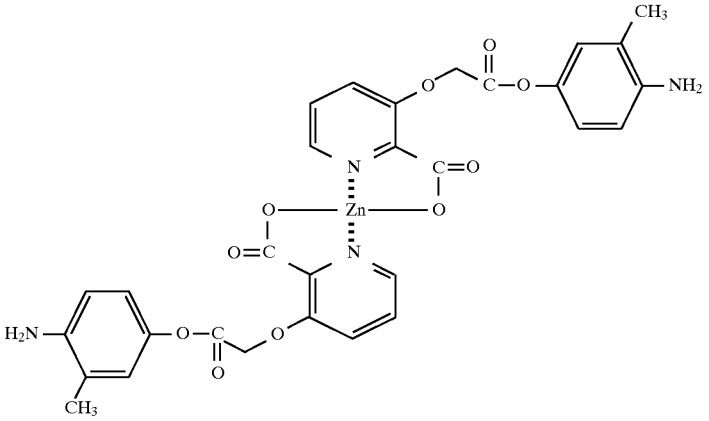
15.
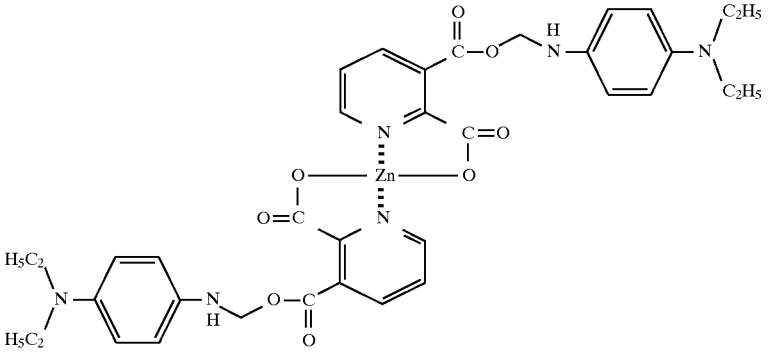
16.
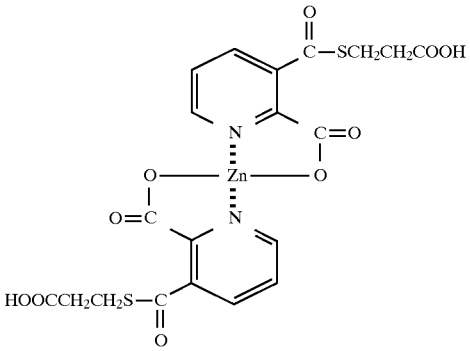
17.
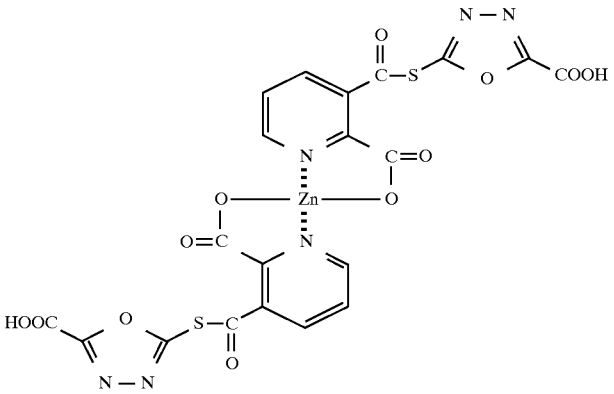

-continued
18.
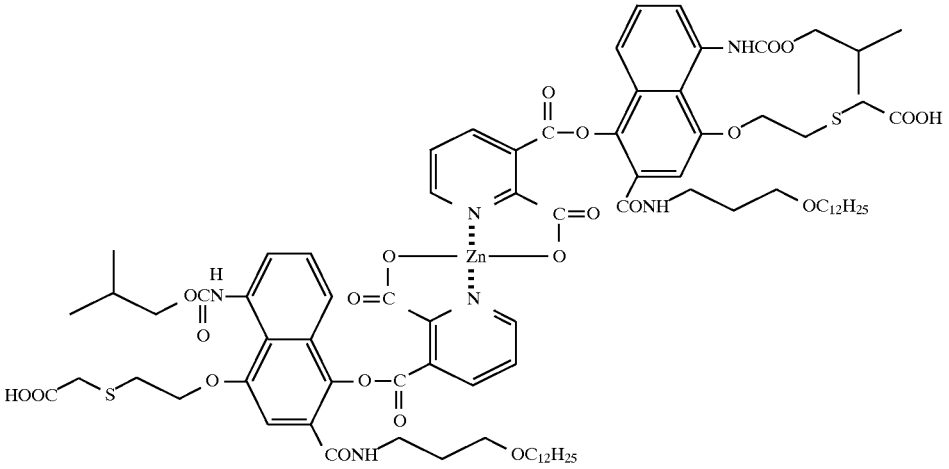
19.
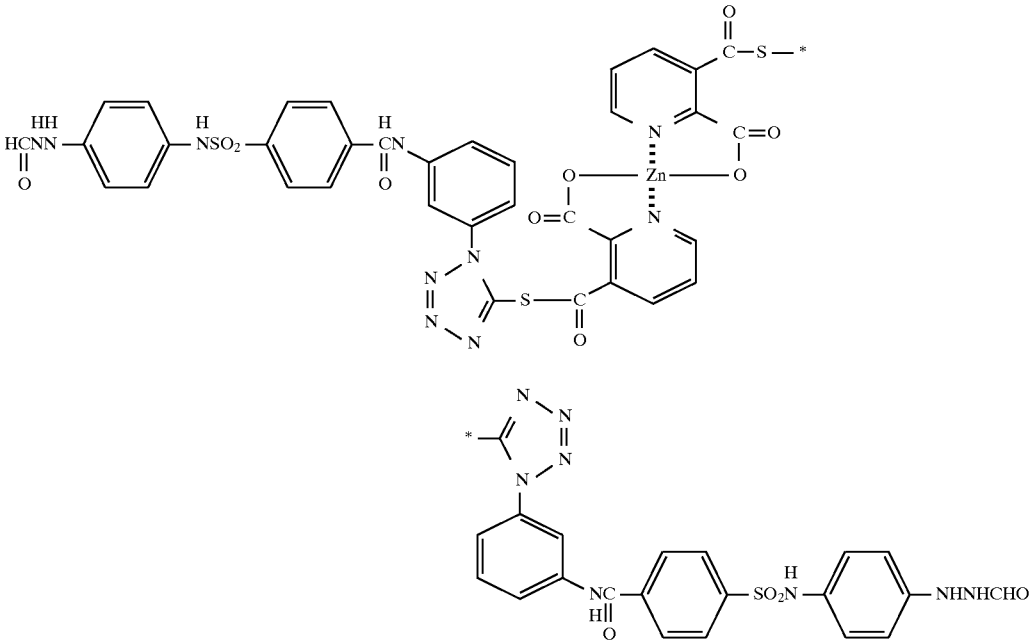
20.
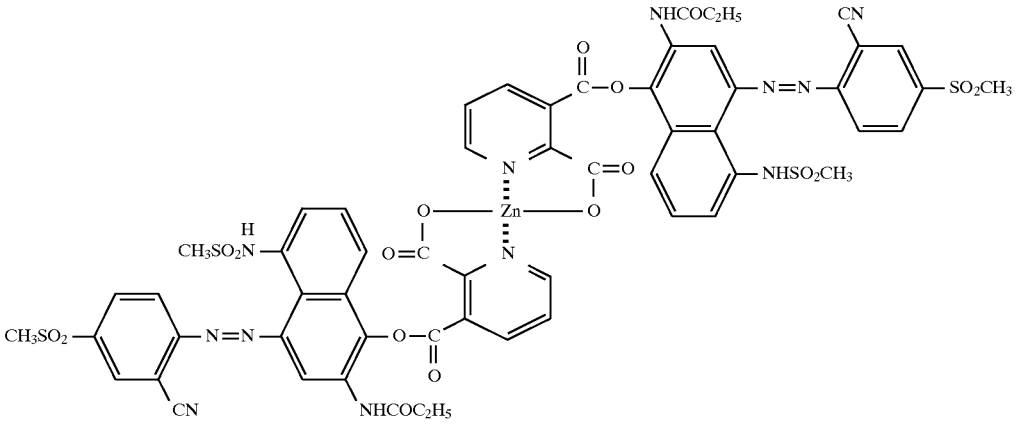

-continued
21.
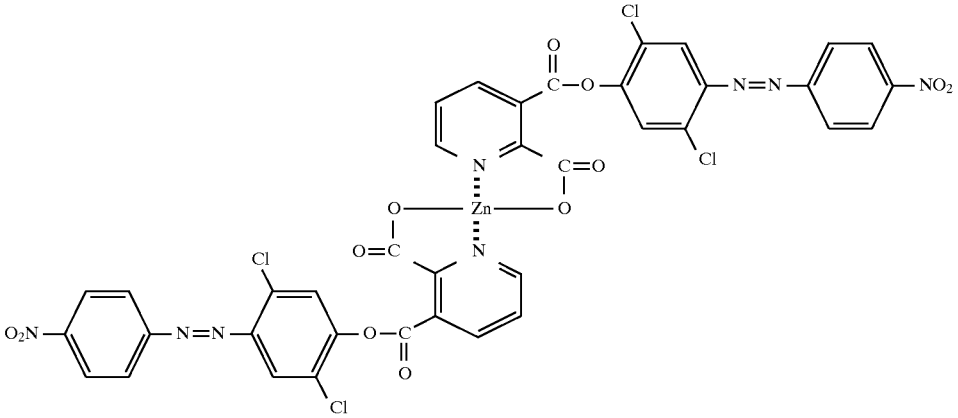
22.
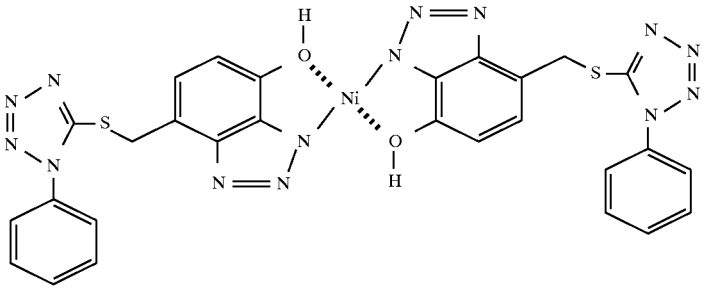
23.
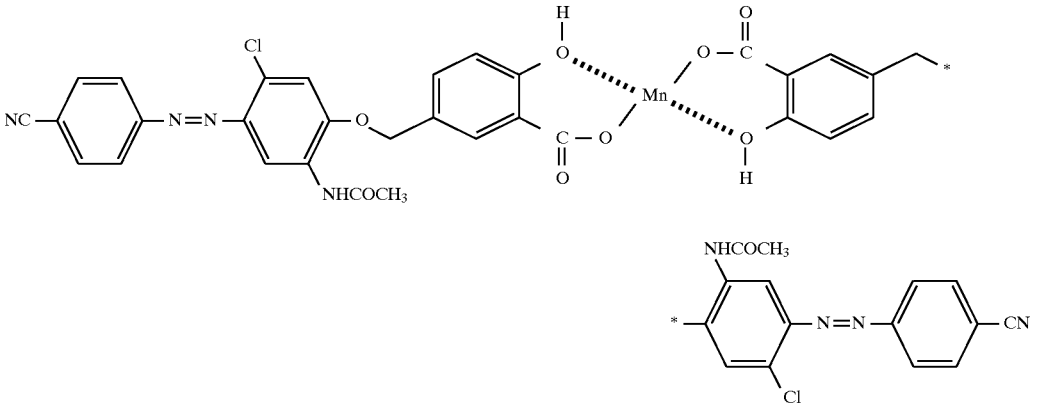
24.
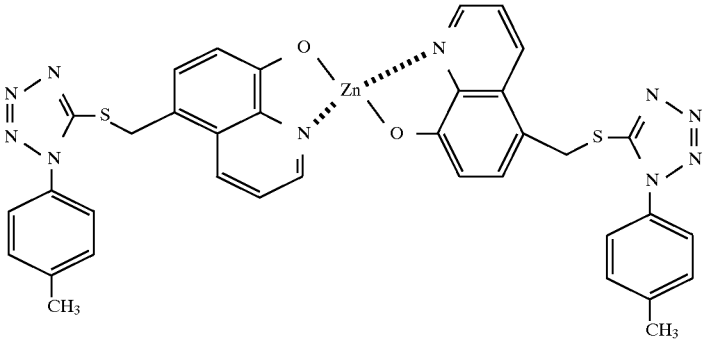

-continued
25.
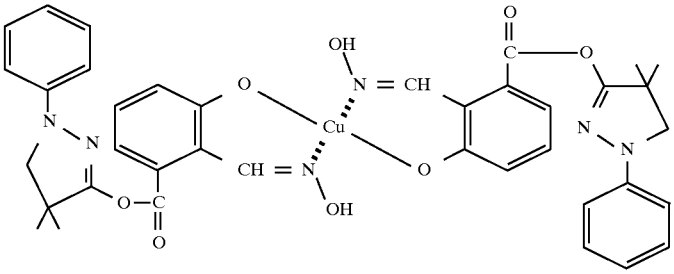
26.
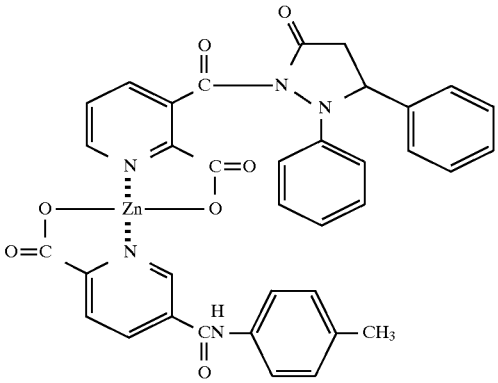
27.
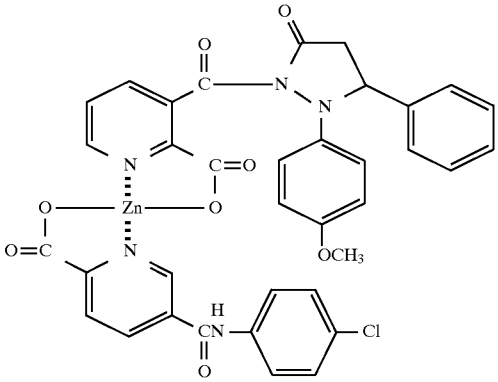
28.
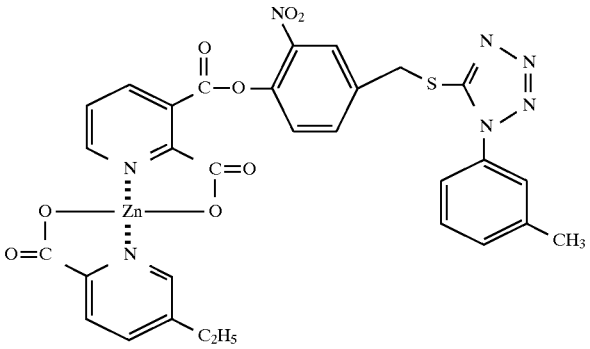

-continued
29.
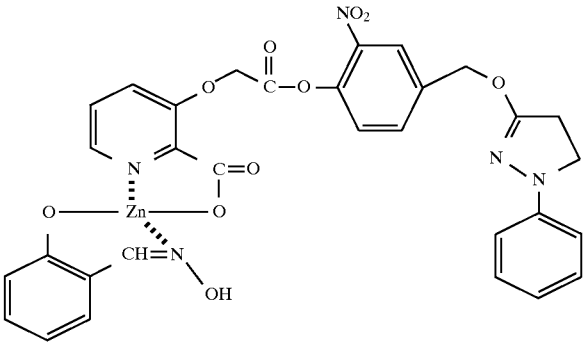
30.
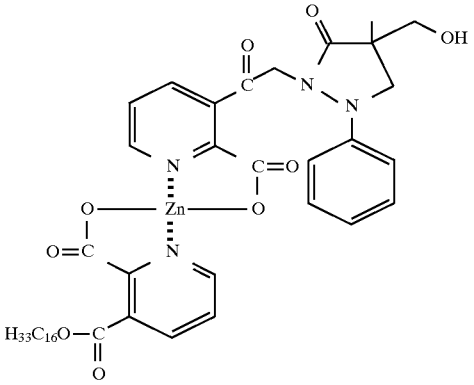
31.
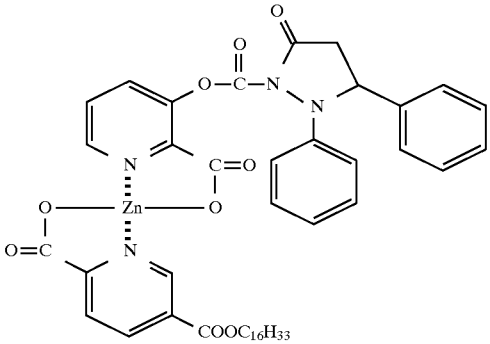
32.
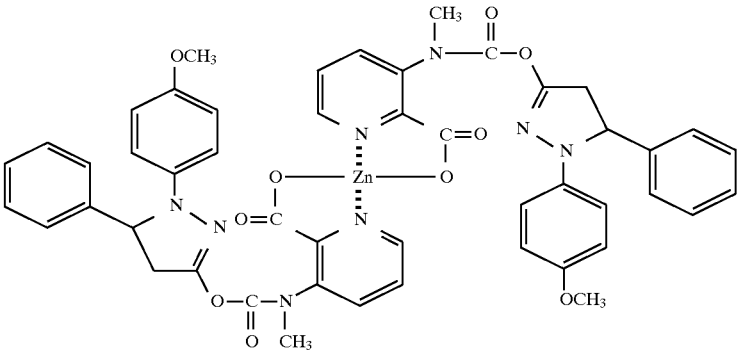

-continued
33.
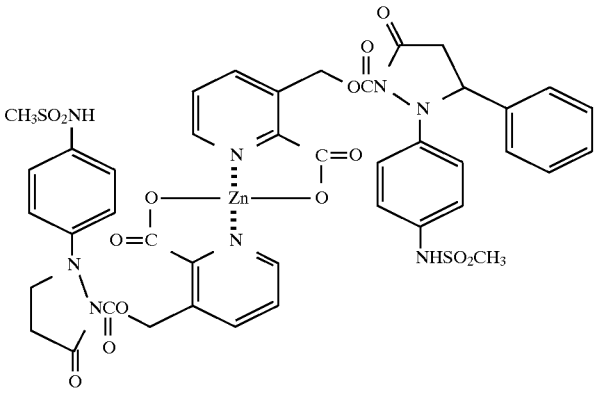
34.
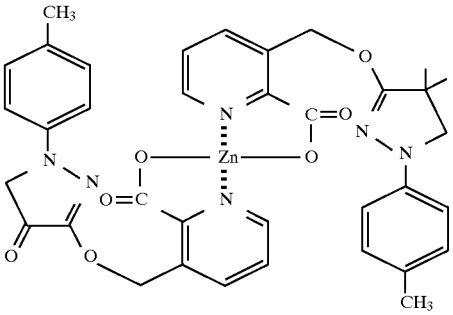
35.
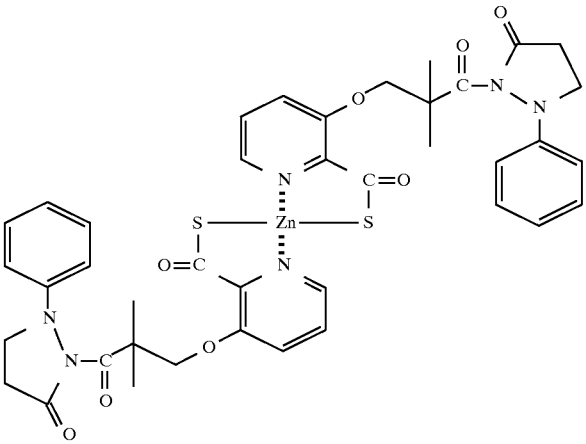

-continued
36.
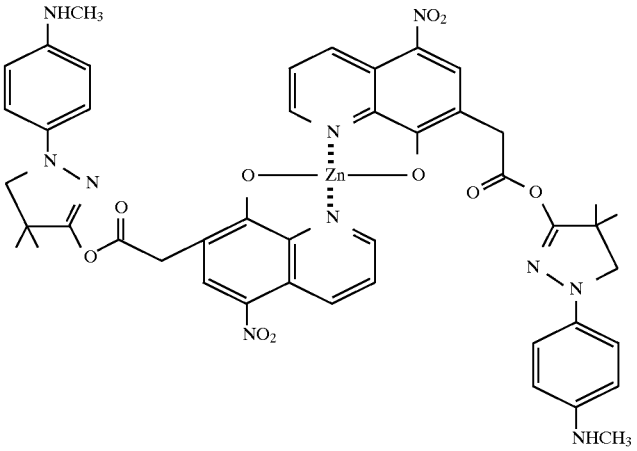
37.
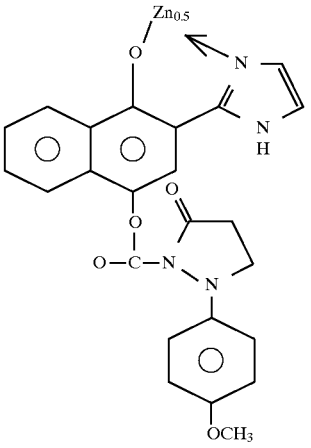
38.
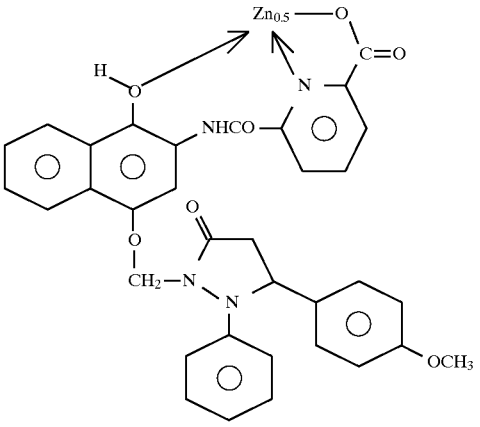

-continued
39.
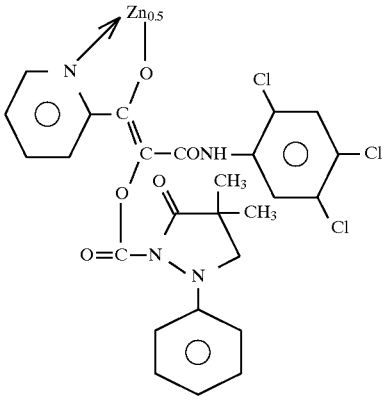
40.
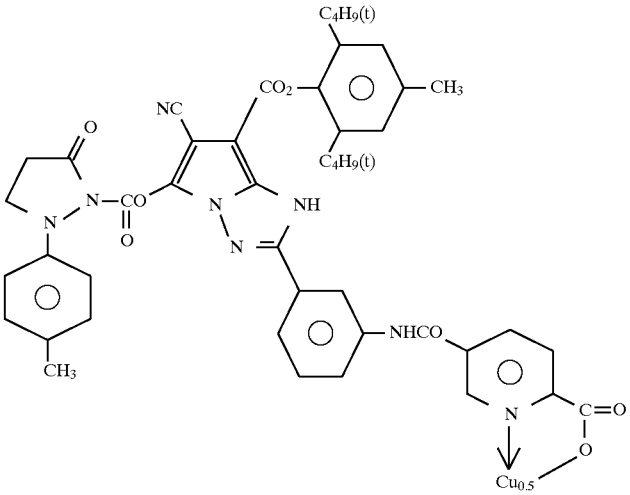
41.
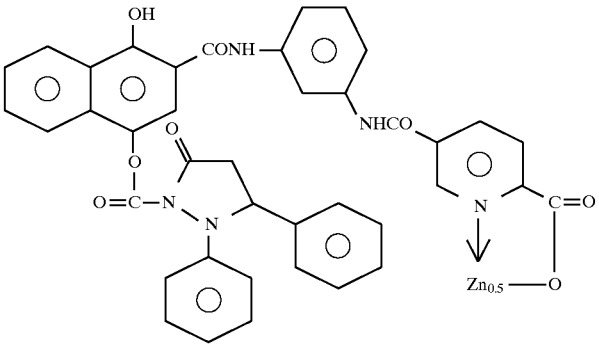

-continued
42.
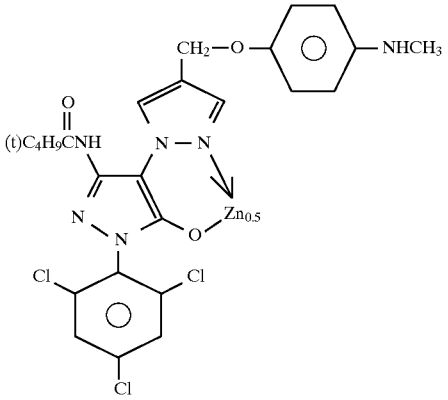
43.
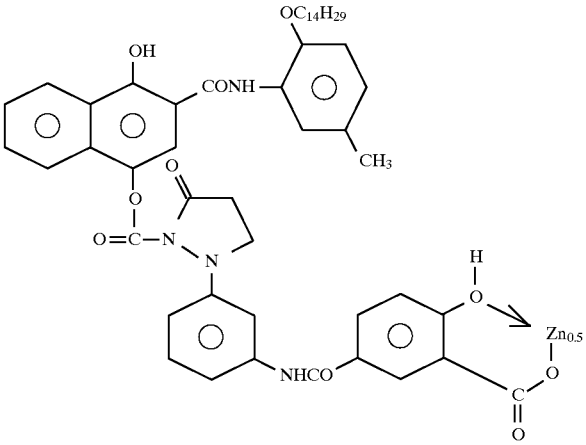
44.
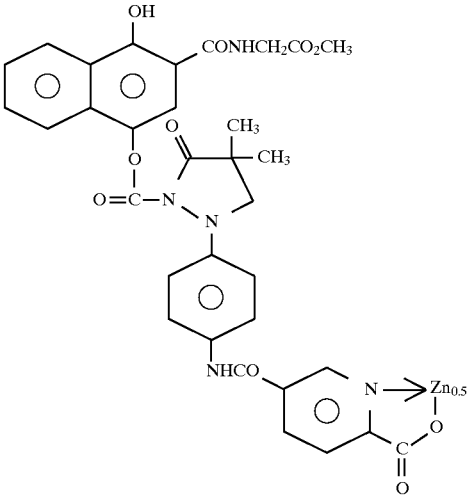

-continued
45.
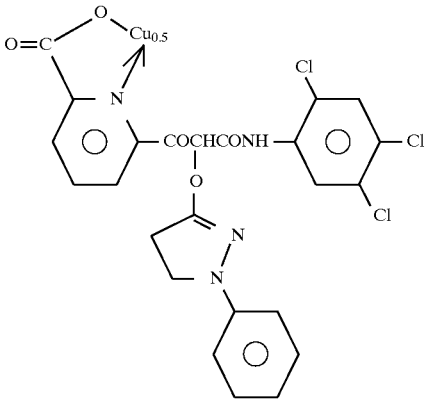
46.
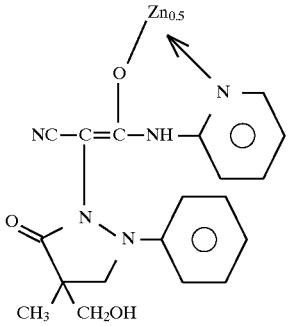
47.
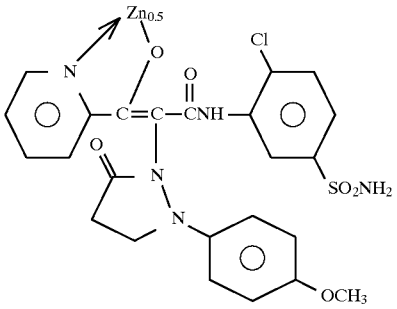
48.
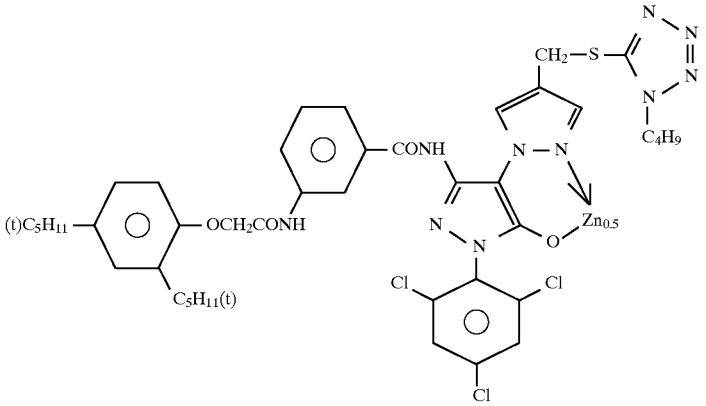

-continued
49.
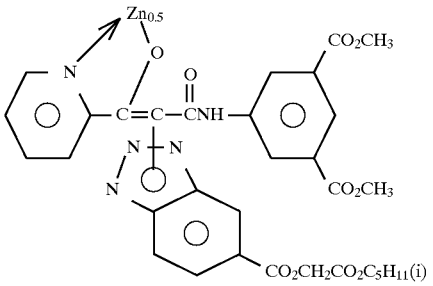
50.
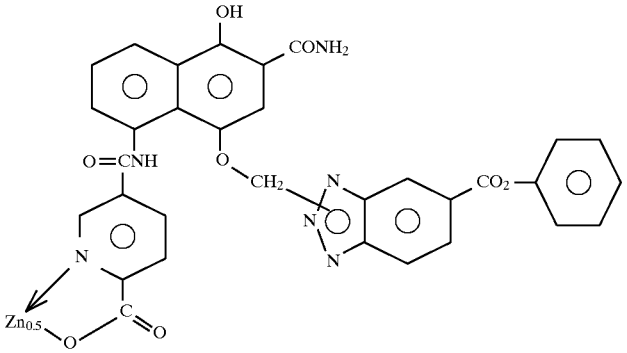
51.
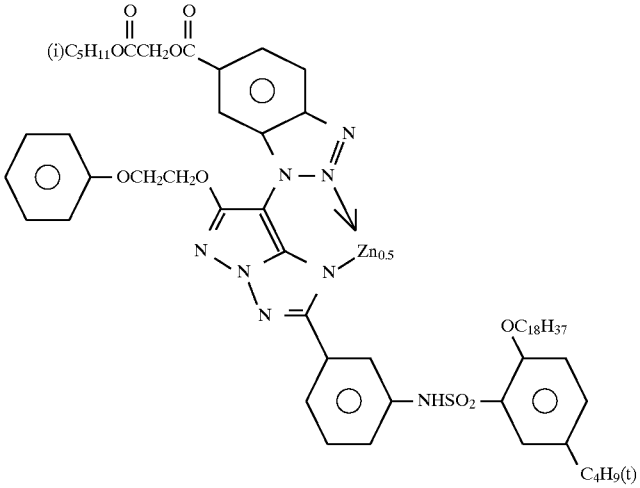
52.
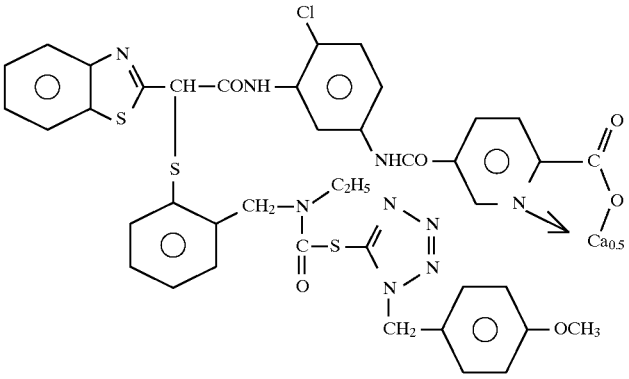

-continued
53.
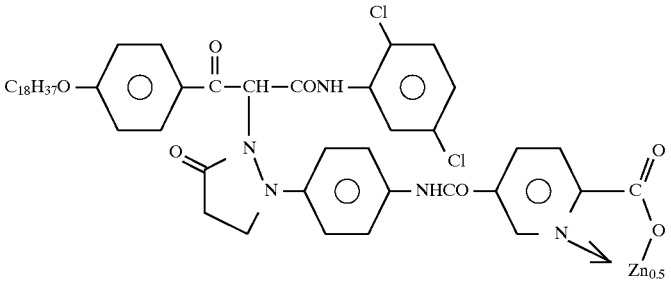
54.
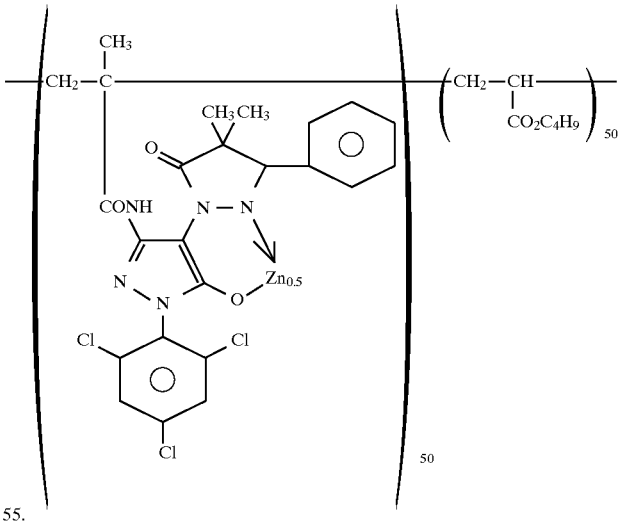
55.
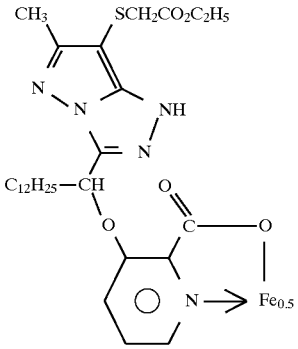

-continued
56.
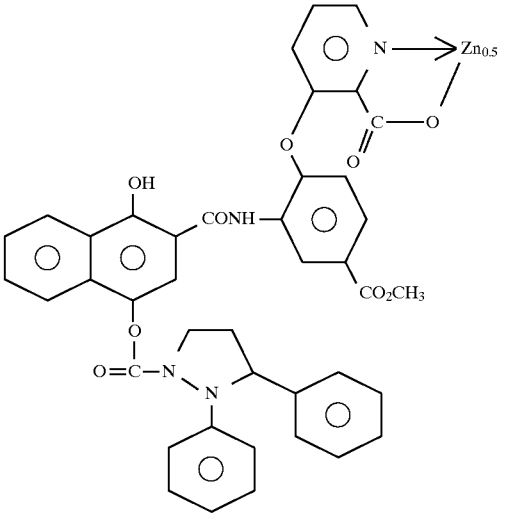
57.
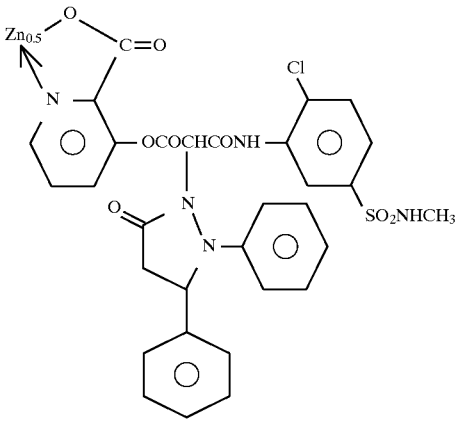
58.
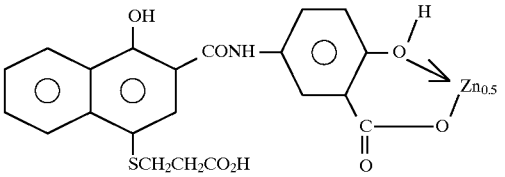

-continued
59.
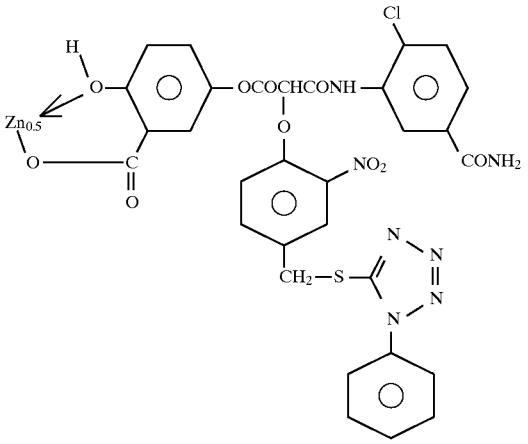
60.
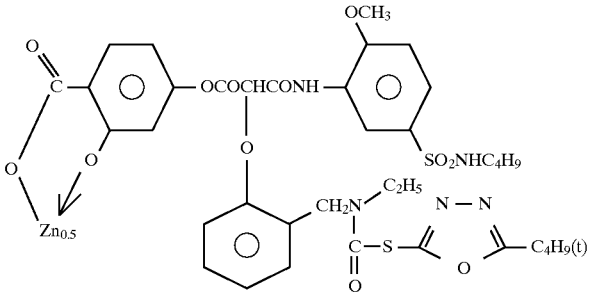
61.
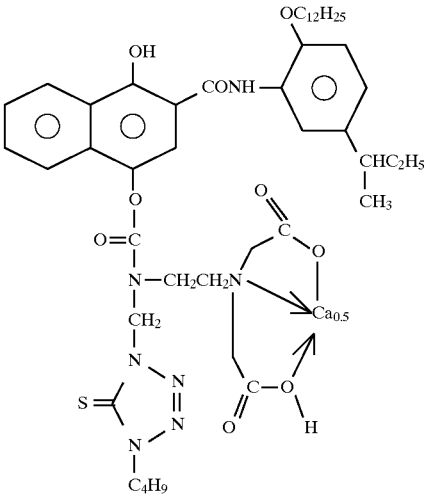

-continued
62.
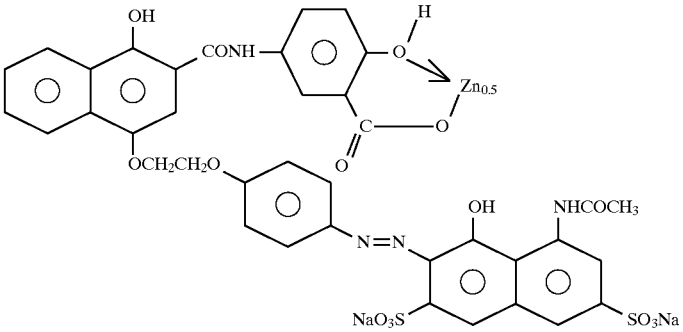
63.
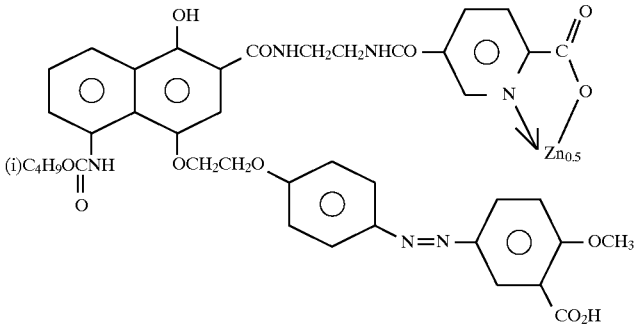
64.
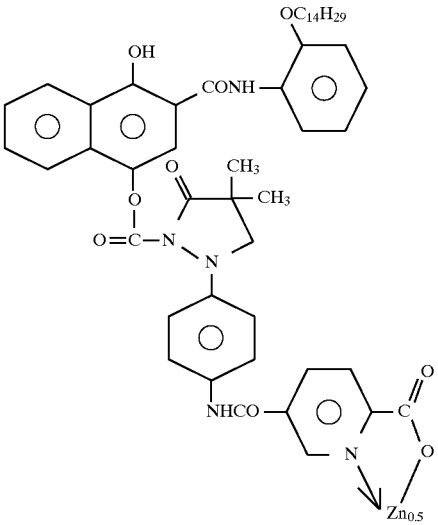
65.
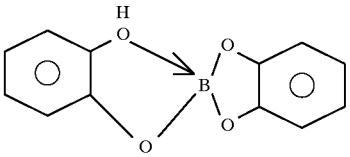

-continued
66.
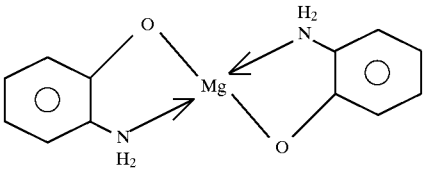
67.
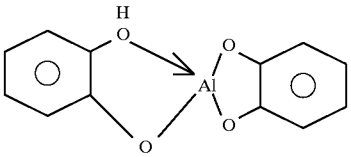
68.
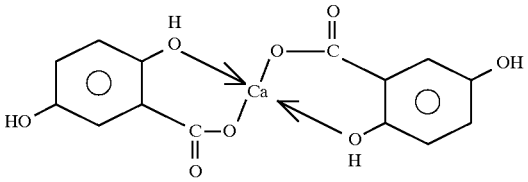
69.
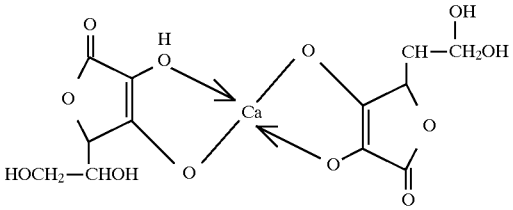
70.
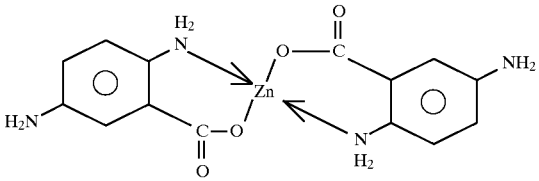
71.
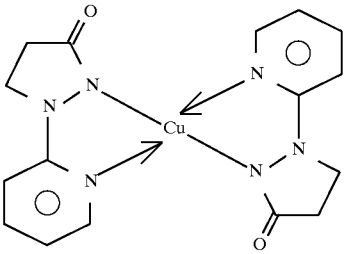
72.
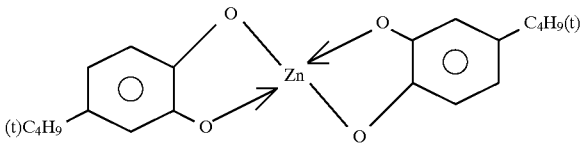

-continued
73.
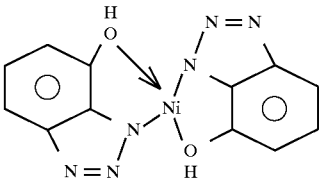
74.
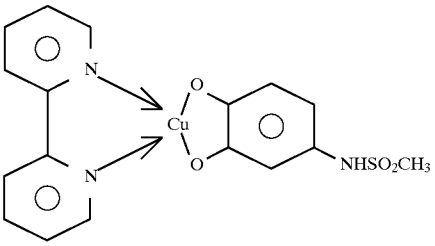
75.
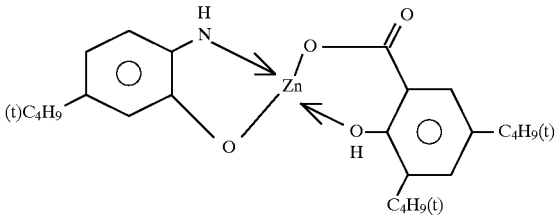
76.
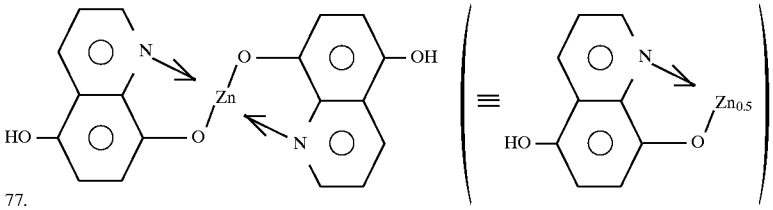
77.
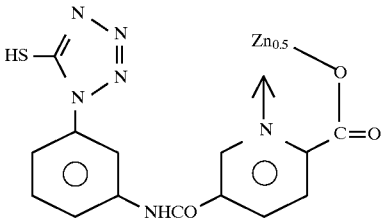
78.
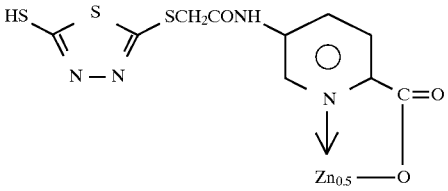
79.
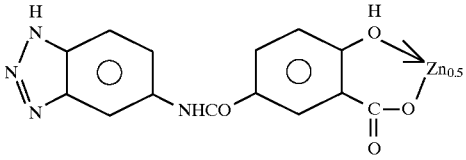

-continued
80.
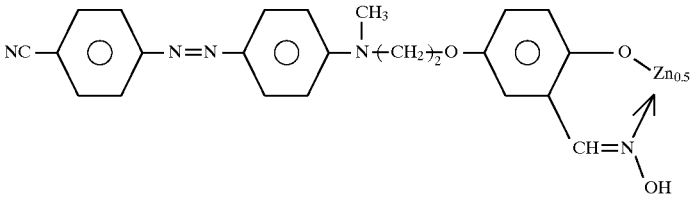
81.
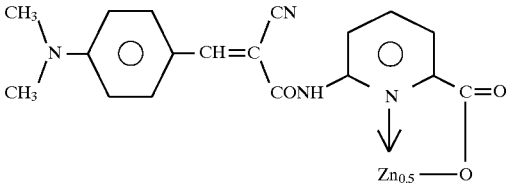
82.
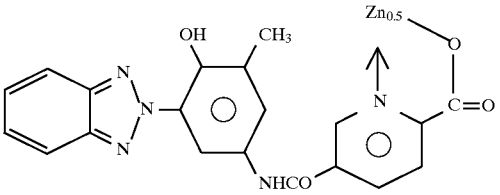
83.
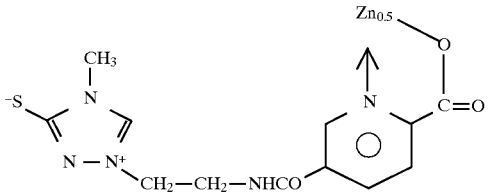
84.
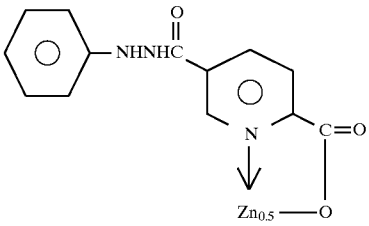
85.
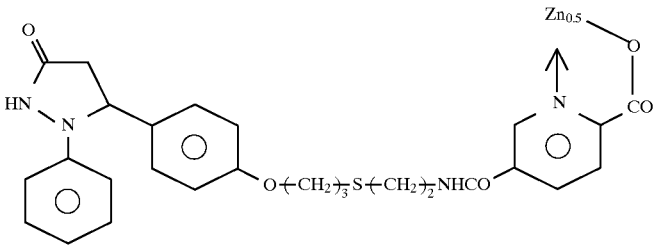

-continued
86.
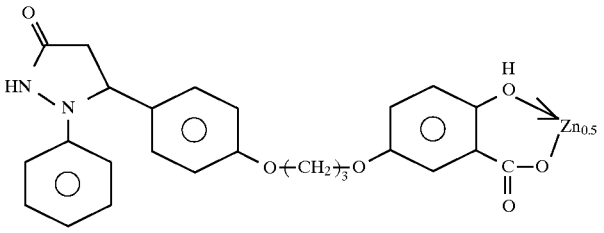
87.
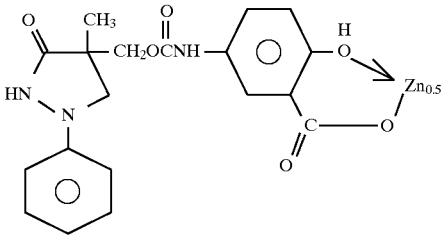
88.
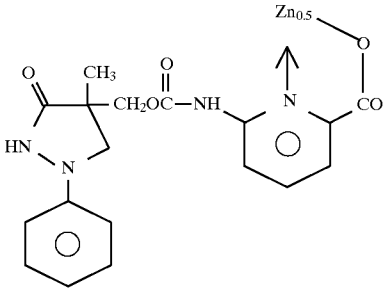
89.
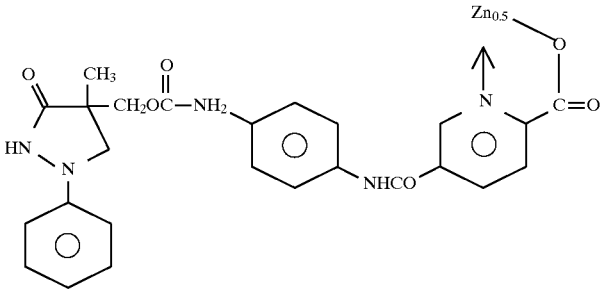
90.
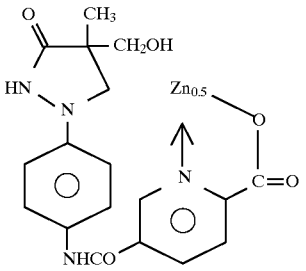

-continued

91.

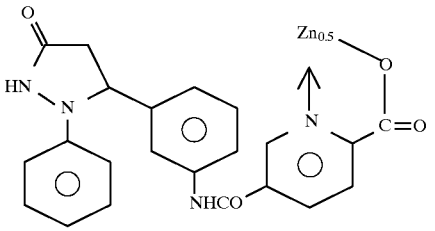

92.

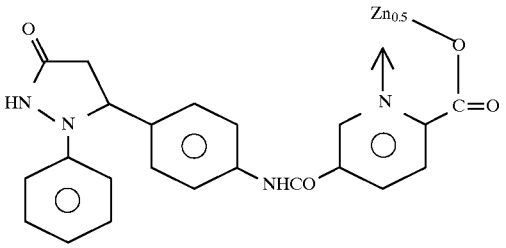

93.

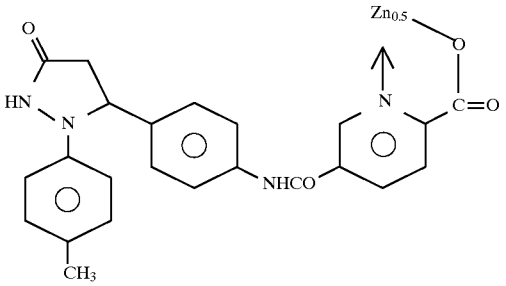

94.

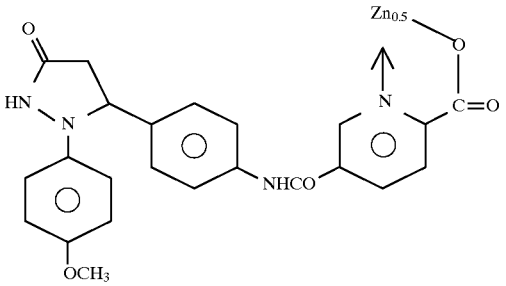

Synthesis examples of the compounds according to the present invention are shown below.

SYNTHESIS EXAMPLE 1

Synthesis of Compound (1)

Synthesis of Compound (A)

One hundred and seventy-six (176) grams of ethyl cinnamate, 108 g of phenylhydrazine, 200 ml of a 28% methanol solution containing sodium methoxide, and 400 ml of acetonitrile were mixed and refluxed with heating in the nitrogen atmosphere for 1 hour. The reaction solution was poured into 2 liters of water and 100 ml of concentrated hydrochloric acid was added, thereby precipitation was formed. This was filtered off and recrystallized with acetonitrile to obtain 180 g of 1-phenyl-5-phenylpyrazolidin-3-one (A) as white crystals.

(A)

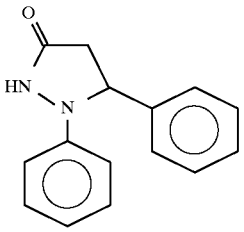

Synthesis of Compound (B)

Eighty-five (85) grams of piperonyl alcohol and 85.2 ml of triethylamine were dissolved in 250 ml of methylene chloride, and 85.6 g of pyridine-2,3-dicarboxylic anhydride was fractionally added to the solution in an ice bath so as not to exceed the temperature of 20° C. After the addition, the post reaction was carried out for 1 hour, then the reaction solution was poured into a mixed solution of 1 liter of water and 60 ml of concentrated hydrochloric acid. The crystals precipitated were recovered by filtration and washed with 1 liter of water. Thus, 110 g of Compound (B) was obtained as white crystals.

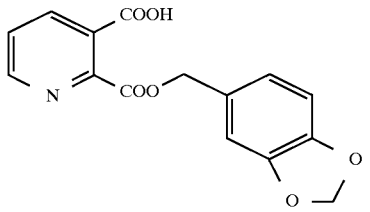

(B)

Synthesis of Compound (C)

Twenty-three point eight (23.8) grams of Compound (A), 30.1 g of Compound (B) and 0.8 g of 4-dimethylaminopyridine were dissolved in 100 ml of dimethylformamide, and 20 ml of an ethyl acetate solution containing 20.6 g of dicyclohexylcarbodiimide was dropwise added thereto in an ice bath. After the dropwise addition, the above solution was allowed to react at room temperature overnight. Two hundred (200) ml of ethyl acetate was poured into the reaction solution, the dicyclohexylurea obtained was filtered off, 300 ml of water was poured into the filtrate and the solution was separated. Washing with water was conducted two times, and after the organic layer was dried over anhydrous magnesium sulfate, the solvent was distilled off under reduced pressure. The oily product obtained was subjected to purification through silica gel column chromatography, and 43 g of Compound (C) was obtained from methylene chloride/ethyl acetate 10/3 fraction as a pale yellow oily product.

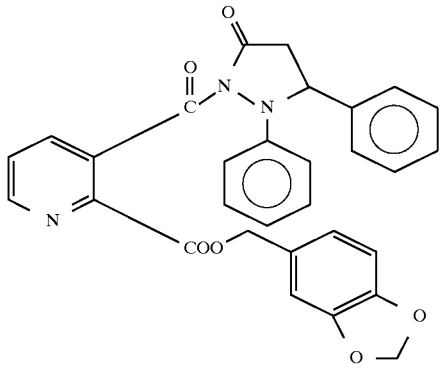

(C)

Synthesis of Compound (D)

Fifty-two point two (52.2) grams of Compound (C) was dissolved in 300 ml of methylene chloride, with ice-cooling, 38 g of trifluoroacetic acid was gradually added thereto. After the solution was allowed to react for 10 minutes, methylene chloride was distilled off under reduced pressure at room temperature. Two hundred (200) ml of acetonitrile was added to the reaction solution, the crystals precipitated were recovered by filtration and washed with 50 ml of acetonitrile to obtain 21 g of Compound (D) as white crystals.

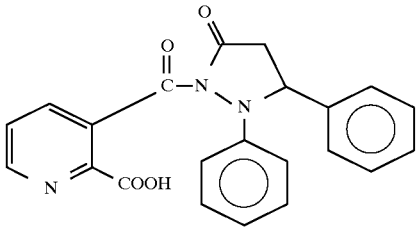

(D)

Synthesis of Compound (1)

Seven point eight (7.8) grams of Compound (D) was dissolved in a mixed solution of 100 ml of methanol and 20 ml of tetrahydrofuran, and 20 ml of a methanol solution containing 2.2 g of zinc acetate dihydrate was dropwise added thereto at room temperature. The crystals precipitated were recovered by filtration and washed with 30 ml of methanol, 30 ml of water, 30 ml of methanol, and 30 ml of ethyl acetate in this order. Thus, 7.6 g of Compound (1) was obtained.

SYNTHESIS EXAMPLE 2

Synthesis of Compound (2)

Synthesis of Compound (E)

Thirty-two (32) grams of sodium bicarbonate was added to 400 ml of a dimethylformamide solution containing 27.8 g of 3-hydroxypicolinic acid, further, 33.3 g of benzyl bromide was dropwise added thereto at room temperature. After the dropwise addition, the above mixed solution was allowed to react at room temperature for 6 hours, then the reaction solution was poured into 2 liters of water. The reaction solution was extracted with 1 liter of ethyl acetate, then the organic layer was dried over anhydrous magnesium sulfate, and the solvent was distilled off under reduced pressure. The obtained product was recrystallized with hexane to obtain 22 g of Compound (E) as white crystals.

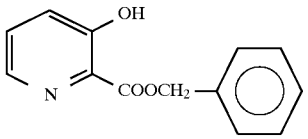

(E)

Synthesis of Compound (F)

One hundred and twenty-four (124) grams of Compound (A), 90.7 g of bromoacetic acid and 0.5 g of dimethylaminopyridine were dissolved in a mixed solvent of 1 liter of dimethylformamide and 300 ml of acetonitrile, and 150 ml of an acetonitrile solution containing 118.4 g of dicyclohexylcarbodiimide was added thereto by dividing to five portions at room temperature. After the addition, the above solution was allowed to stand overnight at room temperature, the dicyclohexylurea precipitated was filtered off, subsequently the filtrate was poured into 3 liters of water and extracted with 1 liter of ethyl acetate. The organic layer was dried over anhydrous magnesium sulfate, the solvent was distilled off under reduced pressure. The oily product obtained was subjected to purification through silica gel column chromatography, and 151 g of Compound (F) was obtained from hexane/ethyl acetate 2/1 fraction as a pale yellow oily product.

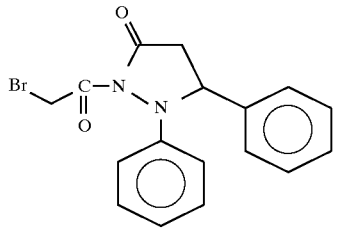

(F)

Synthesis of Compound (G)

Fifteen (15) grams of Compound (F) and 10.1 g of Compound (E) were dissolved in 100 ml of dimethylformamide and 6 ml of triethylamine was dropwise added thereto while maintaining the external temperature at 40° C. After the dropwise addition, the above mixed solution was allowed to react for 2 hours, then the reaction solution was poured into 200 ml of water. The reaction solution was extracted with 300 ml of ethyl acetate, then the organic layer was dried over anhydrous magnesium sulfate, and the solvent was distilled off under reduced pressure. The oily product obtained was subjected to purification through silica gel column chromatography, and 20.1 g of Compound (G) was obtained from hexane/ethyl acetate 1/1 fraction as a pale yellow oily product.

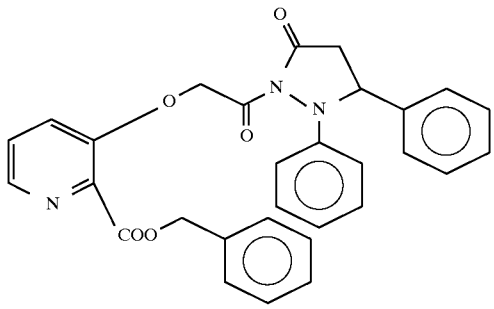

(G)

Synthesis of Compound (H)

Ten (10) grams of Compound (G) was dissolved in 100 ml of ethyl acetate, 0.5 g of 10% Pd-C was added thereto as a catalyst and a hydrogenation reaction was carried out in an autoclave at 40° C. for 2 hours (hydrogen pressure: 50 atm). After the reaction, the catalyst was filtered off and the filtrate was concentrated under reduced pressure to obtain 8.2 g of Compound (H) as white crystals.

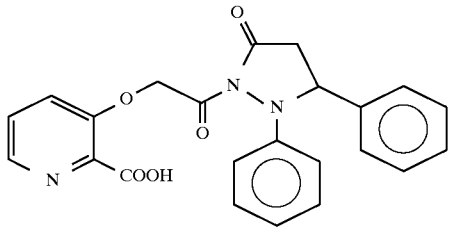

(H)

Synthesis of Compound (2)

Six point two (6.2) grams of Compound (H) was dissolved in 50 ml of methanol, and 10 ml of a methanol solution containing 1.6 g of zinc acetate dihydrate was dropwise added thereto at room temperature. The crystals precipitated were recovered by filtration and washed with 10 ml of methanol, 10 ml of water, 10 ml of methanol, and 10 ml of ethyl acetate in this order. Thus, 6.9 g of Compound (2) was obtained as white crystals.

SYNTHESIS EXAMPLE 3

Synthesis of Compound (4)

Compound (4) was synthesized by almost the same reaction procedure as in the synthesis of Compound (2), except that dimethylaminopyridine was not used in the synthesis of Intermediate Compound (F).

SYNTHESIS EXAMPLE 4

Synthesis of Compound (5)

Compound (5) was synthesized by almost the same reaction procedure as in the synthesis of Compound (2), except that 2-bromooctanoic acid was used in place of bromoacetic acid.

SYNTHESIS EXAMPLE 5

Synthesis of Compound (6)

Compound (6) was synthesized by almost the same reaction procedure as in the synthesis of Compound (4), except that 2-bromooctanoic acid was used in place of bromoacetic acid.

Various known methods can be used in the present invention for introducing a compound having a photographically useful compound which is inactivated by the chelation with a metal into a photographic material. It is preferred in the present invention for said compound to be contained as solid particles since the storage stability with the lapse of time of the photographic material of the present invention becomes better.

A method of producing solid particle colloid of a photographically useful compound of a sub-micrometer size is disclosed in British Patent 1,570,362 in which a photographically useful compound is made into aqueous slurry with an auxiliary dispersant using mills such as a sand mill and a bead mill and dispersing media (beads and balls), and the dispersing media are removed from the pulverized slurry to obtain solid particle colloid. Alkylphenoxyethoxysulfonic acid, naphthalenesulfonic acid, polyvinyl alcohol and polyvinyl pyrrolidone can be cited as an auxiliary dispersant.

The compound according to the present invention is dissolved according to the oil-in-water dispersion method disclosed in U.S. Pat. No. 2,322,027 using high boiling point organic solvents having a boiling point of 175° C. or more at normal pressure, such as phthalic acid esters, phosphoric acid esters, benzoic acid esters, fatty acid esters, amides, phenols, alcohols, carboxylic acids, N,N,N-dialkylanilines, hydrocarbons, oligomers or polymers and/or low boiling point organic solvents having a boiling point of about 30° C. to about 160° C. at normal pressure, such as amides, ethers, etc., then emulsified and dispersed in hydrophilic colloid, such as gelatin.

The process and effects of the latex dispersion method and specific examples of latexes for impregnation are disclosed in U.S. Pat. No. 4,199,363, German Patent Application (OLS) Nos. 2,541,274, 2,541,230 and EP-A-294104. These high boiling point organic solvents and latexes can be imparted with not only the function as mere dispersants but also various functions such as the reaction control of the compound according to the present invention, the control of coloring, the improvement of the physical properties of gelatin film, etc., by selecting the structures thereof. The form of high boiling point organic solvents may be any of liquid, wax or solid.

A compound having a photographically useful compound which is inactivated by the chelation with a metal according to the present invention is preferably contained in the silver halide emulsion layer nearest to the support or in the layer adjacent thereto, and may be contained in a single layer or may be contained in a plurality of layers. Said compound according to the present invention may be used alone or two or more compounds may be used, further, two or more compounds may be contained in separate layers.

Although the compound according to the present invention is preferably contained in the silver halide emulsion layer nearest to the support or in the layer adjacent thereto, it can be contained in any layers in addition to the above-described layer for the purpose of further controlling gradation and improving the storage stability.

The addition amount of the compound having the photographically useful compound which is inactivated by chelation with a metal according to the present invention is from $5\times10^{-6}$ mol to $2\times10^{-2}$ mol, preferably from $1\times10^{-4}$ mol to $1\times10^{-2}$ mol, and more preferably from $2\times10^{-4}$ mol to $5\times10^{-3}$ mol, per $m^2$ of the photographic-material, although it is varied according to the kinds of various photographic organic elements and silver halide emulsion contained in the layer to which the compound is added and the kinds of photographically useful compounds released.

The thus-introduced compound according to the present invention is present stably as a metal complex because a chelating agent is not present in high concentration in a photographic material during storage.

The behavior of the compound according to the present invention during development processing is described below. When a chelating agent is not contained in a processing solution or is contained in such low concentration as the function thereof is negligible, or when only a chelating agent having weaker affinity to the metal (M) in the compound according to the present invention than that of the ligand (LIG) is contained, the compound according to the present invention is present stably as a metal complex. That is, when the compound according to the present invention is emulsified and dispersed, the complex remains in an oil droplet and protected from various chemical reactions, therefore, the photographically useful compound is a little released. Further, when the compound is solid dispersed, the complex is present as a solid, therefore, the photographically useful compound is little released.

When a chelating agent having the equal or more affinity to the metal (M) in the compound according to the present invention than that of the ligand (LIG) is contained in a processing solution, a ligand exchange reaction is caused between the compound according to the present invention and the chelating agent in a processing solution, and because the compound according to the present invention is deprived of the metal, the compound becomes to have high reactivity. The mode of the succeeding reaction varies depending on the structure of the compound, but photographically useful compounds are quickly released through various intermolecular or intramolecular reactions.

The method of searching for the gradient in the present invention is explained.

First, the test sample of a photographic material is wedgewise exposed to a standard white light source (a light source having energy distribution of 4,800° K of black body radiation), and after the designated development processing is conducted, absorption densities of cyan, magenta and yellow are measured through red, green and blue filters by status M condition to obtain a characteristic curve. Each point of fog +0.25, +0.5, +1.0, +1.5 and +1.75 of the absorption densities of cyan, magenta and yellow to the logarithm of exposure amount (axis of abscissa) is plotted from the characteristic curve obtained, and these points are linearly approximated by the least square method. Tan θ to the angle θ from the axis of abscissa is defined as the gradient γ of the photographic material and the gradients γ of cyan, magenta and yellow are taken as γ (C), γ (M) and γ (Y), respectively.

When development processing I and development processing II are carried out, the gradients of yellow, magenta and cyan obtained by these development processing, $\gamma_I(C)$, $\gamma_I(M)$, $\gamma_I(Y)$, and $\gamma_{II}(C)$, $\gamma_{II}(M)$, $\gamma_{II}(Y)$, respectively, of the photographic material of the present invention satisfy the following conditions:

$0.8 \leqq \gamma_{II}(C)/\gamma_I(C) \leqq 1.2$ $0.8 \leqq \gamma_{II}(M)/\gamma_I(M) \leqq 1.2$ $0.8 \leqq \gamma_{II}(Y)/\gamma_I(Y) \leqq 1.2$ More preferably they satisfy the following conditions:

$0.9 \leqq \gamma_{II}(C)/\gamma_I(C) \leqq 1.1$ $0.9 \leqq \gamma_{II}(M)/\gamma_I(M) \leqq 1.1$ $0.9 \leqq \gamma_{II}(Y)/\gamma_I(Y) \leqq 1.1$ When these conditions are not satisfied, the tint of the color of the print obtained from the color negative film developed by at least either one of development processing I or II breaks and the color reproduction worth appreciating cannot be obtained.

In the present invention, $\gamma_I(C)$, $\gamma_I(M)$, $\gamma_I(Y)$, $\gamma_{II}(C)$, $\gamma_{II}(M)$, $\gamma_{II}(Y)$ each is preferably from 0.50 to 0.90, more preferably from 0.60 to 0.85, and particularly preferably from 0.65 to 0.80.

The color developing solutions used in development processing I and II for use in the present invention are explained below. Development processing I according to the present invention is processing corresponding to Kodak C-41 which is the processing for color negative films widely used in these days and is designed so that preferred gradation can be obtained, in general, in 3 minutes and 15 seconds. Development processing II is processing the speed of which is more increased than that of development processing I and which is contrived so that the gradation which approximates to the gradation in development processing I in 1 minute of color developing time can be obtained by enhancing the development activity by increasing the concentration of a developing agent and raising the processing temperature. However, when a photographic material beyond the scope of the present invention is processed, as the development of the lowermost red-sensitive layer is delayed, gradations cannot be completely made to coincide with.

Development processing I is development processing characterized in that color development processing is carried out in 3 minutes and 15 seconds of the color developing time at the temperature of a color developing solution of 38° C. using a color developing solution containing from 15 to 20 mmol/liter of 2-methyl-4-[N-ethyl-N-(β-hydroxyethyl)-amino]aniline as a color developing agent.

Development processing II is development processing characterized in that color development processing is carried out in 60 seconds of the color developing time at the temperature of a color developing solution of 45° C., using a color developing solution containing from 35 to 40 mmol/liter of 2-methyl-4-[N-ethyl-N-(β-hydroxyethyl)amino] aniline as a color developing agent, and containing at least one water-soluble nitrogen-containing heterocyclic carboxylic acid chelating agent.

2,6-Pyridinedicarboxylic acid is preferably used as a water-soluble nitrogen-containing heterocyclic carboxylic acid chelating agent and the addition amount thereof is preferably from $1\times10^{-2}$ mol to $1\times10^{-1}$ mol and more preferably from $2\times10^{-2}$ mol to $6\times10^{-2}$ mol.

Development processing II is prescribed by adjusting the gradation of the uppermost light-sensitive layer of the photographic material (in general, a blue-sensitive layer) within the above range to coincide with the gradation obtained in development processing I.

The pH of the color developing solutions in development processing I and II is 10.05. It is preferred to use a carbonate to maintain the pH of the processing solution 10.05. The addition amount thereof is preferably 0.1 mol/liter or more and from 0.2 to 0.3 mol/liter is particularly preferred.

Hydroxylamine and sulfite are preferably used as preservatives for a color developing agent. The addition amount of hydroxylamine is preferably from 0.05 to 0.2 mol/liter. The addition amount of sulfite is preferably from 0.02 to 0.04 mol/liter.

A bromine ion can be added to a color developing solution for adjusting developing speed.

Further, various chelating agent can be added to a color developing solution.

The processing steps after color development of development processing I and II (a desilvering step, a washing step) may be common to development processing I and II, and the processing solutions in development processing A and B described later can be used.

Development processing I is a development processing wherein various processing conditions of development processing A are limited, and development processing II is a development processing wherein various processing conditions of development processing B are limited.

Specific examples of development processing I and development processing II are described below. When these two processes are conducted, the gradations of the uppermost light-sensitive layer (in general, a blue-sensitive layer) of the photographic material are contrived to almost coincide with.

Specific Examples of Development Processing Steps I and II

Development Processing I-1

Processing Step of Development Processing I-1

| Processing Step | Processing Time | Processing Temperature (°C.) |
|---|---|---|
| Color Development | 3 min 15 sec | 38 |
| Bleaching | 1 min 00 sec | 38 |
| Blixing | 3 min 15 sec | 38 |
| Washing (1) | 1 min 00 sec | 38 |
| Washing (2) | 1 min 00 sec | 38 |
| Drying | 2 min 00 sec | 60 |

Processing Solution of Development Processing I-1

| | Tank Solution (g) |
|---|---|
| Color Developing Solution | |
| Diethylenetriaminepentaacetic Acid | 1.0 |
| 1-Hydroxyethylidene-1,1-diphosphonic Acid | 2.0 |
| Sodium Sulfite | 4.0 |
| Potassium Carbonate | 30.0 |
| Potassium Bromide | 1.4 |

-continued

| | Tank Solution (g) |
|---|---|
| Potassium Iodide | 1.5 mg |
| Hydroxylamine Sulfate | 2.4 |
| 4-[N-Ethyl-N-(β-hydroxyethyl)amino]-2-methylaniline Sulfate | 4.5 |
| Water to make | 1.0 liter |
| pH (adjusted with potassium hydroxide and sulfuric acid) | 10.05 |
| Bleaching Solution | |
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerating Agent $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 liter |
| pH (adjusted with aqueous ammonia and nitric acid) | 6.3 |
| Blixing Solution | |
| Ammonium Ethylenediaminetetraacetato Ferrate Dihydrate | 50.0 |
| Disodium Ethylenediaminetetraacetate | 5.0 |
| Sodium Sulfite | 12.0 |
| Aqueous Solution of Ammonium Thiosulfate (700 g/liter) | 240.0 ml |
| Aqueous Ammonia (27%) | 6.0 ml |
| Water to make | 1.0 liter |
| pH (adjusted with aqueous ammonia and acetic acid) | 7.2 |

Washing Water (tank solutions (1) and (2) are common)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto. The pH of this washing water was in the range of from 6.5 to 7.5.

Development Processing II-1

Processing Step of Development Processing II-1

| Processing Step | Processing Time | Processing Temperature (°C.) |
|---|---|---|
| Color Development | 60 sec | 45 |
| Bleaching | 1 min 00 sec | 38 |
| Blixing | 3 min 15 sec | 38 |
| Washing (1) | 1 min 00 sec | 38 |
| Washing (2) | 1 min 00 sec | 38 |
| Drying | 2 min 00 sec | 60 |

Processing Solution of Development Processing II-1

| Color Developing Solution | Tank Solution (g) |
|---|---|
| Diethylenetriaminepentaacetic Acid | 2.0 |
| 1-Hydroxyethylidene-1,1-diphosphonic Acid | 3.3 |
| Sodium Sulfite | 3.9 |
| Potassium Carbonate | 37.5 |

-continued

| Color Developing Solution | Tank Solution (g) |
|---|---|
| Potassium Bromide | 2.0 |
| Potassium Iodide | 1.3 mg |
| Hydroxylamine Sulfate | 4.5 |
| 2,6-Pyridinedicarboxylic Acid | 8.4 |
| 2-Ethyl-4-[N-ethyl-N-(β-hydroxyethyl)-amino]aniline Sulfate | 11.0 |
| Water to make | 1.0 liter |
| pH (adjusted with potassium hydroxide and sulfuric acid) | 10.05 |

Bleaching Solution

Common to development processing I-1.

Blixing Solution

Common to development processing I-1.

Washing Water

Both tank solutions (1) and (2) are common to development processing I-1.

Next, development processing A and development processing B for use in the present invention are described in detail below.

Development processing A and development processing B for use in the present invention each comprises a color development step, a desilvering step and a drying step. Preferred specific examples thereof are shown below but the present invention is not limited thereto.

(1) Color Development—Bleaching—Fixing—Washing—Stabilization—Drying (2) Color Development—Bleaching—Blixing—Washing—Stabilization—Drying (3) Color Development—Blixing—Washing—Stabilization—Drying (4) Color Development—Blixing—Fixing—Washing—Stabilization—Drying (5) Color Development—Bleaching—Washing—Fixing—Washing—Stabilization—Drying In the above processing steps, washing step before stabilization can be omitted. Further, the final stabilization can also be omitted. In development processing A and development processing B for use in the present invention, the desilvering step after color development may be the same or different. In development processing B, a prebath may be used in the step before color development for releasing a photographically useful compound from a block compound.

Color development in development processing A (i.e., color development processing A) according to the present invention is explained below.

The color developing time in color development processing A for use in the present invention is from 150 seconds to 200 seconds, preferably from 165 seconds to 195 seconds. The color developing time can be varied according to the kind and the concentration of the developing agent and the concentration of the halogen ion (in particular, $Br^-$) in the processing solution, and the temperature and pH of the processing solution.

As the developing agent in color development processing A for use in the present invention, 2-methyl-4-[(N-ethyl-N-(β-hydroxyethyl)amino]aniline, 2-methyl-4-[N-ethyl-N-(3-hydroxypropyl)amino]aniline, 2-methyl-4-[N-ethyl-N-(4-hydroxybutyl)amino]aniline are preferably used, and 2-methyl-4-[N-ethyl-N-(β-hydroxyethyl)amino]aniline is particularly preferably used. The concentration of the developing agent is from 10 mmol to 20 mmol per liter of the processing solution. These developing agents are preferably hydrochloride, p-toluenesulfonate or sulfate.

The concentration of the bromine ion is determined by the dissolution amount of Br from the silver halide color photographic material and the amount of Br supplemented to the color developing solution. The addition amount thereof is from 6 mmol to 14 mmol, preferably from 9 mmol to 13 mmol, per liter of the processing solution, for maintaining the stability of the photographic characteristics at the time of continuous processing.

The temperature of the processing solution is from 35° C. to 40° C., preferably from 36° C. to 39° C.

The pH of the processing solution is from 9.9 to 10.3, preferably from 10.0 to 10.2.

Specifically, the color developing solution and the color developing replenisher using CN-16, CN-16X, CN-16Q and CN-16FA, which are the processing agents for a color negative film manufactured by Fuji Photo Film Co., Ltd., or the color developing solution using C-41, C-41B and C-41RA, which are the processing agents for a color negative film manufactured by Eastman Kodak Company, can preferably be used.

Color development in development processing B (i.e., color development processing B) according to the present invention is explained below.

The color developing time in color development processing B for use in the present invention is from 25 seconds to 90 seconds, preferably from 35 seconds to 75 seconds.

The color developing time according to the present invention is a time including a crossover time (the time from coming out of the color developing solution until entering the processing solution of the next step). The crossover time is preferably as short as possible, but from the performance of the processor, it is preferably from 2 seconds to 10 seconds, more preferably from 3 seconds to 7 seconds.

The color developing time in color development processing B can also be varied, as in color development processing A, according to the kind and the concentration of the developing agent and the concentration of the halogen ion (in particular, $Br^-$) in the processing solution, and the temperature and pH of the processing solution.

The color developing agent for use in the present invention is a p-phenylenediamine derivative and preferred representative examples are shown below.

(D-1) 2-Methyl-4-[N-ethyl-N-(β-hydroxyethyl)amino] aniline (D-2) 2-Methyl-4-[N-ethyl-N-(3-hydroxypropyl)amino] aniline (D-3) 2-Methyl-4-[N-ethyl-N-(3-hydroxybutyl)amino] aniline (D-4) 2-Methyl-N,N-diethyl-p-phenylenediamine (D-5) 2-Methyl-4-[N-ethyl-N-(β-methanesulfonamido) amino]-aniline (D-6) 2-Methoxy-4-[N-ethyl-N-(β-hydroxyethyl)amino] aniline (D-7) 4-Amino-3-methoxy-N,N-bis(3-hydroxypropyl) aniline (D-8) 4-Amino-3-isopropyloxy-N,N-bis(3-hydroxyethyl) aniline (D-9) 1-(B-Hydroxyethyl)-5-amino-6-methylindoline (D-10) 1,2,3,4-Tetrahydro-1-(3,4-dihydroxybutyl)-2,2,4,7-tetramethyl-6-aminoquinoline (D-11) 1,2,3,4-Tetrahydro-1-(J3-hydroxyethyl)-4-hydroxymethyl-6-aminoquinoline In color development processing B for use in the present invention, D-1, D-2, D-3, D-6, D-7, D-8, D-10 and D-11 are preferred, D-1, D-2 and D-3 are more preferred, and D-1 is most preferred.

The concentration of the developing agent is from 25 mmol to 80 mmol, preferably from 25 mmol to 60 mmol, more preferably from 27 mmol to 50 mmol, and most preferably from 30 mmol to 45 mmol, per liter of the processing solution.

The above developing agents can be used in combination of two or more within the above range of the concentration of the developing agent.

In color development processing B for use in the present invention, a bromine ion is particularly important as an antifoggant, and the concentration of Br is from 15 mmol to 60 mmol, preferably from 16 mmol to 42 mmol, and particularly preferably from 16 mmol to 35 mmol, per liter of the processing solution.

The temperature of the processing solution is from 40° C. to 60° C., preferably from 42° C. to 55° C., and particularly preferably from 43° C. to 50° C.

The pH of the processing solution is from 9.9 to 11.0, preferably from 10.0 to 10.5.

The color developing solution of development processing B for use in the present invention contains a water-soluble nitrogen-containing heterocyclic carboxylic acid chelating agent.

It is desired that the water-soluble nitrogen-containing heterocyclic carboxylic acid chelating agent according to the present invention should have solubility of at least $2\times10^{-3}$ mol or more, preferably $1\times10^{-2}$ mol or more, per liter.

2-Pyridinecarboxylic acids, 2-pyrazinecarboxylic acid, imidazole-4,5-dicarboxylic acid, etc., can be cited as the water-soluble nitrogen-containing heterocyclic carboxylic acid chelating agent for use in the present invention, and 2-pyridinecarboxylic acids represented by the following formula (V) are particularly preferred:

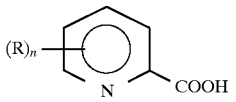

(V)

wherein R represents an alkyl group having from 1 to 4 carbon atoms (e.g., methyl, ethyl, isobutyl), a sulfo group, a hydroxyl group, a carboxyl group, an amino group, an alkoxyl group having from 1 to 12 carbon atoms (e.g., methoxy, ethoxy, dodecyloxy), or an amido group having from 1 to 6 carbon atoms (e.g., acetylamino, pivaloylamino), and n represents 0 or an integer of from 1 to 4. R preferably represents a carboxyl group and n preferably represents 0 or 1.

Specific examples of preferred compounds represented by formula (V) are shown below, but the present invention is not limited thereto.

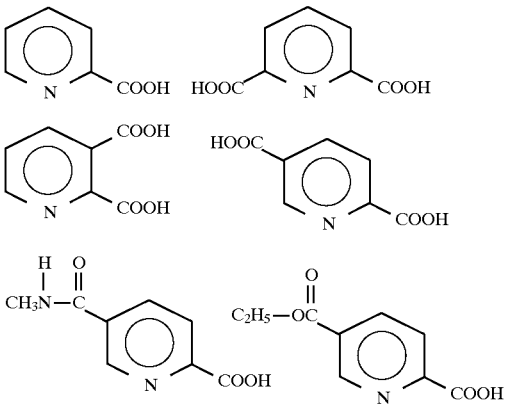

-continued

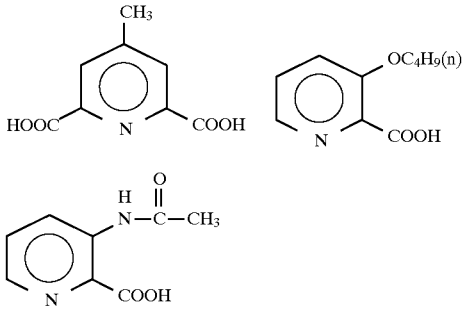

The amount of the water-soluble nitrogen-containing heterocyclic carboxylic acid chelating agent to be contained in a developing solution is from $1\times10^{-3}$ mol to $5\times10^{-1}$ mol, preferably from $5\times10^{-3}$ mol to $2\times10^{-1}$ mol, and more preferably from $1\times10^{-2}$ mol to $1\times10^{-1}$ mol, per liter of the developing solution.

Only one kind of the water-soluble nitrogen-containing heterocyclic carboxylic acid chelating agent may be contained in the developing solution, or two or more kinds may be contained.

In development processing B for use in the present invention, a prebath containing the water-soluble nitrogen-containing heterocyclic carboxylic acid chelating agent can be used before color developing solution. The temperature and pH of the prebath are the same as in the color developing solution, and the kind and the concentration of the water-soluble nitrogen-containing heterocyclic carboxylic acid chelating agent are the same as in the case to be contained in the color developing solution.

As hydroxylamine can be widely used as a preservative of a color developing solution, when higher preservability is required, hydroxylamine derivatives having an alkyl group, a hydroxyalkyl group, a sulfoalkyl group or a carboxyalkyl group as a substituent are preferred. Specifically, N,N-di-(sulfoethyl)hydroxylamine, monomethylhydroxylamine, dimethylhydroxylamine, monoethylhydroxylamine, diethylhydroxylamine, and N,N-di(carboxyethyl) hydroxylamine are preferably used. N,N-Di(sulfoethyl) hydroxylamine is particularly preferred of the above. These compounds can be used in combination with hydroxylamine, but they are preferably used in combination of one or two or more in place of hydroxylamine.

A preservative is preferably used in an amount of from 0.02 to 0.2 mol, more preferably from 0.03 to 0.15 mol, and still more preferably from 0.04 to 0.1 mol, per liter of the color developing solution. In the replenisher, same as the color developing agent, a preservative is preferably contained in the concentration of from 1.1 to 3 times of the mother solution (processing tank solution).

In a color developing solution, sulfite is used to prevent the oxidized product of a color developing agent from becoming tar. The concentration of sulfite in a color developing solution is preferably from 0.01 to 0.05 mol, particularly preferably from 0.02 to 0.04 mol, per liter of the color developing solution. In the replenisher, it is preferred to use sulfite in the concentration of from 1.1 to 3 times of these amounts.

The pH of a color developing solution is preferably from 9.8 to 11.0, and particularly preferably from 10.0 to 10.5, and pH of the replenisher is preferably set at the value by 0.1 to 1.0 higher than the above value. Known pH buffers such as carbonate, phosphate, sulfosalicylate, and borate are used for stably maintaining the pH.

The replenishing rate of a color developing solution is preferably from 80 to 1,300 ml per $m^2$ of the photographic material but, the less is the better, from the viewpoint of the reduction of environmental pollution, and is generally from 80 to 600 ml, preferably from 80 to 400 ml.

The compounds and the processing conditions disclosed in line 16, left lower column, page 4 to line 6, left lower column, page 7 of JP-A-4-125558 can be applied to the processing solution having bleaching ability of the present invention.

A bleaching agent having an oxidation reduction potential of 150 mV or more is preferred, and specific examples thereof disclosed in JP-A-5-72694 and JP-A-5-173312 are preferably used in the present invention, in particular, 1,3-diaminopropanetetraacetic acid and the ferric complex salt of the compounds in specific example 1, page 7 of JP-A-5-173312 are preferred.

In addition, for improving the biodegradability of a bleaching agent, it is preferred to use the ferric complex salt of the compounds disclosed in JP-A-4-251845, JP-A-4-268552, EP-A-588289, EP-A-591934, and JP-A-6-208213 as a bleaching agent. The concentration of these bleaching agents is preferably from 0.05 to 0.3 mol per liter of the processing solution having bleaching ability, and for reducing the discharge amount to the environment, the concentration from 0.1 to 0.15 mol per liter is preferred. When the solution having bleaching ability is a bleaching solution, it is preferred to contain bromide in an amount of from 0.2 to 1 mol, and particularly preferably from 0.3 to 0.8 mol, per liter of the bleaching solution.

The replenisher of the solution having bleaching ability contains fundamentally the concentration of each component calculated by the following equation. According to this procedure, the concentration in the mother solution can be maintained constant.

$$C_R = C_T \times (V_1 + V_2)/V_1 + C_P$$

$C_R$: The concentration of the component in the replenisher $C_T$: The concentration of the component in the mother solution (processing tank solution)

$C_p$: The concentration of the component consumed during processing $V_1$: The replenishing rate of the replenisher having bleaching ability per m of the photographic material (ml)

$V_2$: The amount of carryover from the prebath by $m^2$ of the photographic material (ml)

In addition, a bleaching solution preferably contains a pH buffer, in particular, comparatively odorless dicarboxylic acids such as succinic acid, maleic acid, malonic acid, glutaric acid, and adipic acid are preferred. It is also preferred to use known bleaching accelerators disclosed in JP-A-53-95630, RD, No. 17129, and U.S. Pat. No. 3,893,858.

A bleaching solution is preferably replenished with a bleaching replenisher in an amount of from 50 to 1,000 ml per $m^2$ of the photographic material, more preferably from 80 to 500 ml and most preferably from 100 to 300 ml. Further, a bleaching solution is preferably conducted aeration.

The compounds and the processing conditions disclosed in line 10, left lower column, page 7 to line 19, right lower column, page 8 of JP-A-4-125558 can be applied to the processing solution having fixing ability.

In particular, for improving fixing speed and preservability, the compounds represented by formula (I) or (II) disclosed in JP-A-6-301169 are preferably added to the processing solution having fixing ability alone or in combination. Further, the use of the sulfinic acid disclosed in JP-A-1-224762 as well as p-toluenesulfinate is preferred for improving preservability.

In the solution having bleaching ability and the solution having fixing ability, ammonium is preferably used as a cation for improving desilvering ability but taking the reduction of the environmental pollution into consideration, ammonium is preferably reduced or, if possible, not contained at all.

In bleaching, blixing and fixing processes, it is particularly preferred to carry out the jet stirring as disclosed in JP-A-1-309059.

The replenishing rate of the replenisher in blixing process or fixing process is from 100 to 1,000 ml, preferably from 150 to 700 ml, and particularly preferably from 200 to 600 ml, per m of the photographic material.

It is preferred to recover silver by installing various silver recovery devices by in-line and off-line systems in blixing and fixing processes. Using an in-line system, processing can be carried out with a reduced concentration of silver in a solution, as a result, the replenishing rate can be reduced. Further, it is preferred to recover silver by an off-line system and reuse the solution after silver recovery as a replenisher.

Blixing process and fixing process may comprise a plurality of processing tanks and it is preferred to adopt a multistage countercurrent system with each tank being arranged in cascade piping. From the balance with the size of a processor, in general, two-tank cascade structure is effective and the proportion of the processing time in the preceding tank and the succeeding tank is preferably from 0.5/1 to 1/0.5, particularly preferably from 0.8/1 to 1/0.8.

From the viewpoint of improving preservability, it is preferred that a free chelating agent not in the form of a metal complex is contained in a blixing solution or a fixing solution, and the biodegradable chelating agent described above with respect to the bleaching solution is preferably used as such a chelating agent.

With respect to washing and stabilizing processes, the contents disclosed in line 6, right lower column, page 12 to line 16, right lower column, page 13 of the above JP-A-4-125558 can be preferably applied to the present invention. In particular, the use of the azolylmethylamines disclosed in EP-A-504609 and EP-A-519190, or the N-methylolazoles disclosed in JP-A-4-362943 in place of formaldehyde in a stabilizing solution, and the elimination of image stabilizers such as formaldehyde from a stabilizing solution, by introducing a 2-equivalent magenta coupler into a photographic material are preferred from the work environmental protection.

Further, the stabilizing solution disclosed in JP-A-6-289559 can preferably be used to reduce the adhesion of dusts to a magnetic recording layer coated on a photographic material.

The replenishing rate of washing water and a stabilizing solution is preferably from 80 to 1,000 ml, more preferably from 100 to 500 ml, and still more preferably from 150 to 300 ml, per $m^2$ of the photographic material, which is a preferred range from both sides of the security of washing or stabilizing function and the reduction of waste solution for environmental protection. In processing with such a replenishing rate, it is preferred to use known fungicides such as thiabendazole, 1,2-benzisothiazolin-3-one, and 5-chloro-2-methylisothiazolin-3-one, antibiotics such as gentamycin, and deionized water by ion exchange resin to prevent proliferation of bacteria and fungus. It is more effective to use deionized water with biocides and antibiotics in combination.

The solution in a washing or stabilizing tank is preferably treated by reverse osmosis treatment as disclosed in JP-A-3-46652, JP-A-3-53246, JP-A-3-55542, JP-A-3-121448 and JP-A-3-126030 to reduce the replenishing rate, and in this case a reverse osmosis membrane is preferably a low pressure reverse osmosis membrane.

In the processing of the present invention, it is particularly preferred to conduct the compensation of evaporation of processing solutions as disclosed in Hatsumei-Kyokai, Kokai-Giho, Kogi No. 94-4992. In particular, according to formula-1 on page 2 of the above literature, the method of compensation based on the information of the temperature and humidity of the atmosphere where the processor is installed is preferred. The water to be used for the compensation of evaporation is preferably drawn from the replenisher tank of water washing, and in such a case deionized water is preferably used as the water washing replenisher.

The processing chemicals disclosed in line 15, right column, page 3 to line 32, left column, page 4 of the above Kokai Giho are preferably used in the present invention. The film processor disclosed in lines 22 to 28, right column, page 3 of the above Kokai Giho is preferably used therefor.

Preferred processing chemicals, automatic processors, and specific examples of the evaporation compensation method for carrying out the present invention are disclosed in line 11, right column, page 5 to the last line, right column, page 7 of the above Kokai Giho.

The processing chemicals for use in the present invention may be supplied in any form such as the solution of the concentration of the working solutions, concentrated solutions, granulated powders, dusting powders, tablets, paste or emulsions. As examples of such processing chemicals, there are solution chemicals contained in a low oxygen permeable container disclosed in JP-A-63-17453, vacuum packaged dusting powders and granulated powders disclosed in JP-A-4-19655 and JP-A-4-230748, granulated powders containing water-soluble polymers disclosed in JP-A-4-221951, tablets disclosed in JP-A-51-61837 and JP-A-6-102628, and paste-like processing chemicals disclosed in JP-A-57-500485, and any of these can be used preferably, but from the convenience at the time of use, it is preferred to use solution chemicals previously prepared in the concentration of the working solutions.

As the materials of containers for these processing chemicals, polyethylene, polypropylene, polyvinyl chloride, polyethylene terephthalate, and nylon are used alone or as a composite material. Materials are selected according to the levels of the oxygen permeability required. For a solution which is liable to be oxidized, for example, a color developing solution, materials of low oxygen permeability are preferred, specifically, polyethylene terephthalate and a composite material of polyethylene and nylon. These materials preferably have a thickness of from 500 to 1,500 $\mu$m and oxygen permeability of 20 ml/m$^2$·24 hrs·atm or less.

The photographic material of the present invention comprises at least one blue-sensitive layer, at least one green-sensitive layer and at least one red-sensitive layer on a support. Unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a -thigh sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the upper layer is a silver halide emulsion layer having the highest sensitivity, the middle layer is a silver halide emulsion layer having a lower sensitivity than that of the upper layer, and the lower layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer. (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halides preferably used in the present invention are silver iodobromide, silver iodochloride or silver iodochlorobromide containing about 30 mol % or less of silver iodide, and particularly preferably used are silver iodobromide or silver iodochlorobromide containing from about 2 mol% to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

The silver halide grains may be a fine grain having a grain size of about 0.2 μm or less, or large size grains having a projected area diameter of up to about 10 μm, and the emulsion may be a polydisperse emulsion or a monodisperse emulsion.

The term "equivalent-circle diameter" as used hereinafter means a diameter of a circle having the same area as the projected area of a grain. The term "equivalent-sphere diameter" as used hereinafter means a diameter of a sphere having the same volume as the volume of a grain.

The silver halide photographic emulsions for use in the present invention can be prepared using the methods disclosed, for example, in *Research Disclosure* (hereinafter abbreviated to RD), No. 17643 (December, 1978), pages 22 and 23, "I. Emulsion Preparation and Types", RD, No. 18716 (November, 1979), page 648, RD, No. 307105 (November, 1989), pages 863 to 865, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the superficial latent image type wherein the latent image is primarily formed on the surface, or of the internal latent image type wherein the latent image is formed within the grains, or of a type wherein the latent image is formed both at the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in RD, No. 17643, RD, No. 18716, and RD, No. 307105, and the locations of these disclosures are summarized in a table below.

In the photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 4μm, and particularly preferably from 0.05 to 0.6 μm. Further, the form of the grains may be regular grains and may be a polydisperse emulsion, but a monodisperse emulsion (at least 95% of which have a grain size within ±40% of the average grain size in terms of the weight or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining color images and which do not substantially undergo development during development processing, and they are preferably not pre-fogged. The fine grained silver halide has a silver bromide content of from 0 to 100 mol %, and may contain silver chloride and/or silver iodide, if necessary. The fine grained silver halides which have a silver iodide content of from 0.5 to 10 mol% are preferred. The average grain size of the fine grained silver halide (the average value of the diameters of the circles equivalent to the projected areas) is preferably from 0.01 to 0.5 μm, more preferably from 0.02 to 0.2 μm.

The fine grained silver halide can be prepared by the same methods as the preparation of generally used light-sensitive silver halides. In the preparation of the fine grained silver halide, the surface of the silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in the fine grained silver halide before addition to the coating solution. Colloidal silver can be included in the layer containing the fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in RD and the locations related thereto are indicated in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |

-continued

| Type of Additives | RD 17643 | RD 18716 | RD 307105 |
|---|---|---|---|
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbing Agents, Filter Dyes, and Ultraviolet Absorbing Agents | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the light-sensitive material of the present invention, and the following couplers are particularly preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), column 7, lines 36 to 58 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; [A-4]-63 (page 134), and [A-4]-73 and [A-4]-75 (page 139) of EP-A-456257; M-4 and M-6 (page 26) and M-7 (page 27) of EP-A-486965; M-45 (page 19) of EP-A-571959; (M-1) (page 6) of JP-A-5-204106; and M-22, paragraph 0237 of JP-A-4-362631.

Cyan Couplers:

CX-1, CX-3, CX-4, CX-5, CX-11, CX-1-2, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the colored dyes of which have an appropriate diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for correcting the unnecessary absorption of colored dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development inhibitor releasing compounds:

the compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (1) disclosed in EP-A-568037 (in particular, (23) (page 11); and the compounds represented by formula (I), (II) or (III) disclosed on pages 5 and 6 of EP-A-440195 (in particular, I-(1) on page 29);

Bleaching accelerator releasing compounds:

the compounds represented by formula (I) or (I') disclosed on page 5 of EP-A-310125 (in particular, (60) and (61) on page 61); and the compounds represented by formula (I) disclosed in claim 1 of JP-A-6-59411 (in particular, (7) on page 7);

Ligand releasing compounds:

the compounds represented by LIG-X disclosed in claim 1 of U.S. Pat. No. 4,555,478 (in particular, the compounds in lines 21 to 41, column 12);

Leuco dye releasing compounds:

compounds 1 to 6, columns 3 to 8 of U.S. Pat. No. 4,749,641;

Fluorescent dye releasing compounds:

the compounds represented by COUP-DYE disclosed in claim 1 of U.S. Pat. No. 4,774,181 (in particular, compounds 1 to 11, columns 7 to 10);

Development accelerator releasing or fogging agent releasing compounds:

the compounds represented by formula (1), (2) or (3), column 3 of U.S. Pat. No. 4,656,123 (in particular, (I-22), column 25); and compound ExZK-2, lines 36 to 38, page 75 of EP-A-450637; and Compounds which release dyes the color of which is restored after elimination:

the compounds represented by formula (I) disclosed in claim 1 of U.S. Pat. No. 4,857,447 (in particular, Y-1 to Y-19, columns 25 to 36).

Preferred additives other than couplers are listed below:

Dispersion mediums of oil-soluble organic compound:

P-3, P-5, P-16, P-19, P-25, P-30, P-42, P-49, P-54, P-55, P-66, P-81, P-85, P-86 and P-93 (pages 140 to 144) of JP-A-62-215272;

Latexes for impregnation of oil-soluble organic compound:

the latexes disclosed in U.S. Pat. No. 4,199,363;

Scavengers for the oxidation product of a developing agent:

the compounds represented by formula (I), lines 54 to 62, column 2 of U.S. Pat. No. 4,978,606 (in particular, I-(1), I-(2), I-(6) and I-(12), columns 4 and 5); and the compounds represented by the formula disclosed in lines 5 to 10, column 2 of U.S. Pat. No. 4,923,787 (in particular, compound 1, column 3);

Stain inhibitors:

the compounds represented by formula (I), (II) or (III), lines 30 to 33, page 4 of EP-A-298321 (in particular, I-47, I-72, III-1 and III-27, pages 24 to 48);

Discoloration inhibitors:

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321; II-1 to III-23, columns 25 to 38 of U.S. Pat. No. 5,122,444 (in particular, III-10); I-1 to III-4, pages 8 to 12 of EP-A-471347 (in particular, II-2); and A-1 to A-48, columns 32 to 40 of U.S. Pat. No. 5,139,931 (in particular, A-39 and A-42);

Compounds for reducing the using amounts of color intensifiers and color mixing preventives:

I-1 to II-15, pages 5 to 24 of EP-A-411324 (in particular, I-46);

Formaldehyde scavengers:

SCV-1 to SCV-28, pages 24 to 29 of EP-A-477932 (in particular, SCV-8);

Hardening agents:

H-1, H-4, H-6, H-8 and H-14 on page 17 of JP-A-1-214845; the compounds represented by any of formulae (VII) to (XII), columns 13 to 23 of U.S. Pat. No. 4,618,573 (H-1 to H-54); the compounds represented by formula (6), right lower column, page 8 of JP-A-2-214852 (H-1 to H-76) (in particular, H-14); and the compounds disclosed in claim 1 of U.S. Pat. No. 3,325,287;

Development inhibitor precursors:

P-24, P-37 and P-39, pages 6 and 7 of JP-A-62-168139; and the compounds disclosed in claim 1 of U.S. Pat. No. 5,019,492 (in particular, compounds 28 and 29, column 7);

Fungicides and biocides:

I-1 to III-43, columns 3 to 15 of U.S. Pat. No. 4,923,790 (in particular, II-1, II-9, II-10, II-18 and III-25);

Stabilizers and antifoggants:

I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical sensitizers:

triphenylphosphine selenide; and compound 50 disclosed in JP-A-5-40324;

Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124, pages 8 to 26 of WO 88/04794; compounds 1 to 22, pages 6 to 11 of EP-A-319999 (in particular, compound 1); compounds D-1 to D-87 represented by any of formulae (1) to (3), pages 3 to 28 of EP-A-519306; compounds 1 to 22 represented by formula (I), columns 3 to 10 of U.S. Pat. No. 4,268,622; and compounds (1) to (31) represented by formula (I), columns 2 to 9 of U.S. Pat. No. 4,923,788;

Ultraviolet absorbers:

compounds (18b) to (18r) represented by formula (1), 101 to 427, pages 6 to 9 of JP-A-46-3335; compounds (3) to (66) represented by formula (I), pages 10 to 44, and compounds HBT-1 to HBT-10 represented by formula (III), page 14, of EP-A-520938; and compounds (1) to (31) represented by formula (1), columns 2 to 9 of EP-A-521823.

The present invention can be applied to various color photographic materials such as color negative films for general and cinematographic uses, color reversal films for slide and television uses, color papers, color positive films and color reversal papers. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in RD, No. 17643, page 28, RD, No. 18716, from page 647, right column to page 648, left column, and RD, No. 307105, page 879.

The photographic material of the present invention has a total film thickness of all the hydrophilic colloid layers on the side where the emulsion layers are located of preferably 28 μm or less, more preferably 23 μm or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% relative humidity (stored for two days), and $T_{1/2}$ can be measured using a swellometer of the type described in A. Green et al., *Photogr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness.

The provision of hydrophilic colloid layers (known as backing layers) having a total dry film thickness of from 2 μm to 20 μm on the side of the support opposite to the side on which emulsion layers are provided is preferred in the photographic material of the present invention. The inclusion of the above described light absorbers, filter dyes, ultraviolet absorbers, antistatic agents, hardening agents, binders, plasticizers, lubricants, coating aids, and surfactants in the backing layers is preferred. The swelling factor of the backing layer is preferably from 150 to 500%.

Any color paper for print commercially available can be used in the present invention. Preferred gradient of a color paper is about 2.7±0.1 in calorimetric density. (With respect to calorimetric density, Nihon Shashin Gakkai compiled, *Shashin Kogaku no Kiso, Gin-en Shashin Hen* (*Basis of Photographic Technology, Silver Salt Photography*), page 387 can be referred to.)

A silver halide color photographic material according to the present invention may have a magnetic recording layer. A magnetic recording layer for use in the present invention is explained below.

A magnetic recording layer for use in the present invention is a layer coated on a support with an aqueous or organic solvent based coating solution comprising magnetic particles dispersed in a binder.

Examples of the magnetic particles for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the magnetic particle may be any of an acicular shape, a rice grain shape, a spherical shape, a cubic shape, or a plate-like shape. The specific surface area ($S_{BET}$) is preferably 20 $m^2/g$ or more, and particularly preferably 30 $m^2/g$ or more. The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic particles-may be surface treated with silica and/or alumina and organic materials. Further, the surface of the ferromagnetic particles may be treated with a silane coupling agent or a titanium coupling agent as disclosed in JP-A-6-161032. In addition, the magnetic particles the surfaces of which are covered with inorganic or organic substance as disclosed in JP-A-4-259911 and JP-A-5-81652 can also be used.

The binders which can be used for the magnetic particles includes the thermoplastic resins, thermosetting resins, radiation curable resins, reactive type resins, acid-, alkali- or biodegradable polymers, natural polymers (e.g., cellulose derivatives, saccharide derivatives), and mixtures thereof disclosed in JP-A-4-219569. The above described resins have a Tg of from −40° C. to 300° C., and a weight average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri) acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

The above magnetic substances are dispersed in the above-described binder preferably using, as disclosed in JP-A-6-35092, a kneader, a pin type mill, and an annular type mill, and the combined use thereof is also preferred. The dispersants disclosed in JP-A-5-88283 or other known dispersants can be used. The thickness of a magnetic recording layer is from 0.1 $\mu$m to 10 $\mu$m, preferably from 0.2 $\mu$m to 5 $\mu$m, and more preferably from 0.3 $\mu$m to 3 $\mu$m. The weight ratio of the magnetic particles to the binder is preferably from 0.5/100 to 60/100, and more preferably from 1/100 to 30/100. The coating amount of the magnetic particles is from 0.005 to 3 $g/m^2$, preferably from 0.01 to 2 $g/m^2$, and more preferably from 0.02 to 0.5 $g/m^2$. Transmission yellow density of the magnetic recording layer is preferably from 0.01 to 0.50, more preferably from 0.03 to 0.20, and particularly preferably from 0.04 to 0.15. A magnetic recording layer can be provided on the back surface of the photographic support entirely or in stripe by coating or printing. Coating of a magnetic recording layer can be carried out by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may be provided with functions of lubrication improvement, curling adjustment, antistatic property, adhesion prevention and head abrasion, or another functional layer having these functions may be provided, and at least one kind or more of the particles are preferably abrasives of aspheric inorganic particles having Mohs' hardness of 5 or more. The composition of the aspheric inorganic particle is preferably an oxide such as aluminum oxide, chromium oxide, silicon dioxide, titanium dioxide, etc., a carbide such as silicon carbide and titanium carbide, and fine particles such as diamond. The surface of these abrasives may be treated with a silane coupling agent or a titanium coupling agent. These particles may be added to a magnetic recording layer, or may be overcoated on a magnetic recording layer (e.g., a protective layer, a lubricating layer). The above described binders can be used at this time, preferably the same binders as the binder of the magnetic recording layer are used. Photographic materials having magnetic recording layers are disclosed in U.S. Pat. Nos. 5,336,589, 5,250,404, 5,229,259, 5,215,874 and EP-A-466130.

The polyester support for use in the present invention is described below, but details including photographic materials described above, processing, cartridges and working examples are disclosed in Kokai-Giho, Kogi No. 94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols, diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester comprising from 50 mol% to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more to less than Tg for the purpose of being reluctant to get curling habit. The heat treatment may be carried out at constant temperature within this range or may be carried out with cooling. The heat treatment time is from 0.1 hours to 1,500 hours, preferably from 0.5 hours to 200 hours. The heat treatment of the support may be carried out in a roll state or may be carried out in a web state while transporting. The surface of the support may be provided with concave and convex (e.g., coating conductive inorganic fine particles such as $SnO_2$ or $Sb_2O_5$) to improve the surface state. Also, it is preferred to make some designs such that the edge is knurled to slightly increase the height only of the edge, thereby preventing the difference in level due to the edge from imparting the evenness of support wound thereon. The heat treatment may be carried out at any stage of after formation of the support, after the surface treatment, after coating of a backing layer (an antistatic agent, a sliding agent, etc.), or after undercoating, but preferably conducted after coating of an antistatic agent.

An ultraviolet absorber may be incorporated into the polyester support. Further, light piping can be prevented by including the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment.

An undercoating method is described below. An undercoat layer may be a single layer or may be two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-S-triazine), epichlorohydrin resins, and active vinyl sulfone compounds. $SiO_2$, $TiO_2$, inorganic fine particles or polymethyl methacrylate copolymer fine particles (0.01 to 10 $\mu$m) may be contained as a matting agent.

Further, antistatic agents are preferably used in the present invention. Examples of such antistatic agents include high polymers containing a carboxylic acid, a carboxylate, or a sulfonate, cationic polymers, and ionic surfactant compounds.

The most preferred antistatic agents are fine particles of a crystalline metal oxide of at least one particle selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7\Omega\cdot$cm or less, more preferably $10^5\Omega\cdot$cm or less and having a particle size of from 0.001 to 1.0 $\mu$m or fine particles of composite oxides of them (Sb, P, B, In, S, Si, C), further, fine particles of a metal oxide in the form of sol or fine particles of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the photographic material of the present invention to have a sliding property. The sliding agent-containing layer is preferably provided on both of light-sensitive layer surface and backing layer surface. Preferred sliding property is a dynamic friction coefficient of from 0.01 to 0.25. Measurement at this time is conducted using a stainless steel ball having a diameter of 5 mm at a transporting speed of 60 cm/min (25° C., 60% RH). In this evaluation, when the opposite material is replaced with the light-sensitive layer surface, almost the same level of value can be obtained.

Examples of the sliding agent which can be used in the present invention include polyorganosiloxane, a higher fatty acid amide, a higher fatty acid metal salt, and an ester of a higher fatty acid and a higher alcohol. As polyorganosiloxane, polydimethylsiloxane, polydiethylsiloxane, polystyrylmethylsiloxane, and polymethylphenylsiloxane can be used. The addition layer is preferably the outermost layer of the emulsion layer or a backing layer. In particular, polydimethylsiloxane or esters having a long chain alkyl group are preferred.

The photographic material of the present invention preferably contains a matting agent. The matting agent may be added to either of the emulsion layer side or the backing layer side but it is particularly preferably to be added to the outermost layer on the emulsion layer side. The matting agent may be either soluble or insoluble in the processing solution, preferably both types are used in combination. For example, polymethyl methacrylate, poly(methyl methacrylate/methacrylic acid=9/1 or 5/5 (mol ratio)), and polystyrene particles are preferably used. The average particle size is preferably from 0.8 to 10 $\mu$m, and particle size distribution is preferably narrower, preferably 90% or more of the entire particle number accounts for 0.9 to 1.1 times of the average particle size. For increasing the matting property, fine particles having a particle size of 0.8 4m or less are preferably added at the same time. For example, polymethyl methacrylate (0.2 $\mu$m), poly(methyl methacrylate/methacrylic acid=9/1 (mol ratio), 0.3 $\mu$m), polystyrene particles (0.25 $\mu$m), and colloidal silica (0.03 $\mu$m) are enumerated.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various antistatic agents, and carbon black, metal oxide particles, nonionic, anionic, cationic and betaine based surfactants or polymers can be preferably used. Such a patrone static prevented is disclosed in JP-A-1-312537 and JP-A-1-312538. In particular, those having the resistance of $10^{12}\Omega$ or less at 25° C., 25% RH are preferred. Usually, plastic patrone is produced using plastics including carbon black or a pigment to impart light shielding. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 cm$^3$ or less and preferably 25 cm$^3$ or less. The weight of the plastics used for the patrone and patrone case is preferably from 5 g to 15 g.

Further, the patrone may be a type of sending out the film by revolving a spool. Further, it may be the structure such that the tip of the film is encased in the body of the patrone and the tip of the film is sent to outside through the port of the patrone by revolving the axle of the spool in the feeding direction of the film. These are disclosed in U.S. Pat. Nos. 4,834,306 and 5,226,613. The photographic film for use in the present invention may be a so-called raw film before development or may be a photographic film development processed. Further, a raw film and a processed film may be contained in the same new patrone, or may be stored in different patrones.

The present invention will be illustrated in more detail with reference to examples below, but these are not to be construed as limiting the invention.

EXAMPLE 1

1) Support

The support which was used in the present invention was prepared as follows.

One hundred (100) weight parts of polyethylene-2,6-naphthalate polymer and 2 weight parts of Tinuvin P. 326 (product of Ciba Geigy), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 μm was obtained. Appropriate amounts of blue dyes, magenta dyes and yellow dyes were added to this PEN film (I-1, I-4, I-6, I-24, I-26, I-27 and II-5 disclosed in Kokai-Giho, Kogi No. 94-6023). Further, the film was wound on to a stainless steel spool having a diameter of 20 cm and provided heat history at 110° C. for 48 hours to obtain a support reluctant to get curling habit.

2) Coating of undercoat layer

After both surfaces of the above support were subjected to corona discharge, UV discharge and glow discharge treatments, on one side of the support an undercoat solution having the following composition was coated (10 cc/m$^2$, using a bar coater): 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of backing layer

On the side of the above undercoated support opposite to the side having been coated with the undercoat solution, an antistatic layer, a magnetic recording layer and a sliding layer having the following compositions were coated as backing layers.

3-1) Coating of antistatic layer

Zero point two (0.2) gram/m of a dispersion of fine particle powder of a stannic oxide-antimony oxide composite having the average particle size of 0.005 μm and specific resistance of 5 Ω·cm (the particle size of the second agglomerate: about 0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree: 10) and 0.22 g/m$^2$ of resorcin were coated.

3-2) Coating of magnetic recording layer

Zero point zero six (0.06) gram/m$^2$ of cobalt-γ-iron oxide which was coating-treated with 3-polyoxyethylene-propyloxytrimethoxysilane (polymerization degree: 15) (15 wt %) (specific surface area: 43 m$^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/m$^2$ of diacetyl cellulose (dispersion of the iron oxide was carried out using an open kneader and a sand mill) and 0.3 g/m$^2$ of $C_2H_5C[CH_2OCONH{-}C_6H_3(CH_3)NCO]_3$ as a curing agent, with acetone, methyl ethyl ketone and cyclohexanone as solvents, were coated with a bar coater to obtain a magnetic recording layer having the film thickness of 1.2 μm. Ten (10) mg/m$^2$ of silica particles (0.3 μm) as a matting agent and 10 mg/m$^2$ of an aluminum oxide abrasive (0.15 μm) coating-treated-with 3-polyoxyethylene-propyloxytrimethoxysilane (polymerization degree: 15) (15 wt %) were added. Drying was conducted at 115° C. for 6 minutes (the temperature of the roller and transporting device of the drying zone was 115° C.). The increase of the color density of D of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of sliding layer

A mixture of diacetyl cellulose (25 mg/m$^2$), $C_6H_{13}CH(OH)C_{10}H_{20}COOC_{40}H_{81}$ (Compound a, 6 mg/m$^2$) and $C_{50}H_{101}O(CH_2CH_2O)_{16}H$ (Compound b, 9 mg/m$^2$) was coated. This mixture was melted in xylene/propylene glycol monomethyl ether (1/1 by volume) by heating at 105° C., and the solution was poured into propylene glycol monomethyl ether (10 time amount) at room temperature and dispersed, and the dispersion was further dispersed in acetone (average particle size: 0.01 μm) and then added to the coating solution. Fifteen (15) mg/m$^2$ of silica particles (0.3 μm) as a matting agent and 15 mg/M$^2$ of an aluminum oxide abrasive (0.15 μm) coating-treated with 3-polyoxyethylene-propyloxytrimethoxysilane (polymerization degree: 15) (15 wt %) were added. Drying was conducted at 115° C. for 6 minutes (the temperature of the roller and transporting device of the drying zone was 115° C.). The thus-obtained sliding layer showed excellent characteristics of dynamic friction coefficient of 0.06 (a stainless steel hard ball of 5 mmφ, load: 100g., speed: 6 cm/min), static friction coefficient of 0.07 (a clip method), and dynamic friction coefficient of 0.12 between the surface of the emulsion described below and the sliding layer.

4) Coating of light-sensitive layer

Next, each layer having the following composition was multilayer coated on the opposite side of the above obtained backing layer and a color negative film was prepared as Sample No. 101.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

Sample No. 101.

| | |
|---|---|
| First Layer: First Antihalation Layer | |
| Black Colloidal Silver | 0.08 as silver |
| Gelatin | 0.70 |
| Second Layer: Second Antihalation Layer | |
| Black Colloidal Silver | 0.09 as silver |
| Gelatin | 1.00 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.17 |
| HBS-2 | 0.02 |
| Third Layer: Interlayer | |
| ExC-2 | 0.05 |
| Polyethyl Acrylate Latex | 0.20 |
| Gelatin | 0.70 |
| Fourth Layer: Low Sensitivity Red-Sensitive Emulsion Layer | |
| Silver Iodobromide Emulsion A | 0.21 as silver |
| Silver Iodobromide Emulsion B | 0.23 as silver |
| Silver Iodobromide Emulsion C | 0.10 as silver |
| ExS-1 | $3.8 \times 10^{-4}$ |
| ExS-2 | $1.6 \times 10^{-5}$ |
| ExS-3 | $5.2 \times 10^{-4}$ |
| ExC-1 | 0.16 |
| ExC-2 | 0.02 |
| ExC-3 | 0.030 |
| ExC-4 | 0.11 |
| ExC-5 | 0.020 |
| ExC-6 | 0.010 |
| Cpd-2 | 0.025 |
| HBS-1 | 0.11 |
| Gelatin | 1.10 |
| Fifth Layer: Middle Sensitivity Red-Sensitive Emulsion Layer | |
| Silver Iodobromide Emulsion C | 0.15 as silver |
| Silver Iodobromide Emulsion D | 0.46 as silver |
| ExS-1 | $4.0 \times 10^{-4}$ |
| ExS-2 | $2.1 \times 10^{-5}$ |
| ExS-3 | $5.7 \times 10^{-4}$ |
| ExC-1 | 0.14 |
| ExC-2 | 0.02 |
| ExC-3 | 0.03 |
| ExC-4 | 0.10 |
| ExC-5 | 0.02 |
| ExC-6 | 0.01 |
| Cpd-4 | 0.030 |
| Cpd-2 | 0.05 |
| HBS-1 | 0.11 |
| Gelatin | 0.75 |
| Sixth Layer: High Sensitivity Red-Sensitive Emulsion Layer | |
| Silver Iodobromide Emulsion E | 1.28 as silver |
| ExS-1 | $2.5 \times 10^{-4}$ |
| ExS-2 | $1.1 \times 10^{-5}$ |
| ExS-3 | $3.6 \times 10^{-4}$ |
| ExC-1 | 0.12 |
| ExC-3 | 0.12 |
| ExC-6 | 0.020 |
| ExC-7 | 0.010 |
| Cpd-2 | 0.050 |
| Cpd-4 | 0.020 |
| HBS-1 | 0.23 |
| HBS-2 | 0.10 |
| Gelatin | 1.40 |
| Seventh Layer: Interlayer | |
| Cpd-1 | 0.060 |
| Solid Dispersion Dye ExF-4 | 0.030 |
| HBS-1 | 0.040 |
| Polyethyl Acrylate Latex | 0.15 |
| Gelatin | 1.10 |

-continued

| | |
|---|---|
| Eighth Layer: Low Sensitivity Green-Sensitive Emulsion Layer | |
| Silver Iodobromide Emulsion F | 0.22 as silver |
| Silver Iodobromide Emulsion G | 0.35 as silver |
| ExS-7 | $1.4 \times 10^{-4}$ |
| ExS-8 | $6.2 \times 10^{-4}$ |
| ExS-4 | $2.7 \times 10^{-5}$ |
| ExS-5 | $7.0 \times 10^{-5}$ |
| ExS-6 | $2.7 \times 10^{-4}$ |
| ExM-3 | 0.405 |
| ExM-4 | 0.085 |
| ExY-1 | 0.070 |
| ExY-5 | 0.0070 |
| HBS-1 | 0.30 |
| HBS-3 | 0.015 |
| Cpd-4 | 0.010 |
| Gelatin | 0.95 |
| Ninth Layer: Middle Sensitivity Green-Sensitive Emulsion Layer | |
| Silver Iodobromide Emulsion G | 0.47 as silver |
| Silver Iodobromide Emulsion H | 0.48 as silver |
| ExS-4 | $4.8 \times 10^{-5}$ |
| ExS-7 | $2.1 \times 10^{-4}$ |
| ExS-8 | $9.3 \times 10^{-4}$ |
| ExC-8 | 0.0020 |
| ExM-3 | 0.115 |
| ExM-4 | 0.035 |
| ExY-1 | 0.010 |
| ExY-4 | 0.010 |
| ExY-5 | 0.0050 |
| Cpd-4 | 0.011 |
| HBS-1 | 0.13 |
| HBS-3 | $4.4 \times 10^{-3}$ |
| Gelatin | 0.80 |
| Tenth Layer: High Sensitivity Green-Sensitive Emulsion Layer | |
| Silver Iodobromide Emulsion I | 1.30 as silver |
| ExS-4 | $4.5 \times 10^{-5}$ |
| ExS-7 | $1.2 \times 10^{-4}$ |
| ExS-8 | $5.3 \times 10^{-4}$ |
| ExC-1 | 0.021 |
| ExM-1 | 0.010 |
| ExM-2 | 0.030 |
| ExM-5 | 0.0070 |
| ExM-6 | 0.0050 |
| Cpd-3 | 0.017 |
| Cpd-4 | 0.040 |
| HBS-1 | 0.25 |
| Polyethyl Acrylate Latex | 0.15 |
| Gelatin | 1.33 |
| Eleventh Layer: Yellow Filter Layer | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |
| Twelfth Layer: Low Sensitivity Blue-Sensitive Emulsion Layer | |
| Silver Iodobromide Emulsion J | 0.09 as silver |
| Silver Iodobromide Emulsion K | 0.10 as silver |
| Silver Iodobromide Emulsion L | 0.25 as silver |
| ExS-9 | $8.4 \times 10^{-4}$ |
| ExC-1 | 0.03 |
| ExC-8 | $7.0 \times 10^{-3}$ |
| ExY-1 | 0.050 |
| ExY-2 | 0.70 |
| ExY-3 | 0.45 |
| ExY-4 | 0.040 |
| Cpd-2 | 0.10 |
| Cpd-4 | 0.01 |
| Cpd-3 | $4.0 \times 10^{-3}$ |
| HBS-1 | 0.28 |
| Gelatin | 2.10 |

-continued

| | |
|---|---|
| Thirteenth Layer: | |
| High Sensitivity Blue-Sensitive Emulsion Layer | |
| Silver Iodobromide Emulsion M | 0.58 as silver |

Further, W-1 to W-3, B-4 to B-6, F-1 to F-18, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE 1

| Emulsion | Average AgI Content | Average Grain Size, Equivalent-Sphere Diameter (μm) | Variation Coefficient of the Grain Size (%) | Projected Area, Equivalent-Circle Diameter (μm) | Diameter/Thickness Ratio | Tabularity |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 4.7 | 0.85 | 22 | 1.36 | 5.5 | 22 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 7.5 | 0.85 | 24 | 1.30 | 5.0 | 19 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.3 | 1.05 | 20 | 1.46 | 3.7 | 9 |
| N | 1.0 | 0.07 | — | — | 1.0 | — |

In Table 1:
(1) Emulsions J to M were reduction sensitized during preparation of the grains using thiourea dioxide and thiosulfonic acid according to the examples of JP-A-2-191938 (corresponding to U.S. Pat. No. 5,061,614).
(2) Emulsions C to I, and M were gold, sulfur, and selenium sensitized, respectively, in the presence of the spectral sensitizing dyes which are described at each light-sensitive layer and sodium thiocyanate according to the examples of JP-A-3-237450 (corresponding to EP-A-443453).
(3) Low molecular weight gelatin was used in the preparation of the tabular grains according to the examples of JP-A-1-158426.
(4) In tabular grains, there were observed such dislocation lines as disclosed in JP-A-3-237450 (corresponding to EP-A-443453), using a high pressure electron microscope.
(5) Emulsions A to E, G, H, and J to M contained optimal amounts of Rh, Ir and Fe.

-continued

| | |
|---|---|
| ExS-9 | $3.5 \times 10^{-4}$ |
| ExY-2 | 0.070 |
| ExY-3 | 0.070 |
| ExY-4 | 0.0050 |
| Cpd-2 | 0.10 |
| Cpd-3 | $1.0 \times 10^{-3}$ |
| Cpd-4 | 0.02 |
| HBS-1 | 0.075 |
| Gelatin | 0.55 |
| Fourteenth Layer: First Protective Layer | |
| Silver Iodobromide Emulsion N | 0.10 as silver |
| UV-1 | 0.13 |
| UV-2 | 0.10 |
| UV-3 | 0.16 |
| UV-4 | 0.025 |
| ExF-8 | 0.001 |
| ExF-9 | 0.002 |
| HBS-1 | $5.0 \times 10^{-2}$ |
| HBS-4 | $5.0 \times 10^{-2}$ |
| Gelatin | 1.8 |
| Fifteenth Layer: Second Protective Layer | |
| H-1 | 0.40 |
| B-1 (diameter: 1.7 μm) | 0.04 |
| B-2 (diameter: 1.7 μm) | 0.09 |
| B-3 | 0.13 |
| ES-1 | 0.20 |
| Gelatin | 0.70 |

Further, tabularity is defined by $Dc/t^2$, taking the average equivalent-circle diameter in the projected area of tabular grains as Dc and the average thickness of tabular grains as t.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The dispersion was performed using a BO-type vibrating ball mill manufactured by Chuo Koki K.K. The content was taken out after dispersion and added to 8 g of a 12.5% aqueous solution of gelatin and the beads were removed by filtration and the gelatin dispersion of the dye was obtained. The average particle size of fine particles of the dye was 0.44 μm.

Solid dispersions of ExF-3, ExF-4 and ExF-6 were obtained in the same manner. The average particle sizes of fine particles of the dyes were 0.24 μm, 0.45 μm and 0.52 μm, respectively. ExF-5 was dispersed according to the micro-precipitation dispersion method disclosed in Working Example 1 of EP-A-549489. The average particle size was 0.06 μm.

ExC-1
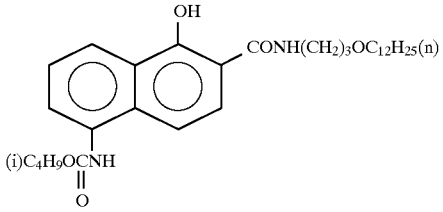
ExC-2
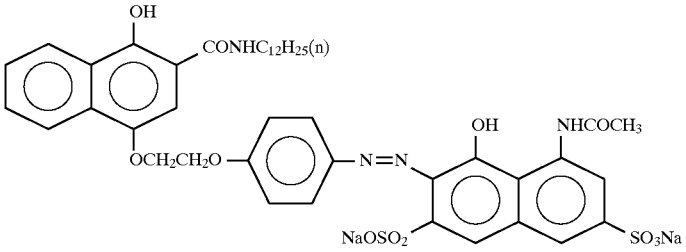
ExC-3
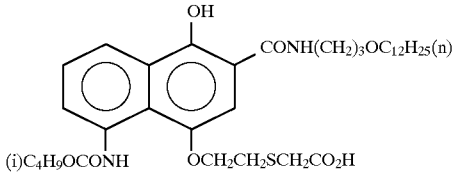
ExC-4
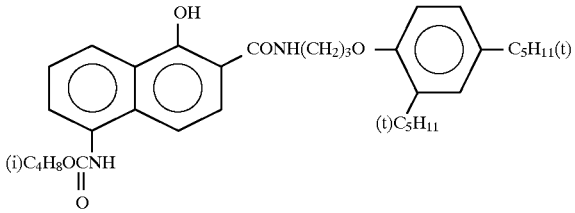
ExC-5
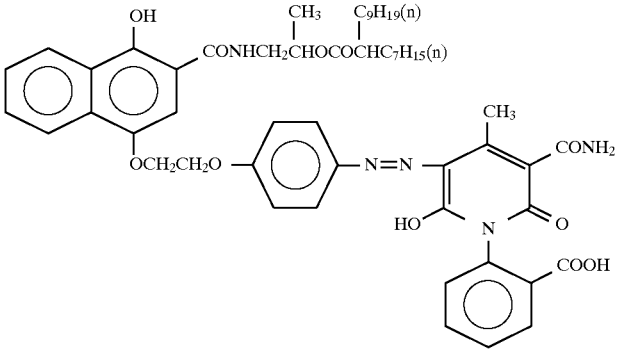
ExC-6
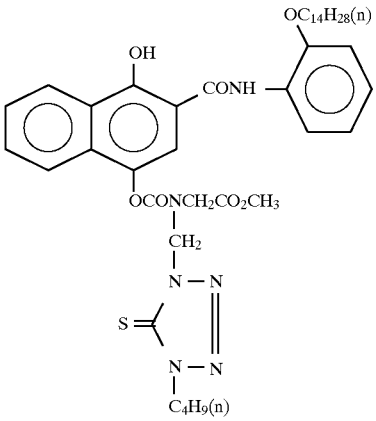

-continued
ExC-7
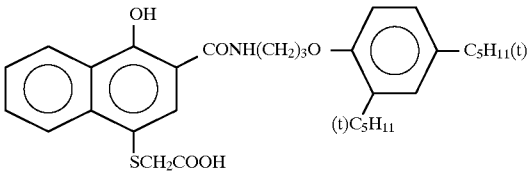
ExC-8
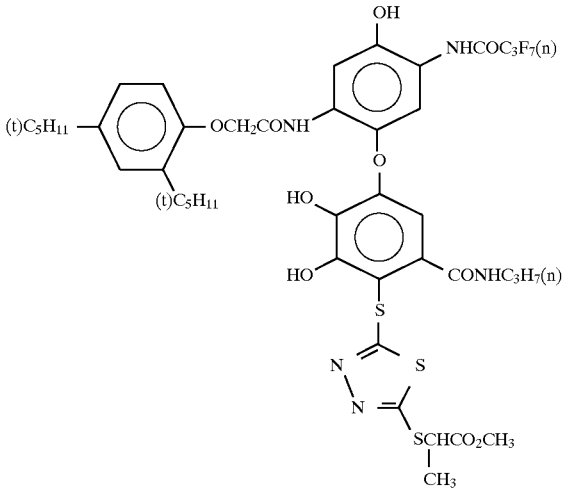
ExM-1
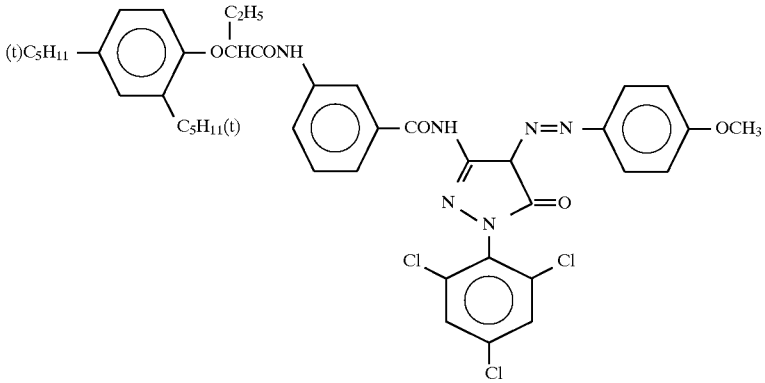
ExM-2
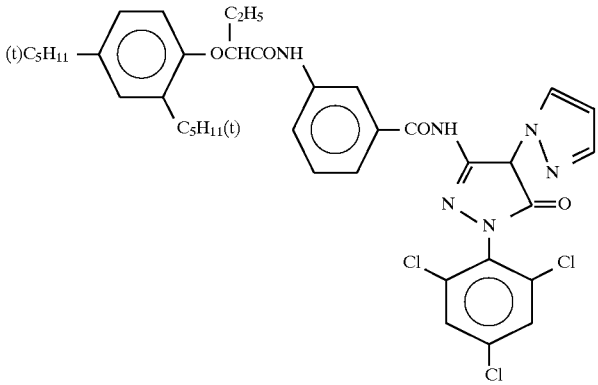

-continued
ExM-3
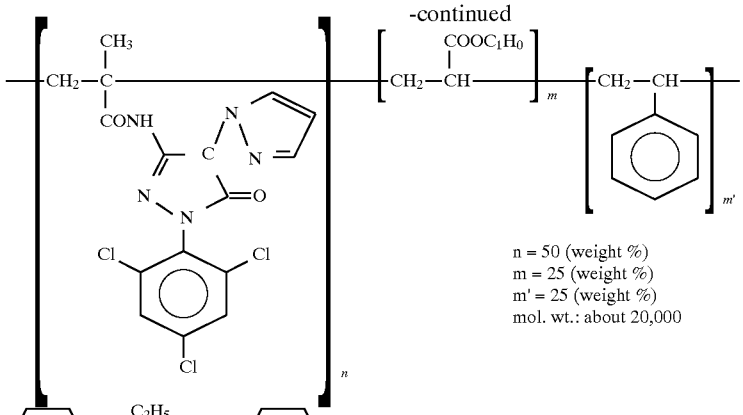
n = 50 (weight %)
m = 25 (weight %)
m' = 25 (weight %)
mol. wt.: about 20,000
ExM-4
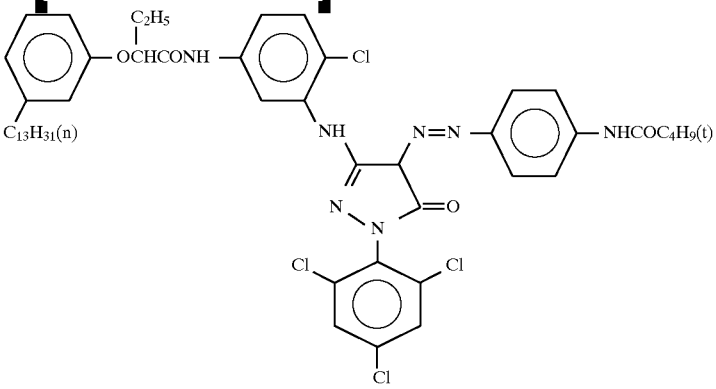
ExM-5
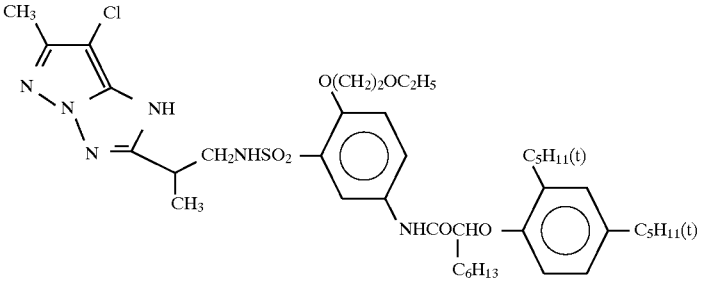
ExM-6
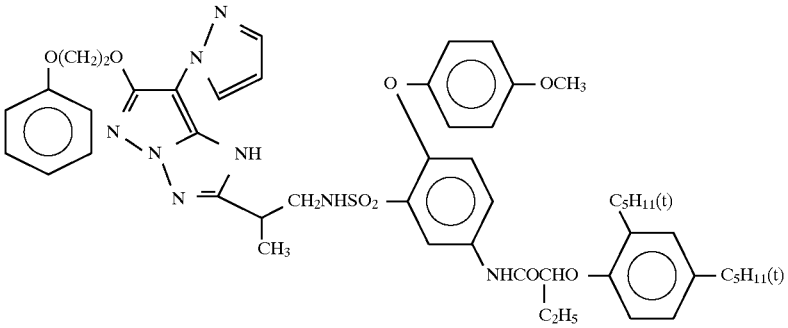
ExY-1
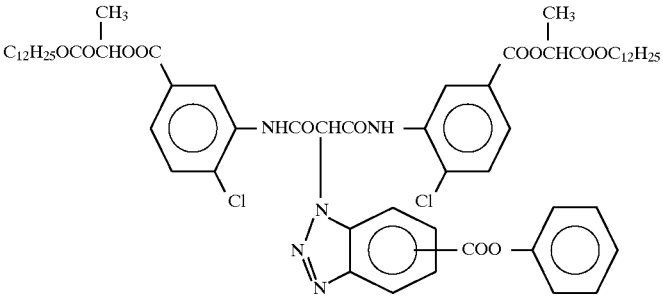

-continued
ExY-2
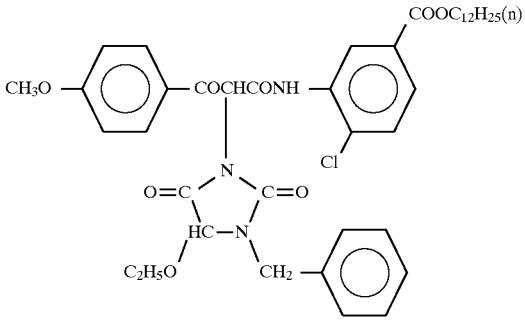
ExY-3
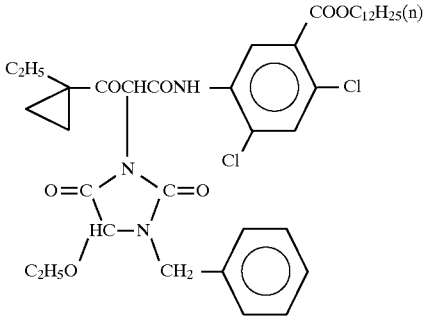
ExY-4
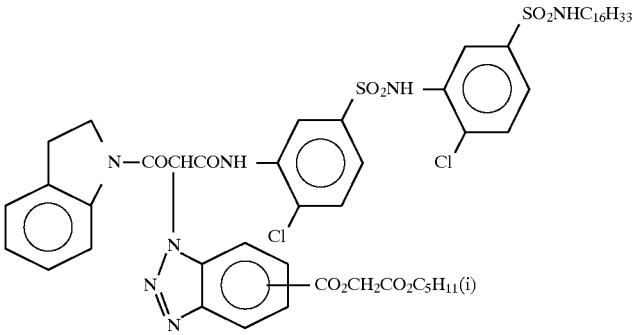
ExY-5
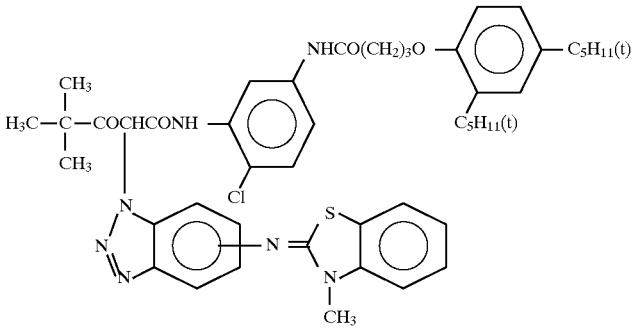
ExF-1
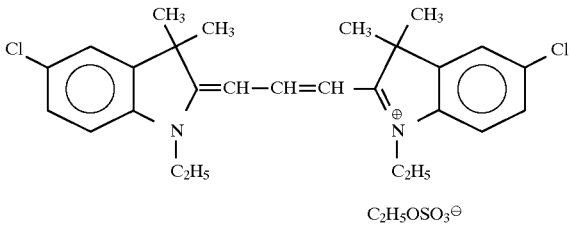

-continued
ExF-2
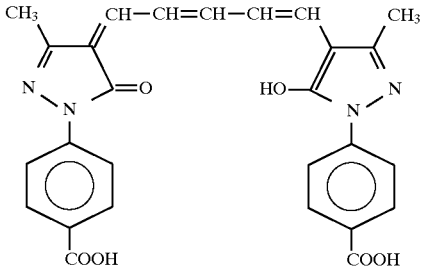
ExF-3
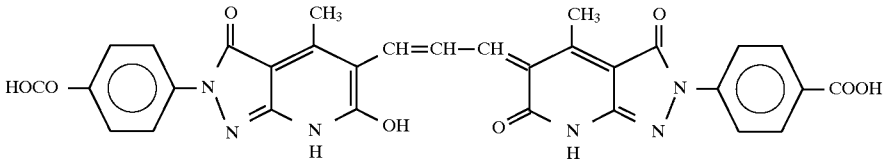
ExF-4
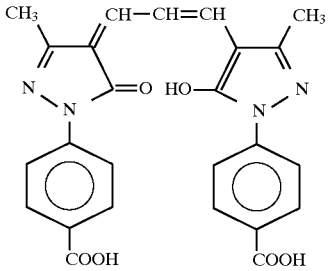
ExF-5
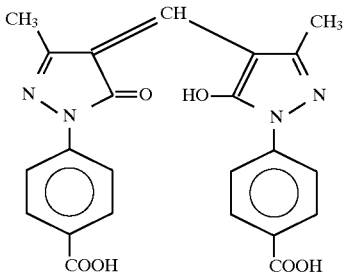
ExF-6
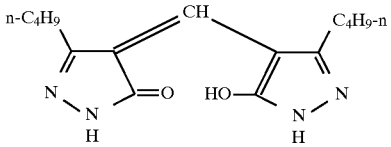
ExF-7
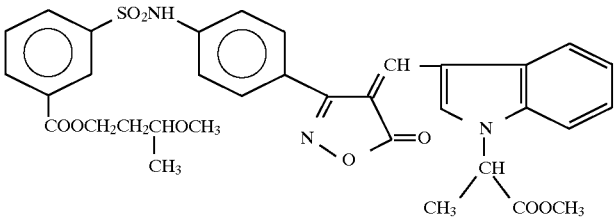
ExF-8
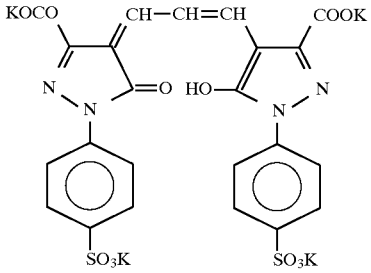

-continued
ExF-9
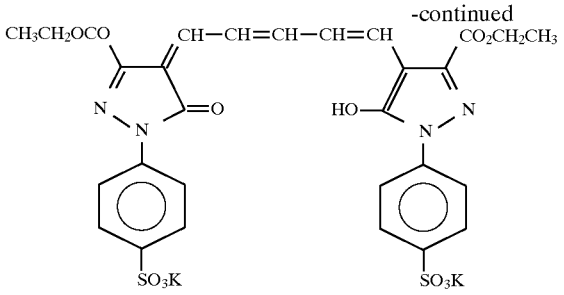
Cpd-1
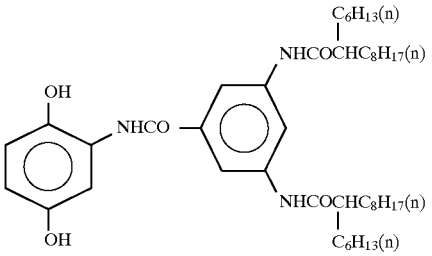
Cpd-2
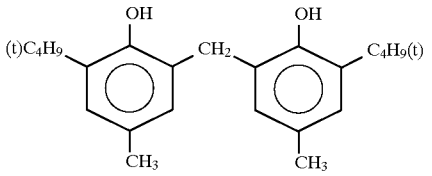
Cpd-3
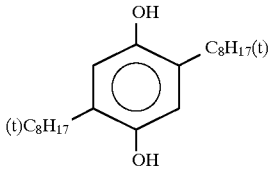
Cpd-4
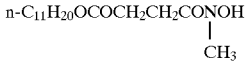
UV-1
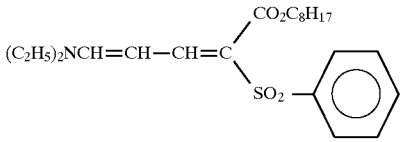
UV-2
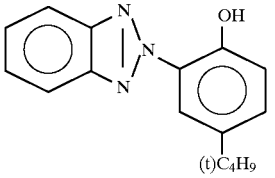
UV-4
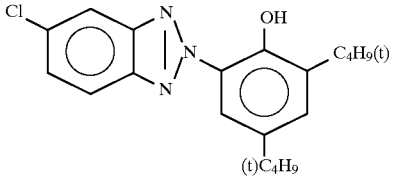
UV-3
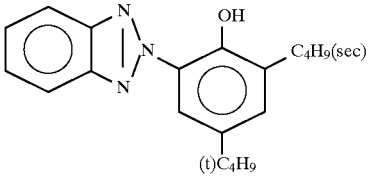

-continued
Tricresyl Phosphate HBS-1
Di-n-butyl Phthalate HBS-2
HSB-3
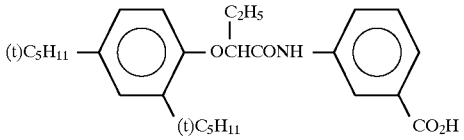
Tri(2-ethylhexyl) Phosphate HBS-4
ExS-1
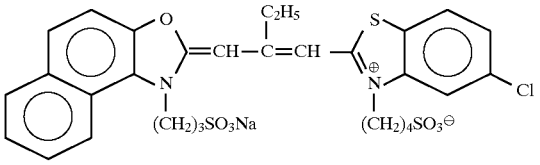
ExS-2
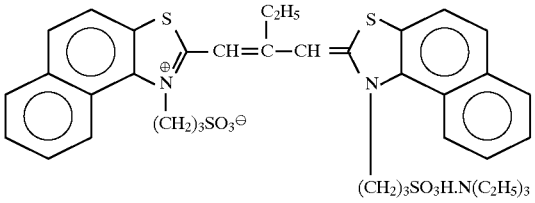
ExS-3
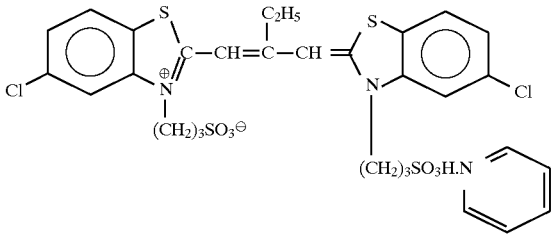
ExS-4
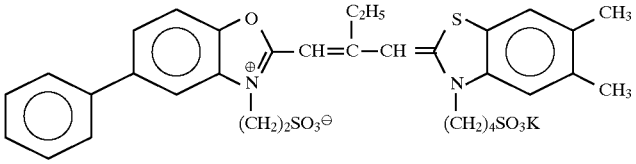
ExS-5
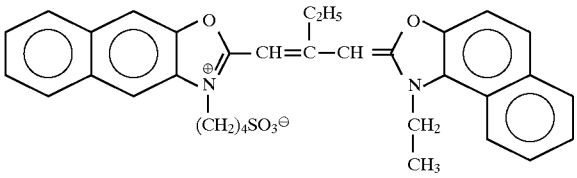
ExS-6
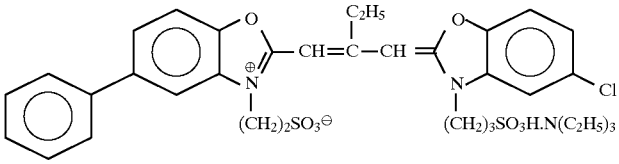
ExS-7
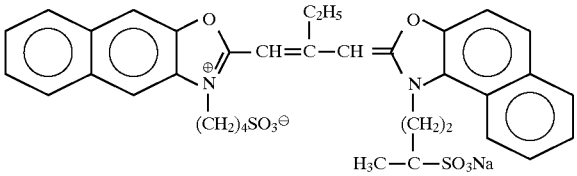

-continued
ExS-8
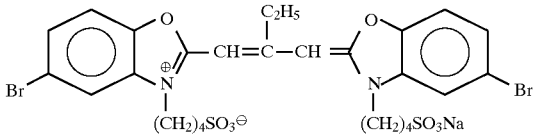
ExS-9
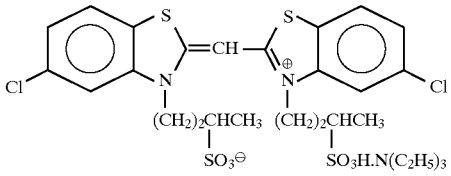
ES-1
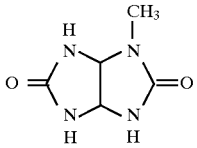
H-1
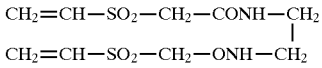
B-1
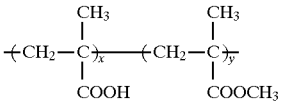
x/y = 10/90 (weight ratio)
average molecular weight:
about 35,000
B-2
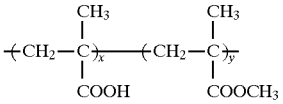
x/y = 40/60 (weight ratio)
average molecular weight:
about 20,000
B-3
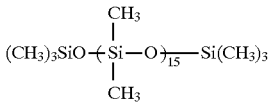
B-4
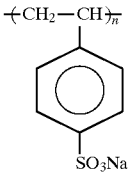
average molecular weight:
about 750,000
n = an integer
B-5
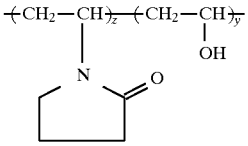
x/y = 70/30 (weight ratio)
average molecular weight:
about 17,000
B-6
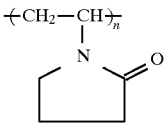
avergae molecular weight:
about 10,000
n = an integer
W-1
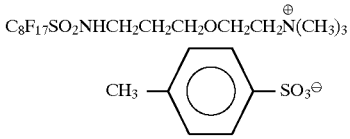
W-2
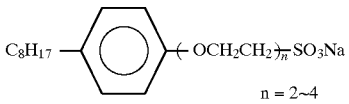
n = 2~4

-continued
W-3
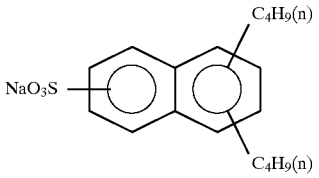
F-1
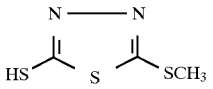
F-2
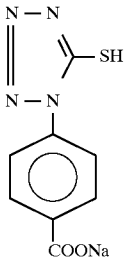
F-3
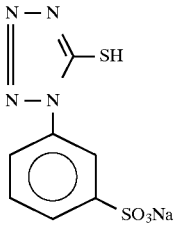
F-4
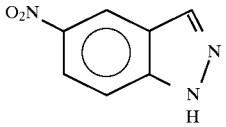
F-5
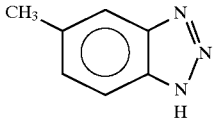
F-6
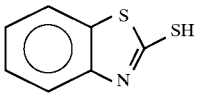
F-7
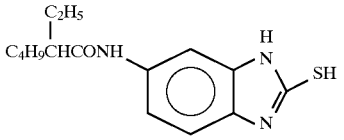
F-8
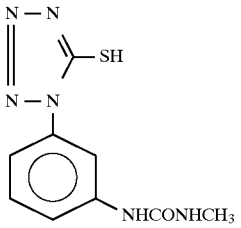
F-9
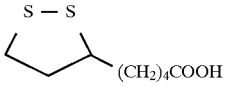

-continued

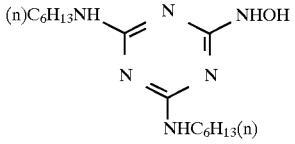

F-10

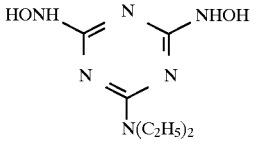

F-11

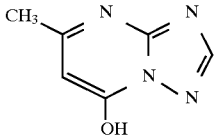

F-12

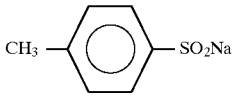

F-13

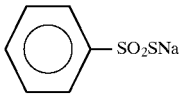

F-14

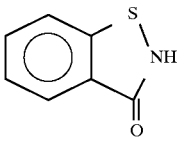

F-15

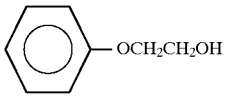

F-16

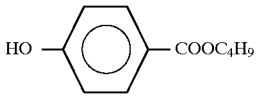

F-17

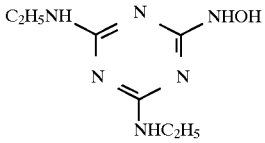

F-18

Sample Nos. 102 to 109 were prepared in the same manner as the preparation of Sample No. 101 except that metal complexes of photographically useful compounds according to the present invention as shown in Table 2 were added to the fourth and fifth layers of Sample No. 101 in the amount of 0.35 mmol, respectively, per $m^2$ of the photographic material. Metal complexes of photographically useful compounds (2), (41), (57) and (94) were added to samples as solid dispersions and (5), (12), (31) and (75) as emulsified dispersions.

Preparation of solid dispersions of metal complexes of photographically useful compounds (2), (41), (57) and (94) according to the present invention, which were added to samples as solid dispersions, was carried out according to the following procedure. Five (5) mmol of the compound to be dispersed, Demole SNB (produced by Kao Corporation) in a ½ weight of the compound, 20 ml of water and 100 g of zirconia beads (diameter: 0.5 mm) were added to a vessel having a capacity of ⅛ gallon, and dispersed using a sand grinder TSG-⅛-4U (a product of AIMEX) at 1,500 rpm for 2 hours. After dispersion, beads were filtered off to obtain dispersion solution.

The average particle sizes of fine particles of metal complexes of photographically useful compounds (2), (41), (57) and (94) in the dispersion solution were 0.42 μm, 0.49 μm, 0.38 μm and 0.50 μm, respectively. The content of each compound in the dispersion solution was obtained by determination by an atomic absorption analysis of the metal ion in homogeneous solution obtained by a wet ashing method.

Metal complexes of photographically useful compounds (5), (12), (31) and (75) were emulsion dispersed with oil-soluble substances contained in each layer.

Each sample was prepared two and two and wedgewise exposed to a light source having energy distribution of 4,800° K of black body radiation, then development processing I-1 and development processing II-1 described above were conducted.

Absorption densities of cyan, magenta and yellow were measured by status M condition to obtain a characteristic curve. From the characteristic curve obtained, the gradient of each of cyan, magenta and yellow was searched for by the method described above. The ratios of the gradients in processing II-1 to the gradients in processing I-1 are shown in Table 2.

TABLE 2

| Sample No. | Metal Complex of Photographically Useful Compound | $\gamma_{II}$ (C)/ $\gamma_{I}$ (C) | $\gamma_{II}$ (M)/ $\gamma_{I}$ (M) | $\gamma_{II}$ (Y)/ $\gamma_{I}$ (Y) | Remarks |
|---|---|---|---|---|---|
| 101 | — | 0.71 | 0.95 | 0.95 | Comparison |
| 102 | (2) | 0.91 | 0.93 | 0.95 | Invention |
| 103 | (5) | 0.95 | 0.95 | 0.93 | Invention |
| 104 | (12) | 0.99 | 1.03 | 0.95 | Invention |
| 105 | (31) | 0.87 | 0.94 | 0.94 | Invention |
| 106 | (41) | 0.91 | 0.96 | 0.95 | Invention |
| 107 | (57) | 0.89 | 0.91 | 0.96 | Invention |
| 108 | (75) | 0.83 | 0.91 | 0.94 | Invention |
| 109 | (94) | 0.85 | 0.92 | 0.95 | Invention |

As is apparent from the results in Table 2, color photographic materials to which the compounds according to the present invention were incorporated showed almost the same gradient in both rapid processing and general processing and images having excellent color reproducibility could be obtained.

EXAMPLE 2

Sample Nos. 101, 103 and 104 were subjected to the same exposure as in Example 1, and development processing A-1 and B-1 to B-4 shown below were carried out. Development processing B-2 to B-4 were the same processing with development processing B-1 except that the kind of the water-soluble nitrogen-containing heterocyclic carboxylic acid chelating agent contained in the color developing solution of development processing B-1 was changed as shown below and added in equimolar amount.

Processing Step of Development Processing A-1 and Composition of the Solution

Processing Step

| Step | Processing Time | Processing Temperature (°C.) | Replenishment Rate* (ml) | Tank Capacity (liter) |
|---|---|---|---|---|
| Color Development | 3 min 5 sec | 38.0 | 23 | 17 |
| Bleaching | 50 sec | 38.0 | 5 | 5 |
| Blixing | 50 sec | 38.0 | — | 5 |
| Fixing | 50 sec | 38.0 | 16 | 5 |
| Washing | 30 sec | 38.0 | 34 | 3.5 |
| Stabilization (1) | 20 sec | 38.0 | — | 3 |
| Stabilization (2) | 20 sec | 38.0 | 20 | 3 |
| Drying | 1 min 30 sec | 60 | | |

*Replenishing rate: per 1.1 meter of 35 mm wide photographic material (corresponding to a 24 Ex. film)

Stabilization was conducted in a countercurrent system from (2) to (1), and the overflow from the washing tank was all introduced into the fixing tank. The upper portion of the bleaching tank and the upper portion of the fixing tank of the automatic processor were notched so that the overflow produced by the supply of the replenishers to the bleaching tank and the fixing tank were all introduced into the blixing tank. Further, the amount of carryover of the developing solution into the bleaching step, the amount of carryover of the bleaching solution to the blixing step, the amount of carryover of the blixing solution to the fixing step, and the amount of carryover of the fixing solution to the washing step were 2.5 ml, 2.0 ml, 2.0 ml, and 2.0 ml per 1.1 meter of 35 mm wide photographic material, respectively. Further, the crossover time was 6 seconds in each case, and this time is included in the processing time of the previous step.

The composition of each processing solution is described below.

| | Tank Solution (g) | Replenisher (g) |
|---|---|---|
| Color Developing Solution | | |
| Diethylenetriaminepentaacetic Acid | 2.0 | 2.0 |
| 1-Hydroxyethylidene-1,1-diphosphonic Acid | 2.0 | 2.0 |
| Sodium Sulfite | 3.9 | 5.1 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | — |
| 2-Methyl-4-[N-ethyl-N-(β-hydroxyethyl)amino]aniline Sulfate | 4.8 | 6.5 |
| Water to make | 1.0 l | 1.0 l |
| pH (adjusted with potassium hydroxide and sulfuric acid) | 10.05 | 10.15 |
| Bleaching Solution | | |
| Ammonium 1,3-Diaminopropanetetraacetato Ferrate Monohydrate | 130 | 195 |
| Ammonium Bromide | 70 | 105 |
| Ammonium Nitrate | 14 | 21 |
| Hydroxyacetic Acid | 50 | 75 |
| Acetic Acid | 40 | 60 |
| Water to make | 1.0 l | 1.0 l |
| pH (adjusted with aqueous ammonia) | 4.4 | 4.4 |

Blixing Tank Solution

The mixed solution of 15/85 mixture (volume ratio) of the above bleaching tank solution and the following fixing tank solution (pH: 7.0)

| Fixing Solution | Tank Solution (g) | Replenisher (g) |
|---|---|---|
| Ammonium Sulfite | 19 | 57 |
| Aqueous Ammonium Thiosulfate Solution (700 g/liter) | 280 ml | 840 ml |
| Imidazole | 15 | 45 |
| Ethylenediaminetetraacetic Acid | 15 | 45 |
| Water to make | 1.0 l | 1.0 l |
| pH (adjusted with aqueous ammonia and acetic acid) | 7.4 | 7.45 |

Washing Water

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto. The pH of this washing water was in the range of from 6.5 to 7.5.

| Stabilizing Solution | (unit: g) |
|---|---|
| Sodium p-Toluenesulfinate | 0.03 |
| Polyoxyethylene-p-monononylphenyl Ether (average polymerization degree: 10) | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| 1,2-Benzisothiazolin-3-one | 0.10 |
| Water to make | 1.0 l |
| pH | 8.5 |

Processing Step of Development Processing B-1 and Composition of the Solution

Processing Step

| Step | Processing Time (sec) | Processing Temperature (°C.) | Replenishment Rate* (ml) | Tank Capacity (liter) |
|---|---|---|---|---|
| Color Development | 60 | 45.0 | 200 | 1 |
| Bleaching | 20 | 45.0 | 130 | 1 |
| Fixing | 40 | 45.0 | 100 | 1 |
| Washing (1) | 15 | 45.0 | — | 1 |
| Washing (2) | 15 | 45.0 | — | 1 |
| Washing (3) | 15 | 45.0 | 400 | 1 |
| Drying | 45 | 80 | | |

*Replenishing rate: per $m^2$ of a photographic material

From washing (3) to fixing tank in a four-tank multistage countercurrent cascade system The composition of each processing solution is described below.

| | Tank Solution (g) | Replenisher (g) |
|---|---|---|
| Color Developing Solution | | |
| 2,6-Pyridinedicarboxylic Acid | 8.4 | 11.2 |
| Sodium Sulfite | 3.9 | 6.5 |
| Potassium Carbonate | 37.5 | 39.0 |
| Potassium Bromide | 2.0 | — |
| Potassium Iodide | 1.3 mg | — |
| Disodium N,N-Bis(sulfonatoethyl)-hydroxylamine | 12.1 | 17.1 |
| 2-Methyl-4-[N-ethyl-N-(β-hydroxyethyl)amino]aniline Sulfate | 11.5 | 15.0 |
| Water to make | 1.0 l | 1.0 l |
| pH (adjusted with potassium hydroxide and sulfuric acid) | 10.05 | 10.25 |
| Bleaching Solution | | |
| Ammonium 1,3-Diaminopropanetetra-acetato Ferrate Monohydrate | 0.33 | 0.50 |
| Ferric Nitrate 9 Hydrate | 0.30 | 4.5 |
| Ammonium Bromide | 0.80 | 1.20 |
| Ammonium Nitrate | 0.20 | 0.30 |
| Acetic Acid | 0.67 | 1.0 |
| Water to make | 1.0 l | 1.0 l |
| pH (adjusted with aqueous ammonia) | 4.5 | 4.0 |

| Fixing Solution | Replenisher equals tank solution (unit: g) |
|---|---|
| Ammonium sulfite | 28 |
| Aqueous Ammonium Thiosulfate Solution (700 g/liter) | 280 ml |
| Imidazole | 15 |
| Ethylenediaminetetraacetic Acid | 15 |
| Water to make | 1.0 l |
| pH (adjusted with aqueous ammonia and acetic acid) | 5.8 |

Washing Water

The washing water having the same composition as development processing A-1 was used.

Stabilizing Solution

The stabilizing solution having the same composition as development processing A-1 was used.

Water-soluble nitrogen-containing heterocyclic carboxylic acid chelating agent

Development Processing B-1: 2,6-Pyridinedicarboxylic acid

Development Processing B-2: 2,5-Pyridinedicarboxylic acid

Development Processing B-3: Picolinic Acid

Development Processing B-4: Not contained

TABLE 3

| Sample No. | Metal Complex of Photographically Useful Compound | Development Processing (x = B-1 to B-4) | $\gamma_x$ (C)/$\gamma_{A-1}$ (C) | $\gamma_x$ (M)/$\gamma_{A-1}$ (M) | $\gamma_x$ (Y)/$\gamma_{A-1}$ (Y) | Remarks |
|---|---|---|---|---|---|---|
| 101 | — | B-1 | 0.71 | 0.95 | 0.95 | Comparison |
| 101 | — | B-2 | 0.72 | 0.99 | 1.01 | Comparison |
| 101 | — | B-3 | 0.69 | 0.97 | 1.01 | Comparison |
| 101 | — | B-4 | 0.75 | 1.00 | 1.03 | Comparison |
| 103 | (5) | B-1 | 0.95 | 0.95 | 0.93 | Invention |
| 103 | (5) | B-2 | 0.85 | 0.96 | 0.96 | Invention |
| 103 | (5) | B-3 | 0.82 | 0.94 | 0.96 | Invention |
| 103 | (5) | B-4 | 0.72 | 1.01 | 0.97 | Invention |
| 104 | (12) | B-1 | 0.99 | 1.03 | 0.95 | Invention |
| 104 | (12) | B-2 | 0.90 | 0.97 | 0.95 | Invention |
| 104 | (12) | B-3 | 0.87 | 0.96 | 0.93 | Invention |
| 104 | (12) | B-4 | 0.70 | 0.99 | 1.01 | Invention |

As is apparent from the results in Table 3, when color photographic materials of the present invention were subjected to development processing B-1 to B-3, which were rapid processing, the same gradient as subjected to development processing A-1, which was general processing could be provided, and good images could be obtained. On the other hand, it is seen that when development processing B-4 which used a color developing solution not containing a water-soluble nitrogen-containing heterocyclic carboxylic acid chelating agent was conducted, color photographic materials of the present invention did not provide preferred gradient.

EXAMPLE 3

Sample Nos. 110 and 111 were prepared in the same manner as the preparation of Sample No. 101 except that metal complexes of the compounds having photographically useful compounds according to the present invention (43) and (64) were added to the fourth and fifth layers of Sample No. 101 in an amount of 0.35 mmol per $m^2$ of the material, respectively, and the amount of ExC-1 added to the fourth and fifth layers was reduced to one half. Sample No. 112 was prepared by similarly adding the developing agent releasing coupler DRC-1 disclosed in JP-B-61-156126. These samples were subjected to the same development processing in Example 1 and the ratios of the gradients were searched for. The results obtained are shown in Table 4 below.

TABLE 4

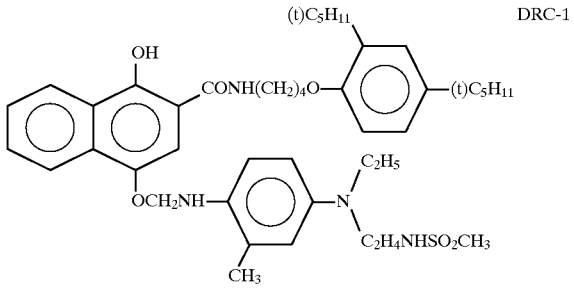

| Sample No. | Compound Added to 4th and 5th Layers | $\gamma_{II}$ (C)/ $\gamma_I$ (C) | $\gamma_{II}$ (M)/ $\gamma_I$ (M) | $\gamma_{II}$ (Y)/ $\gamma_I$ (Y) | Remarks |
|---|---|---|---|---|---|
| 110 | (43) | 0.91 | 0.97 | 0.95 | Invention |
| 111 | (64) | 0.88 | 0.96 | 0.94 | Invention |
| 112 | DRC-1 | 0.73 | 0.94 | 0.94 | Comparison |

As is apparent from the results in Table 4, the obtained to be solved by the present invention cannot be attained only by releasing a development accelerator in a processing solution, but the reaction control is important, which becomes feasible by a photographically useful compound having a metal chelate moiety.

EXAMPLE 4

Samples as shown in Table 5 were prepared and the same development processing as in Example 1 were carried out and the ratios of the gradients were searched for. Every sample provided almost the same gradient in both rapid processing and general processing and images having excellent color reproducibility could be obtained.

TABLE 5

| Sample No. | Metal Complex of Photographically Useful Compound | Addition Layer and Addition amount ($mmol/m^2$) |
|---|---|---|
| 113 | (5) | 4th and 5th, each 0.35 |
| | (82) | 14th, 0.1 |
| 114 | (31) | 4th, 5th, and 7th, each 0.30 |
| | (58) | 6th, 0.1 |
| 115 | (2) | 4th and 5th, each 0.35 |
| | (63) | 3rd, 0.01 |
| | (83) | 4th and 7th, each 0.02 |
| 116 | (12) | 2nd, 0.40, 5th, 0.25 |
| 117 | (41) | 3rd, 0.50, 7th, 0.25, 11th, 0.05 |
| | (59) | 14th, 0.02 |
| 118 | (17) | 4th, 0.10, 13th, 0.05 |
| | (75) | 8th, 9th and 12th, each 0.10 |
| | (94) | 3rd, 0.45, 7th, 0.1 |

EXAMPLE 5

Sample No. 101 were wedgewise exposed to white light through a filter made by combining a red filter, a green filter and a blue filter each having different optical densities. The exposed samples were subjected to development processing I-1 and samples having different gradations of yellow, magenta and cyan densities were prepared. Then, a standard sample subjected to appropriate gray exposure by white light and an ND filter and processed by development processing I-1 was prepared. Using these samples, the ratios of gradients of yellow, magenta and cyan densities in case of combining filters to gradients of a standard sample were obtained.

Based on this exposure conditions, Macbeth color checker was photographed and printed using Sample No. 101 and functional evaluation was conducted with respect to color reproducibility of the printed sample. As a result, if the ratios of the gradients of all of yellow, magenta and cyan to gradients of the standard sample gray exposed are from 0.8 to 1.2, satisfactory images can be obtained by the compensation at printing or as it is. That is, gray not different from the printed image which was obtained using a standard sample could be reproduced.

On the other hand, when gradient ratio of at least one of yellow, magenta and cyan is smaller than 0.8 or larger than 1.2, color balance is upset and other colors were seen overlapped with gray. When the gradient ratios of three of yellow, magenta and cyan are all smaller than 0.8 or larger than 1.2, compared with a standard sample, difference of light and shade of gray was large. Thus, samples not satisfying the gradient ratio cannot produce images not differing from a standard sample.

A silver halide color photographic material and a method of forming images according to the present invention can provide images having excellent color reproducibility.

The present invention can provide a silver halide color photographic material which is improved in the upset of the balance of gradation due to shortening of the color developing time, and which is capable of providing images of the same gradation in any development processing now widely prevailing and super-rapid processing in which the color developing time is speeded up, and a method for forming an image.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having provided thereon at least one blue-sensitive silver halide emulsion layer, at least one green-sensitive silver halide emulsion layer, and at least one red-sensitive silver halide emulsion layer, wherein said photographic material contains at least one compound having a photographically useful compound which is inactivated by the chelation with a metal and is active when chelation with a metal is removed, and when the following development processing I and the following development processing II are carried out, the ratios of the gradients in processing II to the gradients in processing I of yellow, magenta and cyan obtained by said two kinds of development processing satisfy the following conditions:

$0.8 \leqq \gamma_{II}(Y)/\gamma_{I}(Y) \leqq 1.2$ $0.8 \leqq \gamma_{II}(M)/\gamma_{I}(M) \leqq 1.2$ $0.8 \leqq \gamma_{II}(C)/\gamma_{I}(C) \leqq 1.2$ wherein $Y_I(Y)$, $Y_I(M)$, $Y_I(C)$ each represents the gradient of yellow, magenta or cyan when development processing I is carried out and $Y_{II}(Y)$, $Y_{II}(M)$, $Y_{II}(C)$ each represents the gradient of yellow, magenta or cyan when development processing II is carried out, development processing I:

development processing is characterized in that color development processing is carried out (i) for 3 minutes and 15 seconds of the color developing time, (ii) at the temperature of a color developing solution of 38° C., and (iii) using a color developing solution containing form 15 to 20 mmol/liter of 2-methyl-4-(N-ethyl-N-(8-hydroxyethyl)-amin) aniline;

development processing II:

development processing is characterized in that color development processing is carried out (i) for 60 seconds of the color developing time, (ii) at the temperature of a color developing solution of 45° C., and (iii) using a color developing solution containing from 35 to 40 mmol/liter of 2-methyl-4-(N-ethyl-N-(β-hydroxyethyl)-amino)aniline, and containing a water-soluble nitrogen-containing heterocyclic carboxylic acid chelating agent.

2. The silver halide color photographic material as claimed in claim 1, wherein said metal is boron, magnesium, aluminum, calcium, nickel, copper or zinc.

3. The silver halide color photographic material as claimed in claim 1, wherein said photographically useful compound is a developing agent, an auxiliary developing agent, a fogging agent, a development accelerator, or a development inhibitor.

4. The silver halide color photographic material as claimed in claim 1, wherein said compound having a photographically useful compound which is inactivated by the chelation with a metal is represented by the following formula (I), (II) or (III):

$$(PUG—LINK—LIG)_n \cdot M \cdot L_k \quad (I)$$

$$(BP—LINK—LIG)_n \cdot M \cdot L_k \quad (II)$$

$$(PL)_n \cdot M \cdot L_k \quad (III)$$

wherein PUG represents a photographically useful group; LINK represents a single bond or a divalent linking group; LIG represents a chelate group; BP represents a photographically useful group which is blocked; PL represents a photographically useful group having the chelating ability; M represents any of boron, magnesium, aluminum, calcium, nickel, copper or zinc; L represents a chelate ligand; n represents an integer of from 1 to 3; and k represents 0, 1 or 2.

5. The silver halide color photographic material as claimed in claim 4, wherein M represents zinc.

6. The silver halide color photographic material as claimed in claim 4, wherein the atom bonded to M is nitrogen or oxygen.

7. The silver halide color photographic material as claimed in claim 1, wherein said photographic material contains said compound having a photographically useful compound which is inactivated by the chelation with a metal as solid particles.

8. The silver halide color photographic material as claimed in claim 1, wherein said compound having a photographically useful compound which is inactivated by the chelation with a metal is contained in the light-sensitive silver halide emulsion layer nearest to the support or in the layer adjacent thereto.

9. The silver halide color photographic material as claimed in claim 4, wherein LINK includes an ether bond, an alkylene group, or an arylene group, or at least one of $$-\overset{H}{N}-\underset{\underset{O}{\|}}{C}-,\ -\underset{\underset{O}{\|}}{C}-,\ -S-,\ -\underset{\underset{O}{\|}}{C}-O-,$$

$$-\overset{H}{N}-SO_2-,\ -SO-,\ -CH=N-,$$

$$-SO_2-,\ -CH=CH-,\ -\underset{\underset{O}{\|}}{C}-NH-NH-,$$

$$-CH=N-O-,\ -CH-N-NH-.$$

10. The silver halide color photographic material as claimed in claim 4, wherein LIG represents a chelate group having from 2 to 6 coordination groups, wherein the coordination group is a nitrogen-containing heterocyclic residue, a carbonyl group, a carboxyl group, a hydroxyl group, an amino group, a hydroxylamino group, a hydrazino group, an imino group, oxime, hydrazone, an amido group, an imido group, hydrazide or hydroxamic acid.

11. The silver halide color photographic material as claimed in claim 4, wherein a ring formed by a chelate group represented by LIG with a metal atom is a 5-to-8 membered ring.

12. The silver halide color photographic material as claimed in claim 4, wherein PUG is a reducing agent to silver halide, M is zinc, n is 2 and k is zero.

13. The silver halide color photographic material as claimed in claim 4, wherein BP in formula (II) is bonded to LINK-LIG group at the blocking group, and the bond of the blocking group and the photographically useful group are cleaved upon the cleavage of the LIG-M bond, such that said compound of formula (II) is represented by a compound of formula (IV):

$$(PUG—B—LINK—LIG)_n \cdot M \cdot L_k \quad (IV)$$

wherein B represents a blocking group and PUG, LINK, LIG, M, L, n and k are as defined above.

14. The silver halide color photographic material as claimed in claim 1, wherein the gradients satisfy the following conditions:

$0.9 \leqq \gamma_{II}(C)/\gamma_{I}(C) \leqq 1.1$ $0.9 \leqq \gamma_{II}(M)/\gamma_{I}(M) \leqq 1.1$ $0.9 \leqq \gamma_{II}(Y)/\gamma_{I}(Y) \leqq 1.1.$ 15. The silver halide color photographic material as claimed in claim 1, wherein $Y_I(C)$, $Y_I(M)$, $Y_I(Y)$, $Y_{II}(C)$, $Y_{II}(M)$, $Y_{II}(Y)$ each is preferably from 0.50 to 0.90.

16. The silver halide color photographic material as claimed in claim 1, wherein said at least one compound having a photographically useful compound contains a multidentate ligand.

17. A method for forming a color image using the silver halide color photographic material as claimed in claim 1, wherein a color image is formed by carrying out the following development processing A, development processing A:

development processing is characterized in that color development processing is carried out (i) for from 150 seconds to 200 seconds of the color developing time, (ii) at the temperature of a color developing solution of from 35° to 40° C., and (iii) using a color developing solution containing from 10 to 20 mmol/liter of a color developing agent.

18. A method for forming a color image using the silver halide color photographic material as claimed in claim 1, wherein a color image is formed by carrying out the following development processing B, development processing B:

development processing is characterized in that color development processing is carried out (i) for from 25 seconds to 90 seconds of the color developing time, (ii) at the temperature of a color developing solution of from 40 to 60° C., and (iii) using a color developing solution containing from 25 to 80 mmol/liter of a color developing agent, and containing a water-soluble nitrogen-containing heterocyclic carboxylic acid chelating agent.

* * * * *